US009495905B2

(12) United States Patent
Omata et al.

(10) Patent No.: US 9,495,905 B2
(45) Date of Patent: Nov. 15, 2016

(54) DISPLAY APPARATUS

(71) Applicant: Japan Display Inc., Minato-ku (JP)

(72) Inventors: Kazuyoshi Omata, Tokyo (JP); Hiroyuki Kimura, Tokyo (JP); Makoto Shibusawa, Tokyo (JP)

(73) Assignee: Japan Display Inc., Minato-ku (JP)

( * ) Notice: Subject to any disclaimer, the term of this patent is extended or adjusted under 35 U.S.C. 154(b) by 128 days.

(21) Appl. No.: 14/056,346

(22) Filed: Oct. 17, 2013

(65) Prior Publication Data

US 2014/0111557 A1 Apr. 24, 2014

(30) Foreign Application Priority Data

Oct. 19, 2012 (JP) ..... 2012-231739
Feb. 18, 2013 (JP) ..... 2013-029135
Mar. 6, 2013 (JP) ..... 2013-044447

(51) Int. Cl.
*G09G 3/32* (2016.01)

(52) U.S. Cl.
CPC .... *G09G 3/3233* (2013.01); *G09G 2300/0426* (2013.01); *G09G 2300/0452* (2013.01); *G09G 2300/0465* (2013.01); *G09G 2300/0819* (2013.01); *G09G 2300/0852* (2013.01); *G09G 2300/0861* (2013.01); *G09G 2310/0251* (2013.01); *G09G 2310/0297* (2013.01)

(58) Field of Classification Search
CPC ..... G09G 2320/0276; G09G 2360/16; G09G 2320/0626; G09G 3/3468; G09G 3/3611
USPC ..... 345/690
See application file for complete search history.

(56) References Cited

U.S. PATENT DOCUMENTS

| | | | | |
|---|---|---|---|---|
| 6,229,506 | B1 | 5/2001 | Dawson et al. | |
| 8,018,405 | B2 | 9/2011 | Kwak et al. | |
| 8,242,982 | B2 | 8/2012 | Kang et al. | |
| 2001/0019384 | A1 * | 9/2001 | Murade | G02F 1/133512 349/110 |
| 2013/0033631 | A1 * | 2/2013 | Mabuchi | H04N 5/37452 348/302 |

FOREIGN PATENT DOCUMENTS

| | | |
|---|---|---|
| CN | 1837908 A | 9/2006 |
| CN | 101110187 A | 1/2008 |
| JP | 2007-310311 | 11/2007 |
| JP | 2008-83680 | 4/2008 |

(Continued)

OTHER PUBLICATIONS

Office Action issued Jul. 17, 2014 in Korean Patent Application No. 10-2013-0122900 (with English language translation).

(Continued)

*Primary Examiner* — Claire X Pappas
*Assistant Examiner* — Ngan T Pham Lu
(74) *Attorney, Agent, or Firm* — Oblon, McClelland, Maier & Neustadt, L.L.P.

(57) ABSTRACT

According to one embodiment, a display apparatus includes a plurality of pixels and a plurality of control lines. A pixel circuit of each of the pixels includes a driving transistor, an output switch, a pixel switch and a storage capacitance. A number of pixels PX of the plurality of pixels which are adjacent to one another in a column direction share the output switch.

22 Claims, 41 Drawing Sheets

(56) References Cited

FOREIGN PATENT DOCUMENTS

| | | | | |
|---|---|---|---|---|
| JP | 2008-268437 | A | | 11/2008 |
| JP | 2010-54788 | | | 3/2010 |
| JP | 2011-145622 | | | 7/2011 |
| JP | 2011145622 | | * | 7/2011 |
| JP | 2012-108192 | | | 6/2012 |
| JP | 2012-194256 | | | 10/2012 |
| KR | 10-2006-0103181 | A | | 9/2006 |
| KR | 20060103181 | | * | 9/2006 |
| KR | 10-0922065 | B1 | | 10/2009 |

OTHER PUBLICATIONS

Combined Chinese Office Action and Search Report issued May 25, 2015 in Patent Application No. 201310492387.2 (with English language translation).
Office Action mailed Aug. 2, 2016, in Japanese Patent Application No. 2012-231739 (with English-language translation).
Office Action issued Sep. 6, 2016 in Japanese Patent Application No. 2013-044447 (with English-language Translation).
Office Action issued Sep. 13, 2016 in Japanese Patent Application No. 2013-029135 (with English-language Translation).

* cited by examiner

DISPLAY APPARATUS

CROSS-REFERENCE TO RELATED APPLICATIONS

This application is based upon and claims the benefit of priority from Japanese Patent Applications No. 2012-231739, filed Oct. 19, 2012; No. 2013-029135, filed Feb. 18, 2013; and No. 2013-044447, filed Mar. 6, 2013, the entire contents of all of which are incorporated herein by reference.

FIELD

Embodiments described herein relate generally to a display apparatus.

BACKGROUND

In recent years, demand for flat panel display apparatuses typified by liquid crystal display apparatuses has been increasing rapidly due to the characteristics of these display apparatuses such as reduced thickness, weight, and power consumption. Among these display apparatuses, active matrix display apparatus, which includes, in each pixel, a pixel switch having a function of electrically isolating an on pixel and an off pixel and maintaining video signal to the on pixel is utilized for various displays, such as a portable information device.

As such flat-panel active matrix display apparatuses, organic EL display apparatuses using self-illuminated elements have been gathering attention and undergoing active research and development. An organic EL display apparatus is characterized by eliminating the need for a backlight, being suitable for reproduction of moving images due to the high-speed responsiveness thereof, and being suitable for use in cold regions because the organic EL display apparatus is prevented from decreasing in luminance at low temperatures.

In general, the organic EL display apparatus comprises a plurality of pixels juxtaposed in a plurality of rows and a plurality of columns. Each pixel comprises an organic EL element that is a self-illuminated element and a pixel circuit that supplies a driving current to the organic EL element. The pixel performs a display operation by controlling the luminance of the organic EL element.

For driving of a pixel circuit, a driving scheme based on a voltage signal is known. Furthermore, a display apparatus has been proposed which switches a voltage source between a high state and a low state and which outputs both a video signal and an initialization signal through a video signal line, thus reducing the numbers of elements and lines included in each pixel and the layout area of the pixel to increase definition.

DETAILED DESCRIPTION

In general, according to one embodiment, there is provided a display apparatus comprising a plurality of pixels each comprising a display element connected between a high-potential power supply and a low-potential power supply and a pixel circuit configured to control driving of the display element, the pixels being provided in a matrix along a row direction and a column direction, and a plurality of control lines comprising a plurality of reset lines and extending in the row direction to connect to the pixel circuits of the plurality of pixels. The pixel circuit comprises a driving transistor including a source electrode connected to the display element, a drain electrode connected to the reset line, and a gate electrode, an output switch connected between the high-potential power supply and the drain electrode of the driving transistor and configured to switch a state between the high-potential power supply and the drain electrode of the driving transistor to an electrically continuous state or an electrically discontinuous state, a pixel switch connected between a video signal line and the gate electrode of the driving transistor and configured to discriminate whether a signal provided via the video signal line is input to a side of the gate electrode side of the transistor, and a storage capacitance connected between the source electrode and the gate electrode of the driving transistor. A number of pixels PX of the plurality of pixels which are adjacent to one another in the column direction share the output switch.

A display apparatus and a method of driving the display apparatus according to a first embodiment will be described below in detail with reference to the drawings. According to the first embodiment, the display apparatus is an active matrix display apparatus, and more specifically, an active matrix organic EL (ElecroLuminescence) display apparatus.

Figure 1:
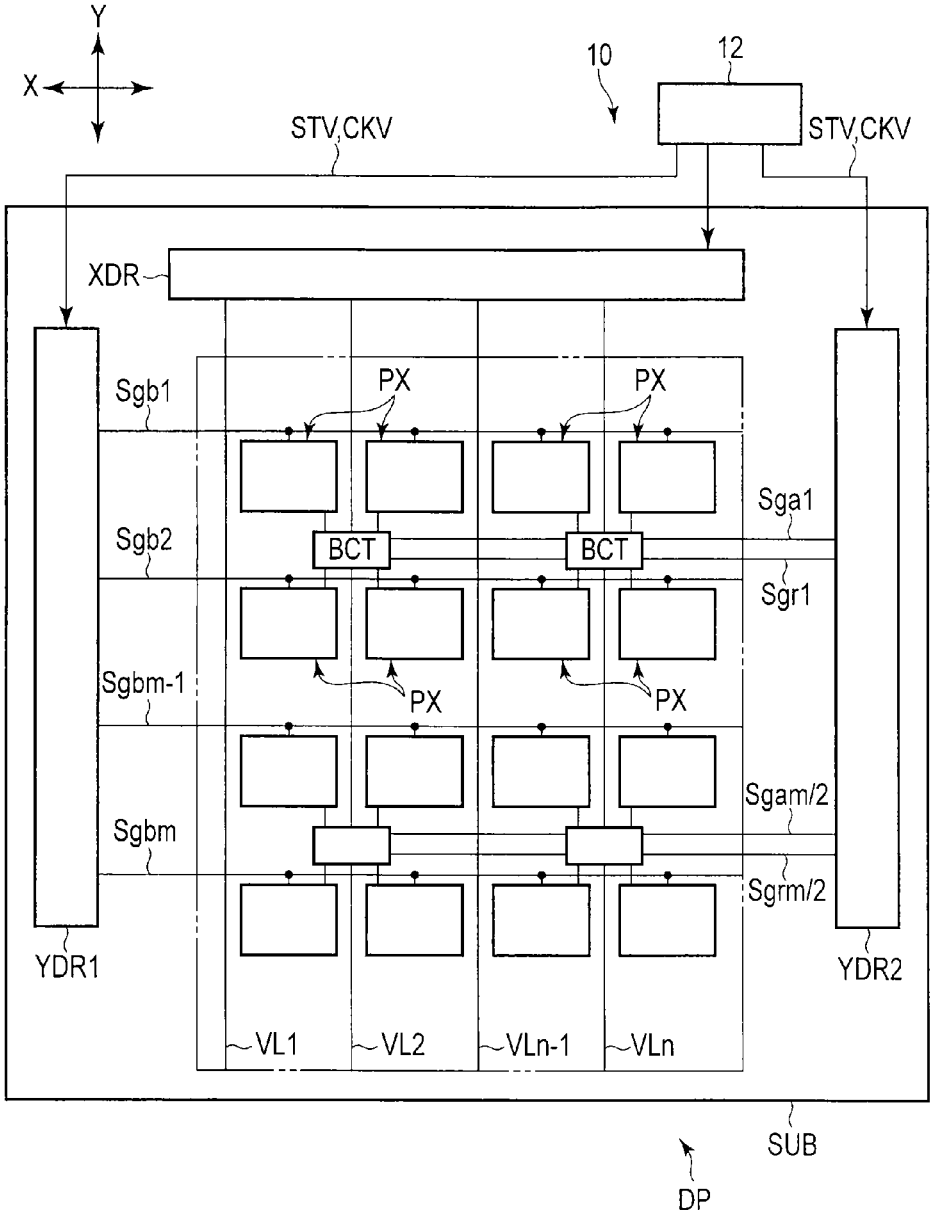
FIG. 1 is a plan view schematically showing a display apparatus according to a first embodiment.
Figure 2:
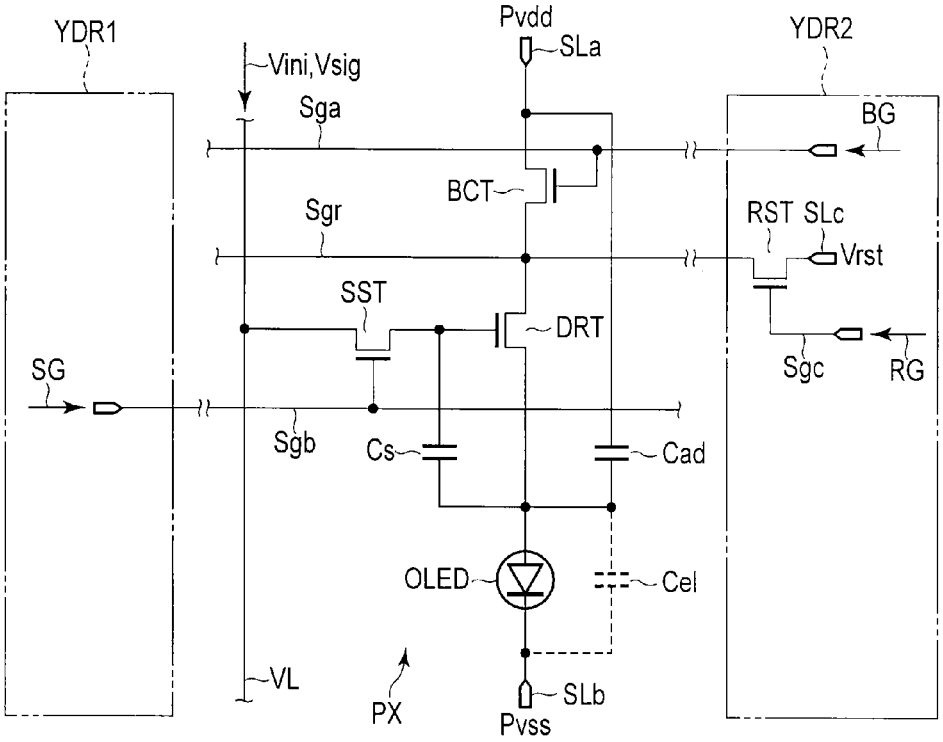
FIG. 2 is an equivalent circuit diagram of a pixel in the display apparatus in FIG. 1.
Figure 3:
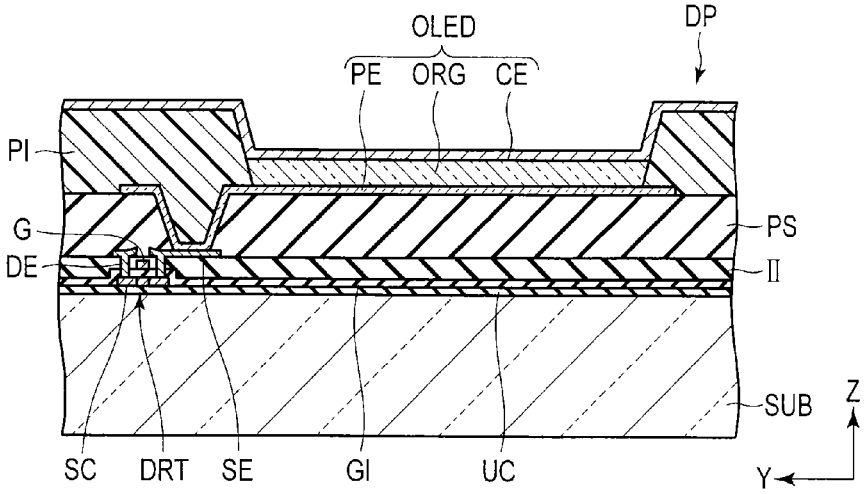
FIG. 3 is a partial cross-sectional view schematically showing an example of a structure that can be adopted for the display apparatus in FIG. 1.

FIG. 1 is a plan view schematically showing a display apparatus according to the present embodiment. FIG. 2 is an equivalent circuit diagram of the display apparatus in FIG. 1. FIG. 3 is a partial cross-sectional view schematically showing an example of a structure that can be adopted for the display apparatus in FIG. 1. In FIG. 3, the display apparatus is drawn such that a display surface, that is, a front surface or a light emitting surface, of the display apparatus faces upward, with a rear surface of the display apparatus facing downward. The display apparatus is an upward-lighting organic EL display apparatus adopting an active matrix driving scheme. The present embodiment adopts the upward-lighting organic EL display apparatus but is also easily applicable to a downward-lighting organic EL display apparatus.

As shown in FIG. 1, the display apparatus according to the present embodiment is configured as, for example, an active matrix display apparatus of at least two inches, and includes a display panel DP and a controller 12 that controls operation of the display panel DP. According to the present embodiment, the display panel DP is an organic EL panel.

The display panel DP comprises an insulating substrate SUB such as a glass substrate which has a light transmission property, m×n pixels PX arranged in a matrix on a display area R1 of the insulating substrate SUB, a plurality of (m/2) first scanning lines Sga (1 to m/2), a plurality of (m) second scanning lines Sgb (1 to m), a plurality of (m/2) third scanning lines Sgc (1 to m/2), a plurality of (m/2) reset lines Sgr (1 to m/2), and a plurality of (n) video signal lines VL (1 to n).

The pixels PX are arranged such that m pixels PX are juxtaposed in a column direction and that n pixels are juxtaposed in a row direction. The first scanning lines Sga, the second scanning lines Sgb, and the reset lines Sgr extend in the row direction. The reset line Sgr comprises a plurality of electrodes electrically connected together. The video signal lines VL extend in the column direction.

As shown in FIG. 1 and FIG. 2, the display panel DP comprises a high-potential power supply line SLa fixed to a high potential Pvdd and a low-potential power supply electrode SLb connected to a low potential Pvss. The high-potential power supply line SLa is connected to a high-potential power supply. The low-potential power supply electrode SLb is connected to a low-potential power supply (reference potential power supply).

The display panel DP comprises scanning line driving circuits YDR1 and YDR2 configured to drive the first scanning lines Sga, the second scanning lines Sgb, and the third scanning lines Sgc for every row of the pixels PX, and a signal line driving circuit XDR configured to drive the video signal lines VL. The scanning line driving circuits YDR1 and YDR2 and the signal line driving circuit XDR are integrally provided on a non-display area R2 outside a display area of the insulating substrate SUB, and form a driving section 10 along with a controller 12.

Each of the pixels PX includes a display element and a pixel circuit configured to supply a driving current to the display element. The display element is, for example, a self-illuminated element, and is an organic EL diode OLED (hereinafter simply referred to as a diode OLED) comprising at least an organic light-emitting layer as an optically active layer.

As shown in FIG. 2, the pixel circuit in each pixel PX is of a voltage signal type that controls light emission from the diode OLED in accordance with a video signal comprising a voltage signal. The pixel circuit comprises a pixel switch SST, a driving transistor DRT, a storage capacitance Cs, and an additional capacitance Cad. The storage capacitance Cs and the additional capacitance Cad are capacitors. The additional capacitance Cad is an element provided to adjust a light emission current amount and may be unnecessary in some cases. A capacitance section Cel is the capacitance of the diode OLED itself (the parasitic capacitance of the diode OLED). The diode OLED also functions as a capacitor.

Each pixel PX comprises an output switch SOT. A plurality of pixels PX adjacent to each other in the column direction Y shares the output switch BCT. According to the first embodiment, four pixels that are adjacent to one another in a row direction X and a column direction Y share one output switch BCT. Furthermore, the scanning line driving circuit YDR2 (or the scanning line driving circuit YDR1) includes a plurality of reset switches RST. The reset switch RST and the reset line Sgr are connected together on a one-to-one basis.

The pixel switch SST, the driving transistor DRT, the output switch BCT, and the reset switch RST each comprise a TFT (Thin Film Transistor) of the same conductivity type, for example, of the N channel type.

In the display apparatus according to the present embodiment, all the TFTs included in the driving transistors and the switches are formed during the same step so as to have the same layer structure, and have a top gate structure that uses polysilicon in a semiconductor layer.

The pixel switch SST, the driving transistor DRT, the output switch BCT, and the reset switch RST each comprise a first terminal, a second terminal, and a control terminal. According to the present embodiment, the first terminal is used as a source electrode, the second terminal is used as a drain electrode, and the control terminal is used as a gate electrode.

In the pixel circuit in the pixel PX, the driving transistor DRT and the output switch BCT are connected in series with the diode OLED between the high-potential power supply line SLa and the low-potential power supply electrode SLb. The high-potential power supply line SLa (high potential Pvdd) is set to, for example, a potential of 10V. The low-potential power supply electrode SLb (low potential Pvss) is set to, for example, a potential of 1.5 V.

In the output switch BCT, a drain electrode is connected to the high-potential power supply line SLa, a source electrode is connected to a drain electrode of the driving transistor DRT, and a gate electrode is connected to the first scanning line Sga. Thus, the output switch BCT is controllably turned on (electrically continuous state) and off (electrically discontinuous state) in accordance with a control signal BG (1 to m/2) from the first scanning line Sga. The output switch BCT controls a light emission duration of the diode OLED in response to the control signal BG.

In the driving transistor DRT, a drain electrode is connected to a source electrode of the output switch BCT and to the reset line Sgr, and a source electrode is connected to one electrode (in this case, an anode) of the diode OLED. The other electrode (in this case, a cathode) of the diode OLED is connected to the low-potential power supply electrode SLb. The driving transistor DRT outputs a driving current with a current amount corresponding to a video signal Vsig.

In the pixel switch SST, a source electrode is connected to a video signal line VL (1 to n), a drain electrode is connected to a gate electrode of the driving transistor DRT, and a gate electrode is connected to the second scanning line Sgb (1 to m) functioning as a signal write control gate line. The pixel switch SST is controllably turned on and off in accordance with a control signal SG (1 to m) supplied through the second scanning line Sgb. The pixel switch SST controllably connects and disconnects the pixel circuit to and from the video signal line VL (1 to n) to load the video signal Vsig into the pixel circuit through the corresponding video signal line VL (1 to n).

The reset switch RST is provided every two rows in the scanning line driving circuit YDR2. The reset switch RST is connected between the drain electrode of the driving transistor DRT and a reset power supply. In the reset switch RST, a source electrode is connected to a reset power supply line SLc connected to the reset power supply, a drain electrode is connected to the reset line Sgr, and a gate electrode is connected to the third scanning line Sgc functioning as a reset control gate line. As described above, the first reset power supply line SLc is connected to the first reset power supply and fixed to a reset potential Vrst that is a constant potential.

The reset switch RST switches a state between the reset power supply line SLc and the reset line Sgr to the electrically continuous state (on) or the electrically discontinuous state (off) in accordance with the control signal RG (1 to m/2) provided through the third scanning line Sgc. The reset switch RST is switched on to initialize the potential of the source electrode of the driving transistor DRT.

On the other hand, the controller 12 shown in FIG. 1 is provided on a printed circuit board (not shown in the drawings) disposed outside the display panel DP to control the scanning line driving circuits YDR1 and YDR2 and the signal line driving circuit XDR. The controller 12 receives a digital video signal and a synchronous signal that are externally supplied, and generates a vertical scanning control signal that controls a vertical scanning timing and a horizontal scanning control signal that controls a horizontal scanning timing, based on the synchronous signal.

The controller 12 supplies the vertical scanning control signal and the horizontal scanning control signal to each of the scanning line driving circuits YDR1 and YDR2 and the signal line driving circuit XDR. The controller 12 also supplies a digital video signal and an initialization signal to the signal line driving circuit XDR in synchronism with the horizontal and vertical scanning timings.

The signal line driving circuit XDR converts each of video signals sequentially obtained during each horizontal scanning period into an analog form and supplies a video signal Vsig corresponding to gradation to the plurality of video signal lines VL (1 to n) in parallel. Furthermore, the signal line driving circuit XDR supplies an initialization signal Vini to the video signal line VL.

Each of the scanning line driving circuits YDR1 and YDR2 includes shift registers and output buffers (not shown in the drawings) and transfers an externally supplied horizontal scanning start pulse subsequently to the succeeding stage. The scanning line driving circuit supplies three types of control signals, that is, the control signals BG (1 to m/2), SG (1 to m), and RG (1 to m/2) (FIG. 2) to the pixels PX in each row via the output buffer. The control signal RG is not directly supplied to the pixel PX but at a predetermined timing based on the control signal RG, a predetermined voltage is supplied through the reset power supply line SLc fixed to the reset potential Vrst.

Thus, the first scanning line Sga, the second scanning line Sgb, and the third scanning line Sgc are driven by the control signals BG, SG, and RG, respectively.

Now, configurations of the driving transistor DRT and the diode OLED will be described with reference to FIG. 3.

The TFT of the N channel type forming the driving transistor DRT comprises a semiconductor layer SC. The semiconductor layer SC is provided on an undercoat layer UC provided on the insulating substrate SUB. The semiconductor layer SC is, for example, a polysilicon layer including a p-type region and an n-type region.

The semiconductor layer SC is covered with a gate insulating film GI. The gate electrode G of the driving transistor DRT is provided on the gate insulating film GI. The gate electrode G is located opposite the semiconductor layer SC. An interlayer insulating film II is provided on the gate insulating film GI and the gate electrode G.

A source electrode SE and a drain electrode DE are further provided on the interlayer insulating film II. The source electrode SE and the drain electrode DE are connected to a source region and a drain region, respectively, of the semiconductor layer SC through contact holes formed in the interlayer insulating film II and the gate insulating film GI. A passivation film PS is provided on the source electrode SE and the drain electrode DE.

The diode OLED includes a pixel electrode PE, an organic layer ORG, and a counter electrode CE. According to the first embodiment, the pixel electrode PE is an anode, and the counter electrode CE is a cathode.

The pixel electrode PE is provided on the passivation film PS. The pixel electrode PE is connected to the source electrode SE of the driving transistor DRT through a contact hole provided in the passivation film PS. In the present example, the pixel electrode PE is a rear electrode with light reflectivity.

A partitioning insulating layer PI is further provided on the passivation film PS. The partitioning insulating layer PI comprises a through-hole provided at a position corresponding to the pixel electrode PE or a slit provided at a position corresponding to a column or a row formed by the pixel electrode PE. In this case, by way of example, the partitioning insulating layer PI comprises the through-hole provided at a position corresponding to the pixel electrode PE.

The organic layer ORG including a light emitting layer is provided on the pixel electrode PE. The light emitting layer is, for example, a thin film containing a luminescent organic compound that emits red light, green light, blue light, or white (achromatic) light. In addition to the light emitting layer, the organic layer ORG includes a hole injection layer, a hole transportation layer, a hole blocking layer, an electron transportation layer, and an electron injection layer.

The emission color of the diode OLED need not necessarily be divided into red light, green light, blue light, and white light, but the diode OLED may exclusively emit white light. In this case, the diode OLED can emit red light, green light, blue light, or white light by combination with a red color filter, a green color filter, and a blue color filter.

The partitioning insulating layer PI and the organic layer ORG are covered with the counter electrode CE. In the present example, the counter electrode CE is an electrode connected among the pixels PX, that is, a common electrode. Furthermore, in the present example, the counter electrode CE is a cathode and a light-transmissive front electrode. The counter electrode CE is electrically connected through a contact hole provided in both the passivation film PS and the partitioning insulating layer PI, to an electric line (not shown in the drawings) provided in the same layer as that in which the source electrode SE and the drain electrode DE are provided.

The diode OLED configured as described above excites organic particles forming the organic layer ORG to generate excitons when holes injected through the pixel electrode PE are recoupled to electrons injected through the counter electrode CE, inside the organic layer ORG. The excitons emit light while being radiated and inactivated, and the light is emitted to the exterior from the organic layer ORG to the exterior through the transparent counter electrode CE.

Figure 4:
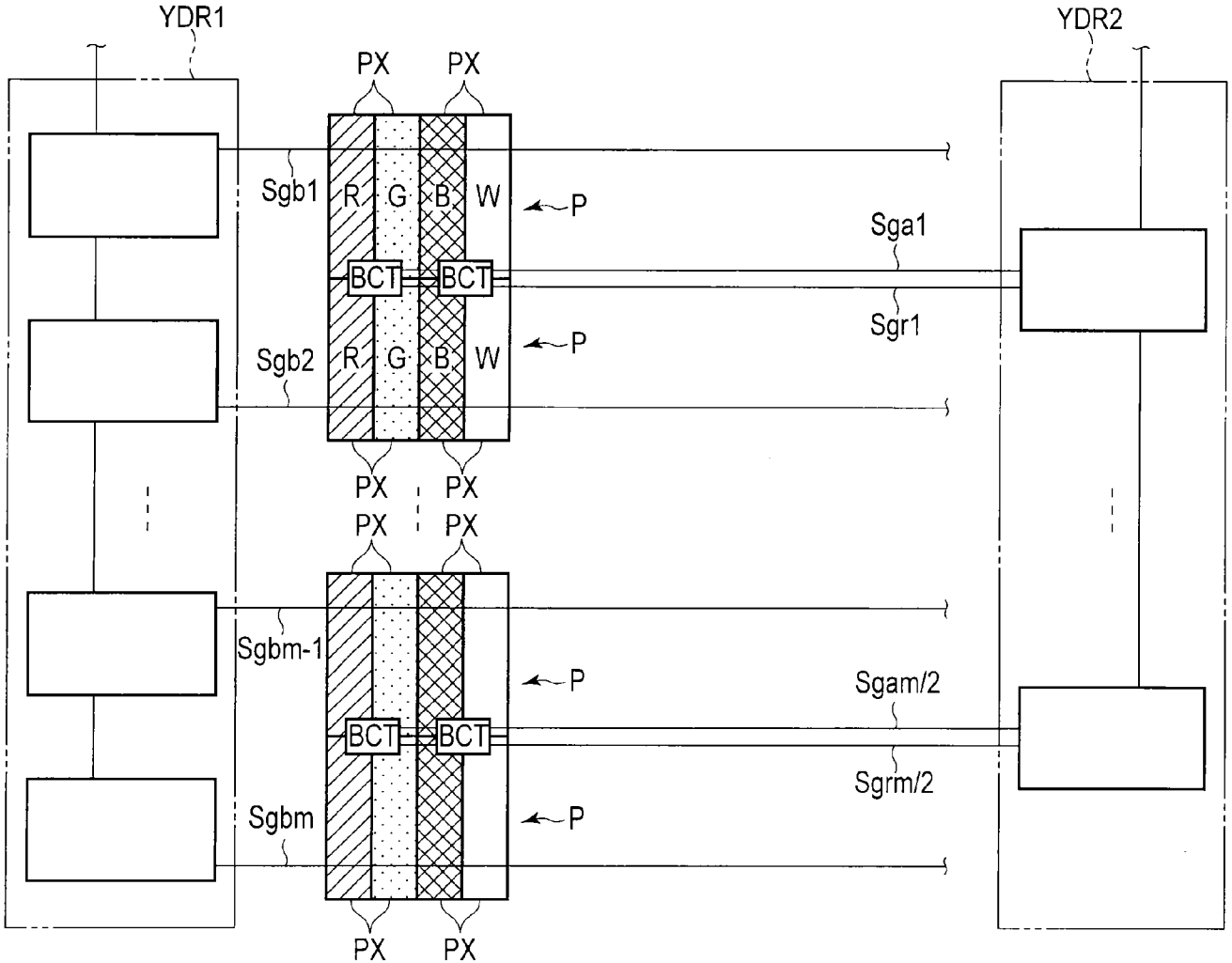
FIG. 4 is a schematic diagram showing a layout configuration of pixels in Example 1 according to the first embodiment.
Figure 5:
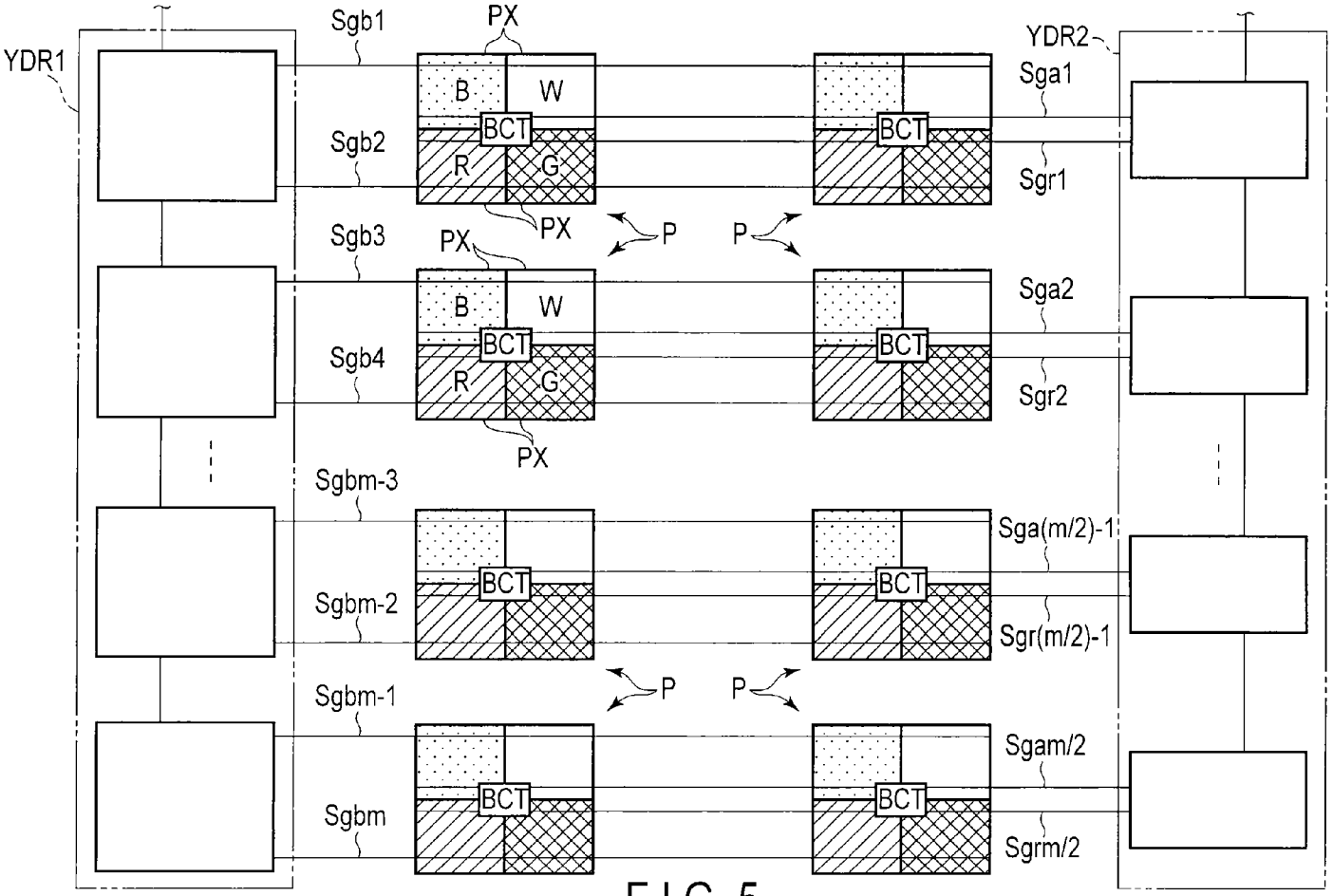
FIG. 5 is a schematic diagram showing a layout configuration of pixels in Example 2 according to the first embodiment.

Now, a layout configuration of the plurality of pixels PX will be described. FIG. 4 is a schematic diagram showing a layout configuration of the pixels PX in Example 1 according to the first embodiment. FIG. 5 is a schematic diagram showing a layout configuration of the pixels PX in Example 2 according to the first embodiment.

As shown in FIG. 4, the pixels are so called vertical stripe pixels. In the row direction X, the following pixels are alternately arranged: a pixel PX configured to display a red image, a pixel PX configured to display a green image, a pixel PX configured to display a blue image, and a pixel PX configured to display a white image. In the column direction Y, pixels PX configured to display images in the same color are arranged.

The red (R) pixel PX, the green (G) pixel PX, the blue (B) pixel PX, and the white (W) pixel PX form a picture element P. In Example 1, the picture element P comprises four (four color) pixels PX. However, the picture element P is not limited to this and may be variously modified. For example, when no white pixel PX is provided, the picture element P may comprise three (three color) pixels, that is, the red pixel, the green pixel, and the blue pixel.

The output switch BCT is shared by four adjacent pixels PX (two adjacent pixels in the column direction Y and two adjacent pixels in the row direction X). Thus, each of the numbers of the first scanning lines Sga and the third scanning lines Sgc is m/2.

As shown in FIG. 5, the pixels PX are so called RGBW square pixels. The plurality of pixels PX comprises a first pixel, a second pixel adjacent to the first pixel in the column direction Y, a third pixel adjacent to the first pixel in the row direction X, and a fourth pixel adjacent to the second pixel in the row direction X and to the third pixel in the column direction Y. The first to fourth pixels are a red pixel PX, a green pixel PX, a blue pixel PX, and a white pixel PX. The picture element P comprises the first to fourth pixels.

For example, any two of the red pixel PX, the green pixel PX, the blue pixel PX, and the white pixel PX are arranged in an even-numbered row. The remaining two pixels are arranged in an odd-numbered row. In Example 2, the red pixel PX and the green pixel PX are arranged in the even numbered row, and the remaining two pixels, the blue pixel PX and the white pixel PX are arranged in the odd numbered row. The output switch BCT is shared by the first to fourth pixels.

Figure 6:
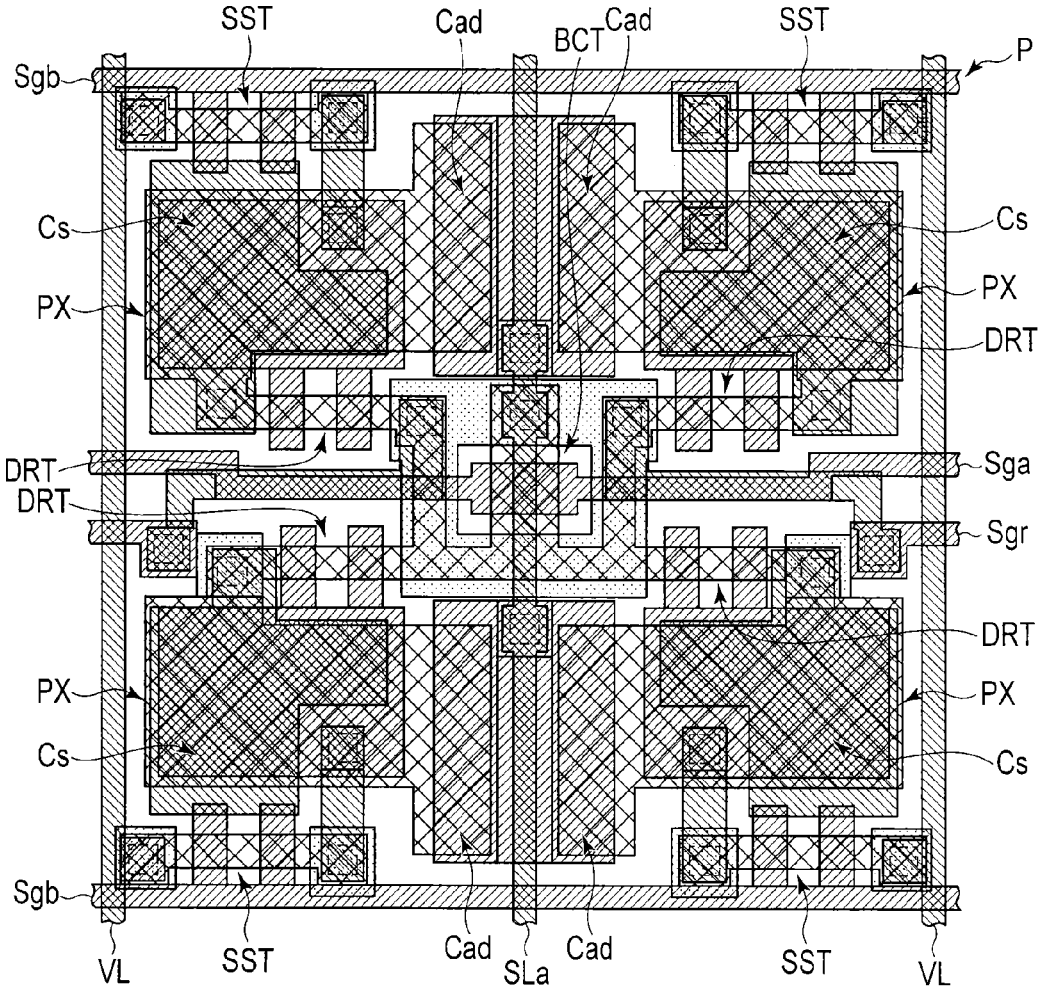
FIG. 6 is a plan view showing a picture element according to the first element.

FIG. 6 is a plan view showing the pixel PX according to the present embodiment. FIG. 6 shows the configuration of the pixels PX in a case where the four pixels PX (one picture element P) share the output switch BCT. In this case, RGBW square configuration pixels are used as a typical example.

To allow the elements in the pixel circuit to be efficiently laid out, the four pixels PX sharing the output switch BCT are arranged such that the driving transistors DRT, the pixel switches SST, the video signal lines VL, the storage capacitances Cs, the additional capacitances Cad, and the second scanning lines Sgb are symmetric with respect to the output switch BCT in the column direction and in the row direction.

The first embodiment uses the terms "pixel PX" and "picture element P", but the pixel may be interchanged with a subpixel. In this case, the picture element is a pixel.

Now, operation of the display apparatus (organic EL display apparatus) configured as described above will be described. FIG. 7, FIG. 8, FIG. 9, and FIG. 10 are timing charts showing control signals for the scanning line driving circuits YDR1 and YD2 during a display operation.

Figure 7:
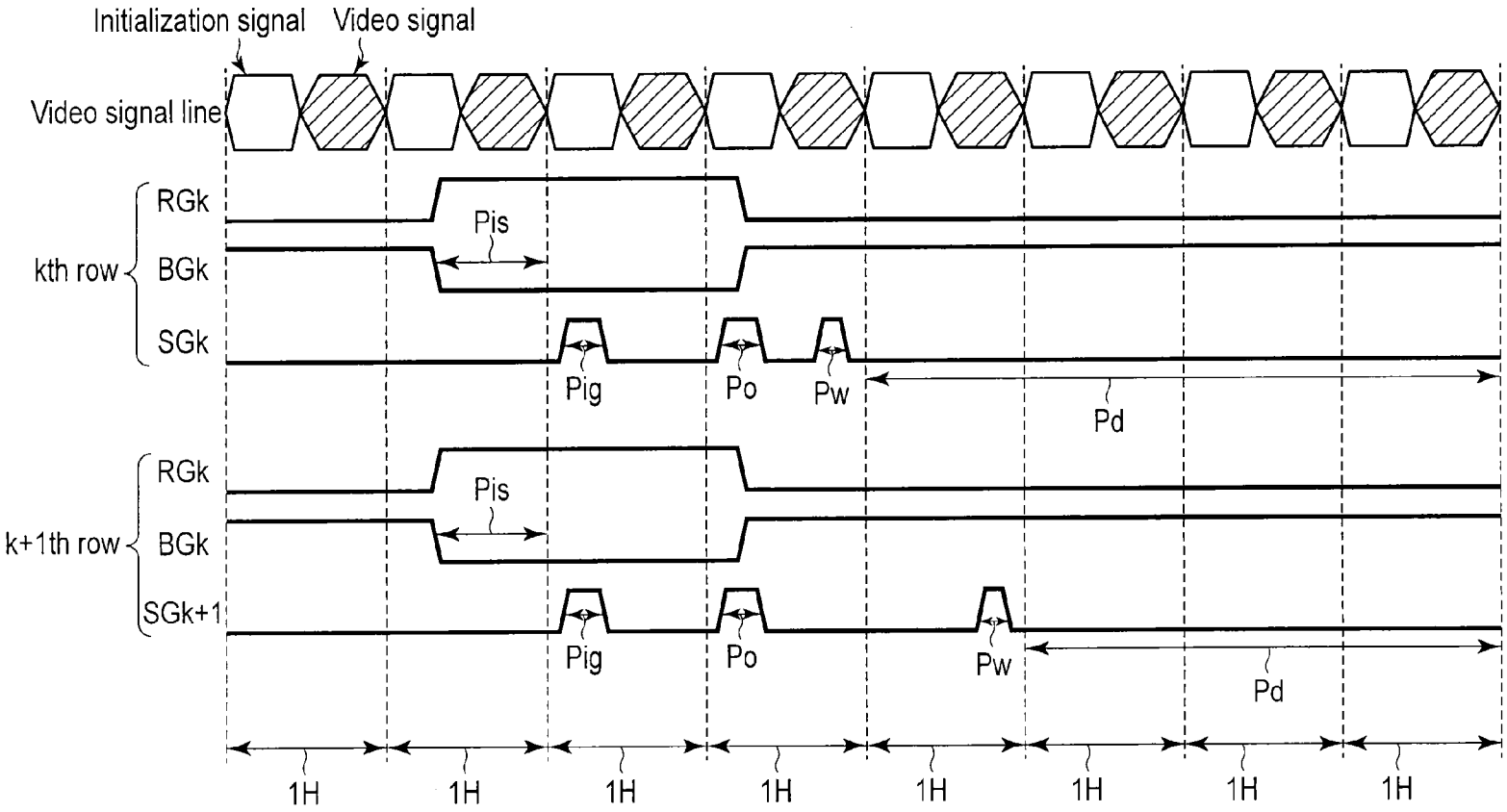
FIG. 7 is a timing chart showing control signals for a scanning line driving circuit obtained when a layout configuration of pixels in Example 1 according to the first embodiment is adopted and when one offset cancel operation is performed.
Figure 8:
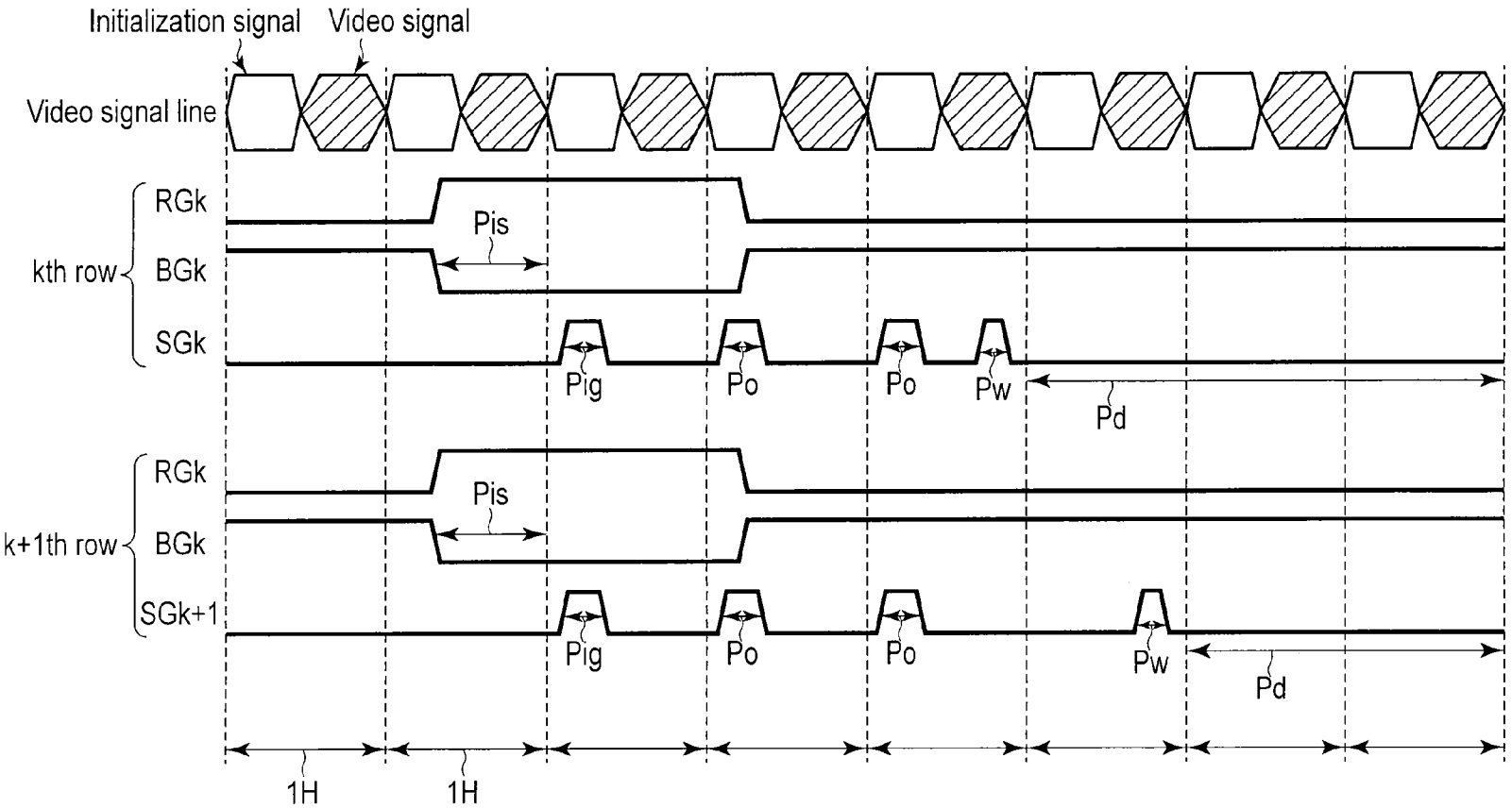
FIG. 8 is a timing chart showing control signals for the scanning line driving circuit obtained when the layout configuration of pixels in Example 1 according to the first embodiment and when two offset cancel operations are performed.
Figure 9:
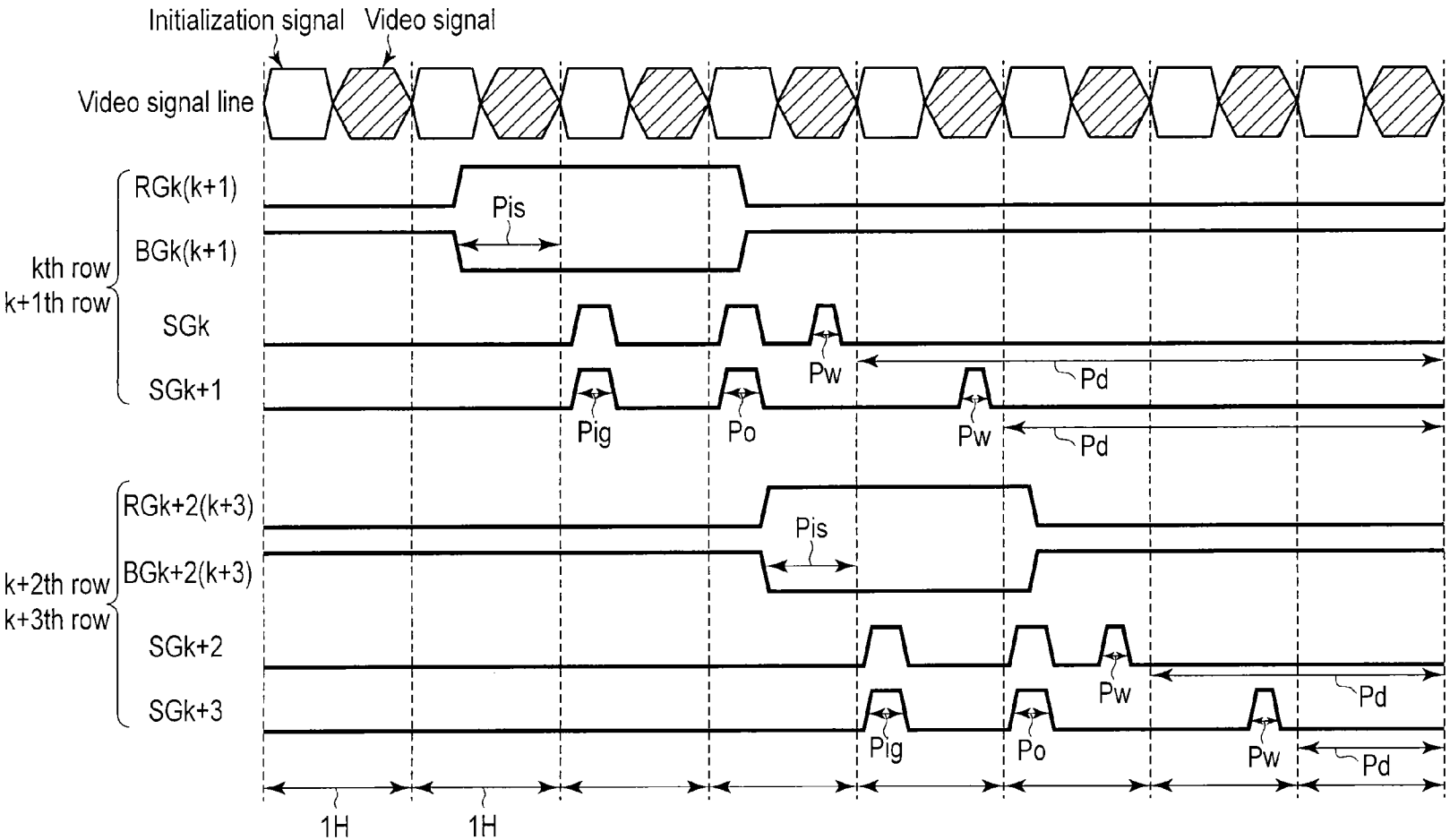
FIG. 9 is a timing chart showing control signals for the scanning line driving circuit obtained when a layout configuration of pixels in Example 2 according to the first embodiment is adopted and when one offset cancel operation is performed.
Figure 10:
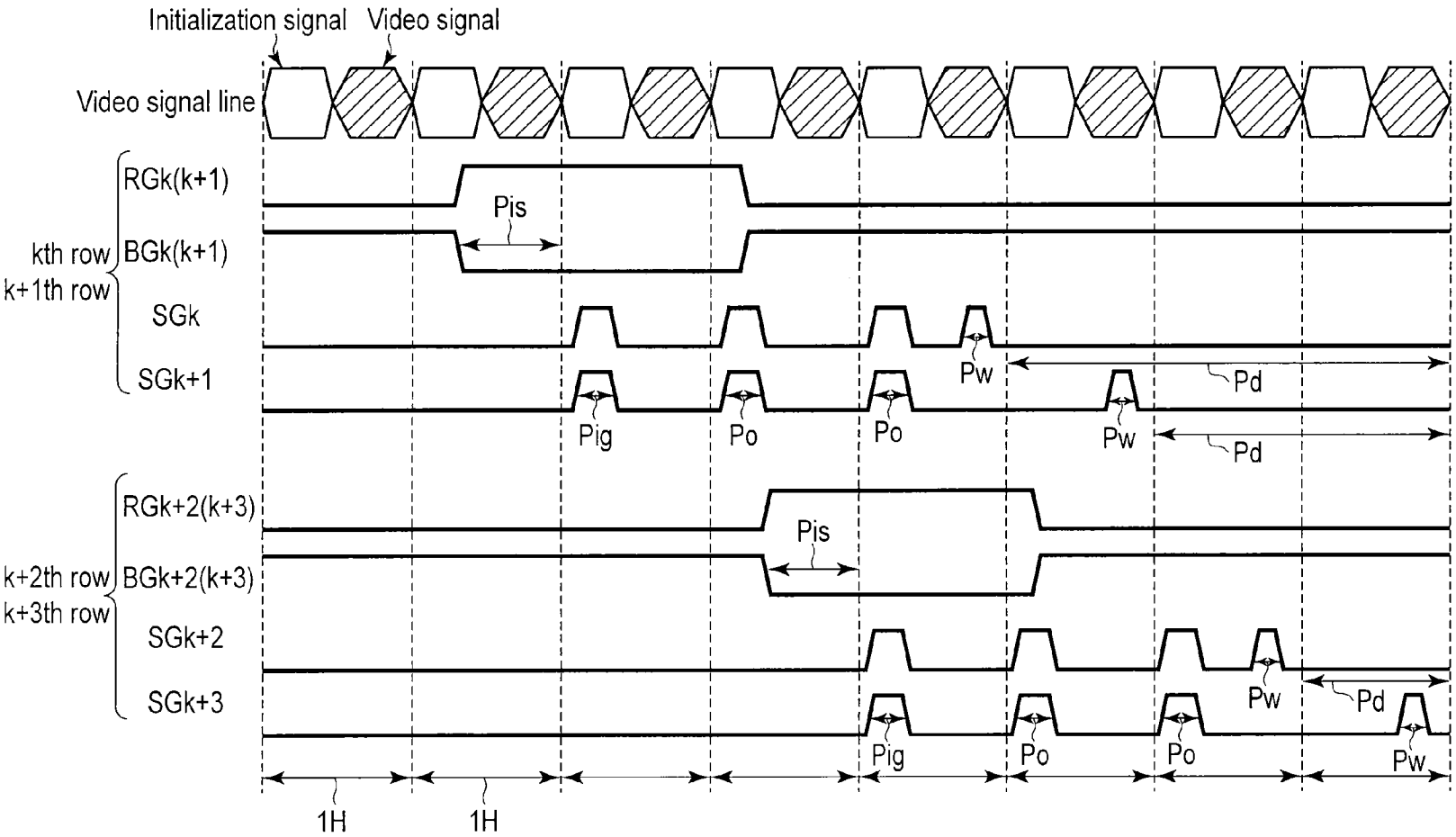
FIG. 10 is a timing chart showing control signals for the scanning line driving circuit obtained when the layout configuration of pixels in Example 2 according to the first embodiment is adopted and when two offset cancel operations are performed.

FIG. 7 shows a case where vertical stripe pixels are used and where one offset cancel period is provided, FIG. 8 shows a case where vertical stripe pixels are used and where a plurality of offset cancel periods (in this case, two offset cancel periods as a typical example) is provided. FIG. 9 shows a case where RGBW square pixels are used and where one offset cancel period is provided, and FIG. 10 shows a case where RGBW square pixels are used and where a plurality of offset cancel periods (in this case, two offset cancel periods as a typical example) is provided.

Thus, in Example 1, the display apparatus can be driven using control signals in FIG. 7 or control signals in FIG. 8. In Example 2, the display apparatus can be driven using control signals in FIG. 9 or control signals in FIG. 10.

Each of the scanning line driving circuits YDR1 and YDR2 generates, for example, a pulse with a width of one horizontal scanning period corresponding to each horizontal scanning period from a start signal and a clock, and outputs the pulse as a control signal BG (1 to m/2), SG (1 to m), or RG (1 to m/2). In this case, one horizontal scanning period is referred to as 1H.

The operation of the pixel circuit is divided into a source initialization operation performed during a source initialization period Pis, a gate initialization operation performed during a gate initialization period Pig, an offset cancel (OC) operation performed during an offset cancel period Po, a video signal write operation performed during a video signal write period Pw, and a display operation (light emission operation) performed during a display period Pd (light emission period).

As shown in FIG. 7 to FIG. 10 and FIG. 1 and FIG. 2, first, the driving section 10 performs a source initialization operation. For the source initialization operation, the scanning line driving circuits YDR1 and YDR2 set a level at which the control signal SG turns off the pixel switch SST (off potential: in this case, a low level), a level at which the control signal BG turns off the output switch BCT (off potential: in this case, the low level), and a level at which the control signal RG turns on the reset switch RST (on potential: in this case, a high level).

The output switch BCT and the pixel switch SST are turned off (electrically discontinuous state), and the reset switch RST is turned on (electrically continuous state). Then, a source initialization operation is started. Turning the reset switch RST on resets the potential of the source electrode and drain electrode of the driving transistor DRT equal to the potential of the first reset power supply (reset potential Vrst).

Thus, the source initialization operation is complete. In this case, the first reset power supply (reset potential Vrst) is set to, for example, −2 V.

Then, the driving section 10 performs a gate initialization operation. For the gate initialization operation, the scanning line driving circuits YDR1 and YDR2 set a level at which the control signal SG turns on the pixel switch SST (on potential: in this case, the high level), a level at which the control signal BG turns off the output switch BCT, and a level at which the control signal RG turns on the reset switch RST. The output switch BCT is turned off, and the pixel switch SST and the reset switch RST are turned on. Then, the gate initialization operation is started.

During the gate initialization operation Pig, the initialization signal Vini (initialization voltage) output through the video signal line VL is applied to the gate electrode of the driving transistor DRT through the pixel switch SST. Thus, the potential of the gate electrode of the driving transistor DRT is reset to a value corresponding to the initialization signal Vini to initialize information in a preceding frame. The voltage level of the initialization signal Vini is set to, for example, 2 V.

Subsequently, the driving section 10 performs an offset cancel operation. The control signal SG is set to an on potential, the control signal BG is set to the on potential (high level), and the control signal RG is set to an off potential (low level). Thus, the reset switch RST is turned off, and the pixel switch SST and the output switch BCT are turned on. An offset cancel operation for a threshold is started.

During the offset cancel period Po, the initialization signal Vini is applied to the gate electrode of the driving transistor DRT through the video signal line VL and the pixel switch SST. The potential of the gate electrode of the driving transistor DRT is fixed.

Furthermore, the output switch BCT is in the on state, so that a current flows into the driving transistor DRT through the high-potential power supply line SLa. The potential of the source electrode of the driving transistor DRT has an initial value equal to the potential (reset potential Vrst) written during the source initialization period Pis. While gradually reducing a current flowing into the driving transistor DRT through between the drain electrode and the source electrode of the driving transistor DRT, the potential of the source electrode of the driving transistor DRT shifts toward higher potentials while absorbing and compensating for a variation in the TFT property of the driving transistor DRT. According to the first embodiment, the offset cancel period Po is set to a time of, for example, 1 μsec.

At the end of the offset cancel period Po, the potential of the source electrode of the driving transistor DRT is Vini−Vth. The voltage value of the initialization signal Vini is denoted by Vini, and the threshold voltage of the driving transistor DRT is denoted by Vth. Thus, the voltage between the gate electrode and the source electrode of the driving transistor DRT reaches a cancel point (Vgs=Vth). A potential difference corresponding to the cancel point is stored (held) in the storage capacitance Cs. As in examples illustrated in FIG. 8 and FIG. 10, a plurality of offset cancel periods Po can be provided as necessary.

Subsequently, during the video signal write period Pw, the control signal SG is set to a level at which the pixel switch SST is turned on. The control signal BG is set to a level at which the output switch BCT is turned on. The control signal RG is set to a level at which the reset switch RST is turned off. Then, the pixel switch SST and the output switch BCT are turned on, and the reset switch RST is turned off. A video signal write operation is started.

During the video signal write period Pw, the video signal Vsig from the video signal line VL is written to the gate electrode of the driving transistor DRT through the pixel switch SST. Furthermore, a current from the high-potential power supply line SLa flows to the low-potential power supply electrode SLb through the output switch BCT and the driving transistor DRT via the capacitance section (parasitic capacitance) Cel of the diode OLED. Immediately after the pixel switch SST is turned on, the potential of the gate electrode of the driving transistor DRT is Vsig (R, G, B), and the potential of the source electrode of the driving transistor is Vini−Vth+Cs(Vsig−Vini)/(Cs+Cel+Cad).

The voltage value of the video signal Vsig is denoted by Vsig, the capacity of the storage capacitance Cs is denoted by Cs, the capacity of the capacitance section Cel is denoted by Cel, and the capacity of the additional capacitance Cad is denoted by Cad.

Subsequently, a current flows to the low-potential power supply electrode SLb via the capacitance section Cel of the diode OLED. At the end of the video signal write period Pw, the potential of the gate electrode of the driving transistor DRT is Vsig (R, G, B), and the potential of the source electrode of the driving transistor DRT is Vini−Vth+ΔV1+Cs(Vsig−Vini)/(Cs+Cel+Cad). The relation between a current Idrt flowing through the driving transistor DRT and the capacitance Cs+Cel+Cad is expressed by Formula 1, where ΔV1 denotes displacement of potential of the source electrode determined by Formula 1 and corresponding to the voltage value of the video signal Vsig, the video signal write period Pw, and mobility in the transistor.

$$\int_0^{Pw} Idrt\,dt = \int_{Vs}^{Vs+\Delta V1} (Cs+Cel+Cad)\,dV \qquad \text{(Formula 1)}$$

In this case, the following formula holds true.

$$\begin{aligned} Idrt &= \beta \times (Vgs - Vth)^2 \\ &= \beta \times \{(Vsig - Vini) \times (Cel + Cad)/(Cs + Cel + Cad)\}^2. \end{aligned}$$

The following formula defines β.

$$\beta = \mu \times Cox \times W/2L$$

The channel width of the driving transistor DRT is denoted by W, the channel length of the driving transistor DRT is denoted by L, carrier mobility is denoted by μ, and a gate capacitance per unit area is denoted by Cox. The variation of the mobility of the driving transistor DRT is thereby corrected.

Finally, during the display period Pd, the control signal SG is set to a level at which the pixel switch SST is turned off. The control signal BG is set to a level at which the output switch BCT is turned on. The control signal RG is set to a level at which the reset switch RST is turned off. Then, the output switch BCT is turned on, and the pixel switch SST and the reset switch RST are turned off. A display operation is started.

The driving transistor DRT outputs a driving current Iel of a current amount corresponding to the gate control voltage written to the storage capacitance Cs. The driving current Iel is supplied to the diode OLED. Thus, the diode OLED emits light at a luminance according to the driving current Iel to perform a display operation. The diode OLED maintains the light emission state until, after one frame period, the control signal BG is set to the off potential again.

The above-described source initialization operation, gate initialization operation, offset cancel operation, video signal write operation, and display operation are sequentially and repetitively performed on each pixel PX to display the desired image.

In the display apparatus and the method of driving the display apparatus according to the first embodiment configured as described above, the display apparatus comprises the plurality of video signal lines VL, the plurality of scanning lines (first scanning lines Sga, second scanning lines Sgb, and third scanning lines Sgc), the plurality of reset lines Sgr, and the plurality of pixels PX. Each of the pixels PX comprises the driving transistor DRT, the diode OLED, the pixel switch SST, the output switch BCT, the storage capacitance Cs, and the additional capacitance Cad.

The diode OLED is connected between the high-potential power supply line SLa and the low-potential power supply electrode SLb. The driving transistor DRT comprises the source electrode connected to the diode OLED, the drain electrode connected to the reset line Sgr, and the gate electrode. The output switch BCT is connected between the high-potential power supply line SLa and the drain electrode of the driving transistor DRT to switch a state of the part between the high-potential power supply line SLa and the drain electrode of the driving transistor DRT to the electrically continuous state or the electrically discontinuous state.

The pixel switch SST is connected between the video signal line VL and the gate electrode of the driving transistor DRT to determine, in a switchable manner, whether to load the video signal Vsig provided through the video signal line VL onto the gate electrode side of the transistor. The storage capacitance Cs is connected between the source electrode and the gate electrode of the driving transistor DRT.

A number of pixels PX of the plurality of pixels PX adjacent to one another in the column direction share the output switch BCT. According to the first embodiment, four pixels PX share one output switch BCT.

Compared to a case where one output switch BCT is provided for each pixel PX, the first embodiment can reduce the number of the output switches BCT to one-quarter, reduce the numbers of the first scanning lines Sga, the third scanning lines Sgc, and the reset lines Sgr to half, and reduce the number of the reset switches RST to half. Consequently, the display apparatus can be configured to have a slim border and to achieve a high definition.

During the display period Pd, the output current Iel in a saturated area of the driving transistor DRT is applied to the diode OLED, which thus emits light.

In this case, when the gain coefficient of the driving transistor DRT is denoted by β, the output current Iel is expressed by:

$$Iel=\beta\times\{(Vsig-Vini-\Delta V1)\times(Cel+Cad)/(Cs+Cel+Cad)\}^2$$

The following formula defines β.

$$\beta=\mu\times Cox\times W/2L$$

The channel width of the driving transistor DRT is denoted by W, the channel length of the driving transistor DRT is denoted by L, carrier mobility is denoted by μ, and a gate capacitance per unit area is denoted by Cox.

Thus, the output current Iel has a value independent of the threshold voltage Vth of the driving transistor DRT, allowing elimination of the adverse effect of a variation in the threshold voltage of the driving transistor DRT on the output current Iel.

Furthermore, the absolute value of ΔV1, described above, increases consistently with the mobility μ in the driving transistor DRT, and thus, the adverse effect of the mobility μ can be compensated for. This allows suppression of inappropriate display, striped unevenness, or a viewer's sense of roughness caused by the variation, enabling high-grade image display.

Thus, a high-definition display apparatus and a method of driving the display apparatus can be obtained which allow the border to be made slimmer.

Now, a display apparatus and a method of driving the display apparatus according to a second embodiment will be described. The same functional sections of the second embodiment as the corresponding functional sections of the first embodiment are denoted by the same reference numerals and will not be described in detail.

Figure 11:
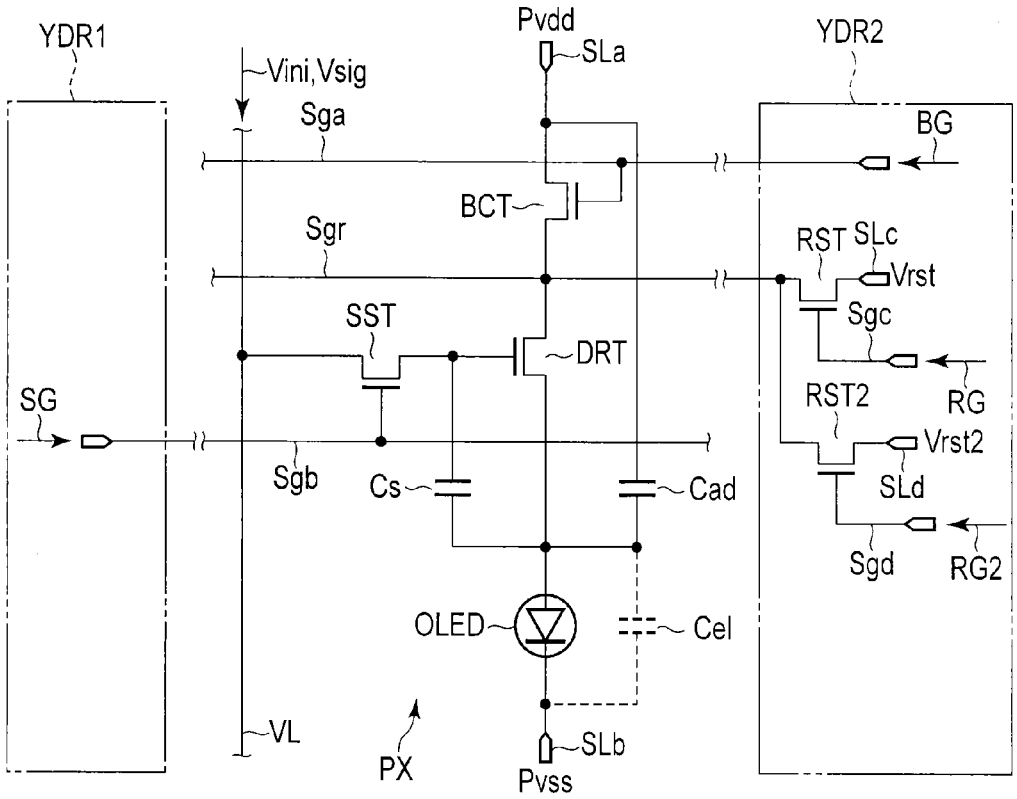
FIG. 11 is an equivalent circuit diagram of a pixel in a display apparatus according to a second embodiment.

As shown in FIG. 11, a display panel DP comprises a plurality of (m/2) four scanning lines Sgd (1 to m/2). Furthermore, a scanning line driving circuit YDR2 (or a scanning line driving circuit YDR1) comprises a plurality of reset switches RST2 as a plurality of other (second) reset switches. The reset switch RST2 and a reset line Sgr are connected together on a one-to-one basis.

The reset switch RST2 comprises a TFT with the same conductivity type as that of the reset switch (first reset switch) RST and the like, for example, an N channel type. Furthermore, the reset switch RST2 is formed according to the same steps as those for the reset switch RST so as to have the same layer structure as that of the reset switch RST. Like the reset switch RST and the like, the reset switch RST2 comprises a first terminal (source electrode), a second terminal (drain electrode), and a control terminal (gate electrode).

The reset switch RST2 is provided in a scanning line driving circuit YDR2 every two rows. The reset switch RST2 is connected between other reset power supply and a reset line Sgr. In the reset switch RST2, a source electrode is connected to a reset power supply line SLd connected to the other reset power supply. A drain electrode of the reset switch RST2 is connected to the reset line Sgr. A gate electrode of the reset switch RST2 is connected to a fourth scanning line Sgd functioning as a gate line for reset control. As described above, the reset power supply line SLd is connected to the other reset power supply and fixed to a reset potential Vrst2 that is a constant potential. The value of the reset potential Vrst2 is different from the value of the reset potential Vrst. In this case, the other reset power supply (reset potential Vrst2) is set to, for example, 5 V.

The reset switch RST2 switches the state between the reset power supply line SLd and the reset line Sgr to the electrically continuous state or the electrically discontinuous state in accordance with a control signal RG2 (1 to m/2) provided through the fourth scanning line Sgd. The reset switch RST2 is switched on to initialize the potential of the source electrode of the driving transistor DRT.

Each of the scanning line driving circuits YDR1 and YDR2 includes shift registers and output buffers (not shown in the drawings) and sequentially transfers an externally supplied horizontal scanning start pulse to the next stage to supply four types of control signals, that is, control signals BG (1 to m/2), SG (1 to m), RG (1 to m/2), and RG2 (1 to m/2) to pixels PX in each row via the output buffer.

The pixel PX is not directly supplied with the control signal RG but is supplied with a predetermined signal through the reset power supply line SLc fixed to a reset potential Vrst at a predetermined timing according to the control signal RG. Alternatively, the pixel PX is supplied, at a predetermined timing according to the control signal RG2, with a predetermined voltage through the reset power supply line SLd fixed to the reset potential Vrst2.

Thus, a first scanning line Sga, a second scanning line Sgb, a third scanning line Sgc, and the fourth scanning line Sgd are driven by the control signals BG, SG, RG, and RG2, respectively.

Now, operation of the display apparatus (organic EL display apparatus) configured as described above will be described. FIG. 12, FIG. 13, FIG. 14, and FIG. 15 are each a timing chart showing control signals for scanning line driving circuits YDR1 and YDR2 during display operation.

Figure 12:
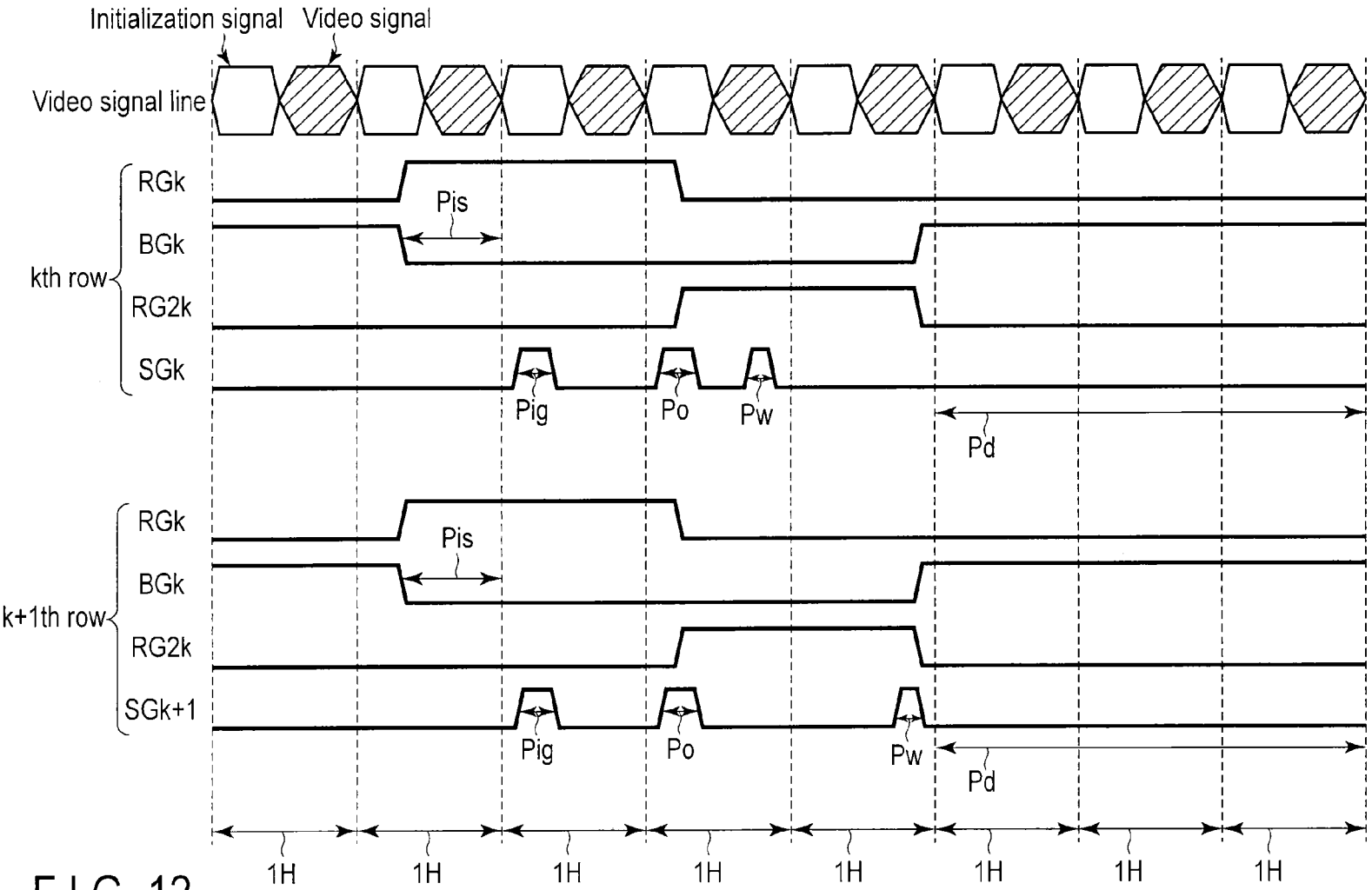
FIG. 12 is a timing chart showing control signals for a scanning line driving circuit obtained when a layout configuration of pixels in Example 1 according to the second embodiment is adopted and when one offset cancel operation is performed.
Figure 13:
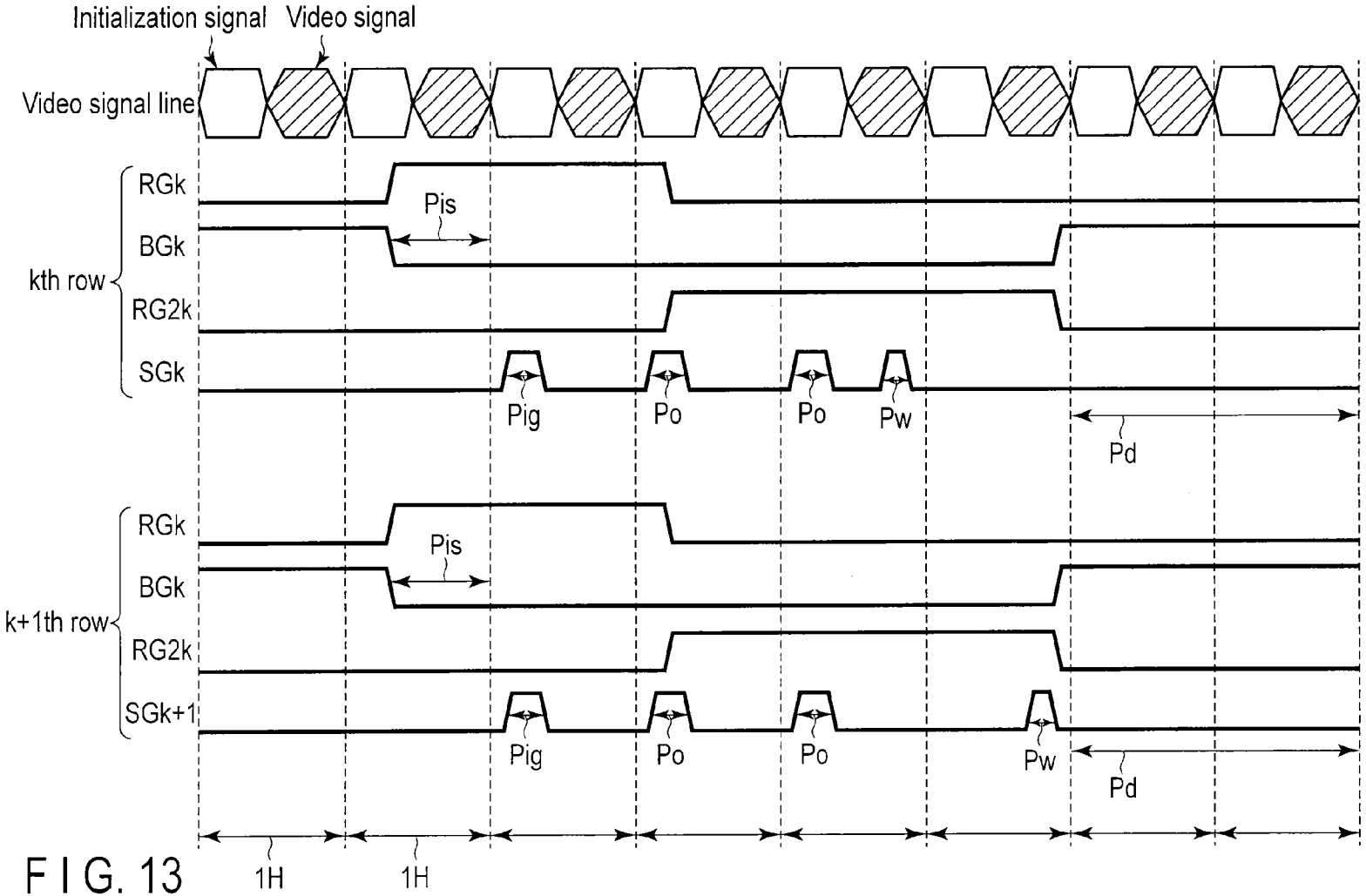
FIG. 13 is a timing chart showing control signals for the scanning line driving circuit obtained when the layout configuration of pixels in Example 1 according to the second embodiment is adopted and when two offset cancel operations are performed.
Figure 14:
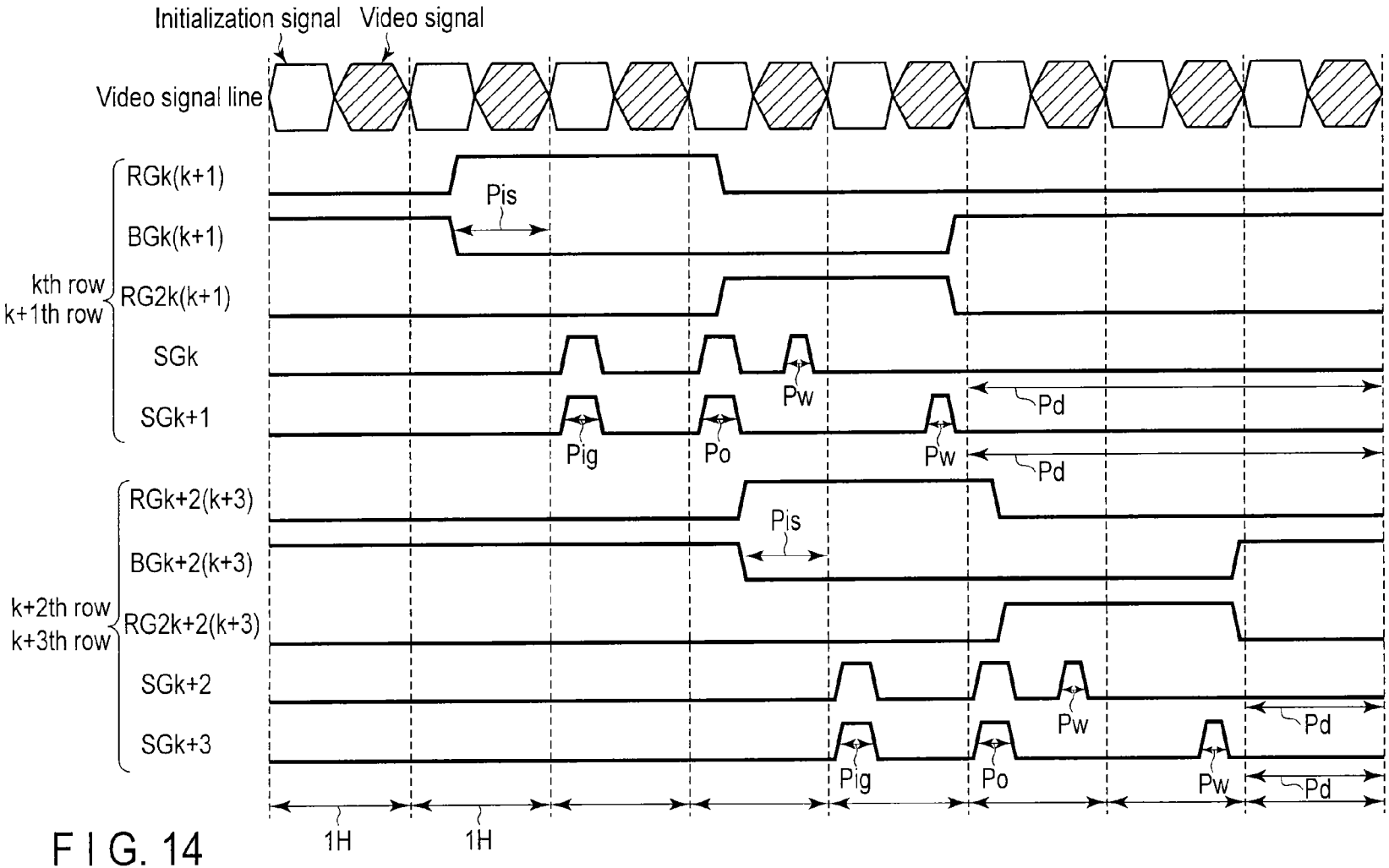
FIG. 14 is a timing chart showing control signals for the scanning line driving circuit obtained when a layout configuration of pixels in Example 2 according to the second embodiment is adopted and when one offset cancel operation is performed.
Figure 15:
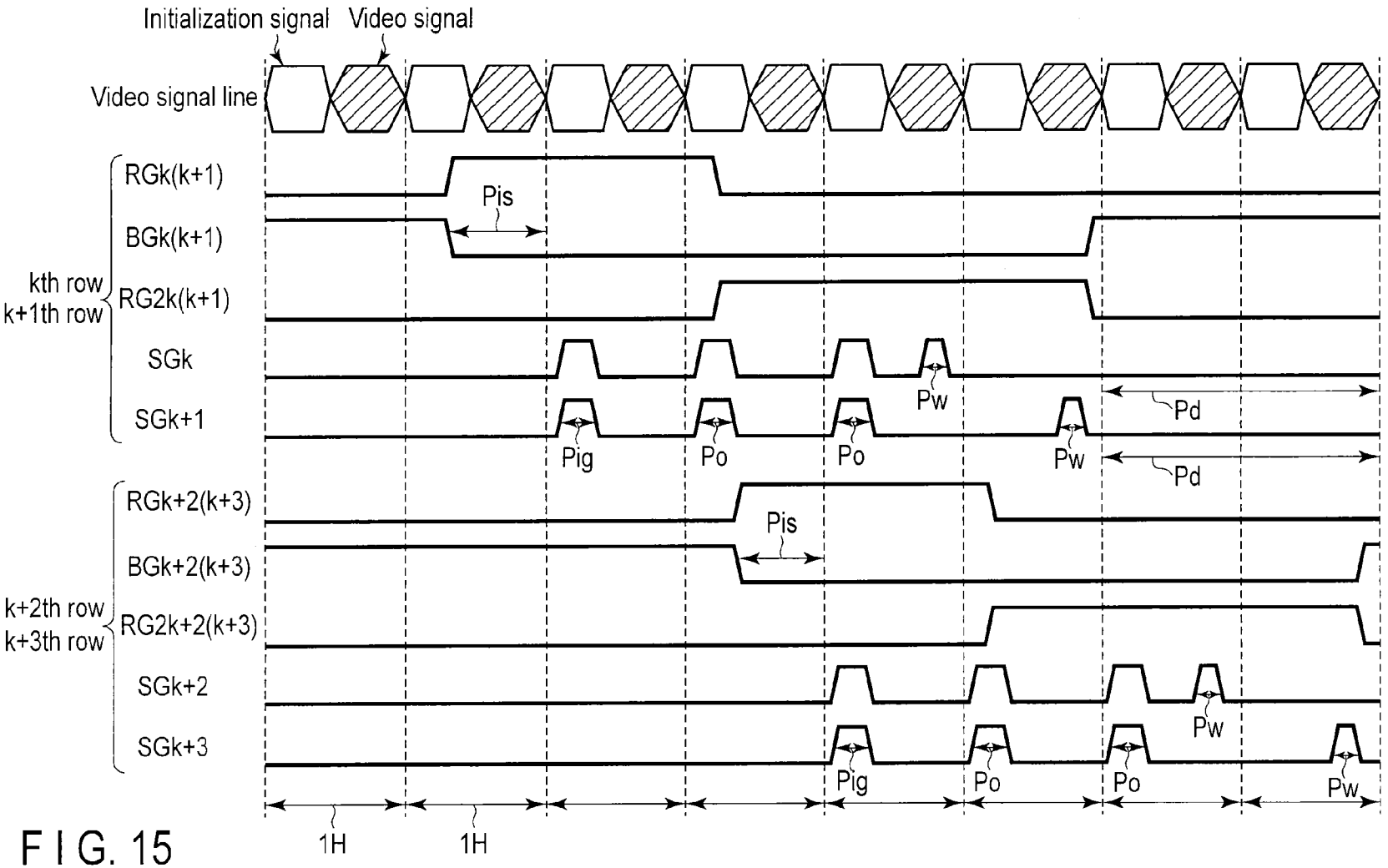
FIG. 15 is a timing chart showing control signals for the scanning line driving circuit obtained when a layout configuration of pixels in Example 2 according to the second embodiment is adopted and when two offset cancel operations are performed.

FIG. 12 illustrates a case where vertical stripe pixels are used and where one offset cancel period is provided. FIG. 13 illustrates a case where vertical stripe pixels are used and where a plurality of offset cancel periods (in this case, two offset cancel periods, as a typical example) is provided. FIG. 14 illustrates a case where RGBW square pixels are used and where one offset cancel period is provided. FIG. 15 illustrates a case where RGBW square pixels are used and where a plurality of offset cancel periods (in this case, two offset cancel periods, as a typical example) is provided.

Thus, in Example 1 according to the second embodiment to which Example 1 (FIG. 4) according to the first embodiment is applied, the display apparatus can be driven using the control signals in FIG. 12 or the control signals in FIG. 13. In Example 2 according to the second embodiment to which Example 2 (FIG. 5) according to the first embodiment is applied, the display apparatus can be driven using the control signals in FIG. 14 or the control signals in FIG. 15.

Each of the scanning line driving circuits YDR1 and YDR2 generates, from a start signal and a clock, a pulse of a width equal to one horizontal scanning period corresponding to each horizontal scanning period, and outputs the pulse as the control signal BG (1 to m/2), SG (1 to m), RG (1 to m/2), or RG2 (1 to m/2).

The operation of a pixel circuit is divided into a source initialization operation performed during a source initialization period Pis, a gate initialization operation performed during a gate initialization period Pig, an offset cancel (OC) operation performed during an offset cancel period Po, a video signal write operation performed during a video signal write period Pw, and a display operation (light emission operation) performed during a display period Pd (light emission period).

As shown in FIG. 12 to FIG. 15, and FIG. 1 and FIG. 2, first, a driving section 10 performs a source initialization operation. During the source initialization operation, the scanning line driving circuits YDR1 and YDR2 set the control signal SG to the level at which the pixel switch SST is turned off, set the control signal BG to the level at which the output switch BCT is turned off, set the control signal RG to the level at which the reset switch RST is turned on, and set the control signal RG2 to the level at which the reset switch RST2 is turned off (off potential: in this case, a low level).

The output switch BCT, the pixel switch SST, and the reset switch RST2 are each turned off, and the reset switch RST is turned on. Thus, a source initialization operation is started. Turning the reset switch RST on resets the potentials of a source electrode and a drain electrode of a driving transistor DRT equal to the potential (reset potential Vrst) of the reset power supply. Then, the source initialization operation is completed. In this case, the reset power supply (reset potential Vrst) is set to, for example, −2 V.

Then, the driving section 10 performs a gate initialization operation. During the gate initialization operation, the scanning line driving circuits YDR1 and YDR2 set the control signal SG to the level at which the pixel switch SST is turned on, set the control signal BG to the level at which the output switch BCT is turned off, set the control signal RG to the level at which the reset switch RST is turned on, and set the control signal RG2 to the level at which the reset switch RST2 is turned off. The output switch BCT and the reset switch RST2 are turned off, and the pixel switch SST and the reset switch RST are turned on. Thus, a gate initialization operation is started.

During the gate initialization period Pig, an initialization signal Vini (initialization voltage) output from the video signal line VL is applied to a gate electrode of the driving transistor DRT via the pixel switch SST. Thus, the potential of the gate electrode of the driving transistor DRT is reset to a potential corresponding to the initialization signal Vini to initialize information in the last frame. The voltage level of the initialization signal Vini is set to, for example, 2 V.

Subsequently, the driving section 10 performs an offset cancel operation. The control signal SG is set to the on potential, and the control signal BG is set to the off potential. The control signal RG is set to the off potential, and the control signal RG2 is set to the on potential. Thus, the reset switch RST and the output switch BCT are turned off and the pixel switch SST and the reset switch RST2 are turned on. Then, an offset cancel operation for a threshold is started.

During the offset cancel period Po, the initialization signal Vini is applied to the gate electrode of the driving transistor DRT through a video signal line VL and the pixel switch SST. The potential of the gate electrode of the driving transistor DRT is fixed.

Furthermore, the reset switch RST2 is in the on state, and a current from the other reset power supply flows into the driving transistor DRT through the reset switch RST2 and the reset line Sgr. In this case, the other reset power supply (reset potential Vrst2) is set to, for example, 5 V. The potential of the source electrode of the driving transistor DRT has an initial value equal to the potential (reset potential Vrst) written during a source initialization period Pis. While gradually reducing a current flowing into the driving transistor DRT through between the drain electrode and the source electrode of the driving transistor DRT, the potential of the source electrode of the driving transistor DRT shifts toward higher potentials while absorbing and compensating for a variation in the TFT property of the driving transistor DRT. According to the second embodiment, the offset cancel period Po is set to a time of, for example, 1 μsec.

At the end of the offset cancel period Po, the potential of the source electrode of the driving transistor DRT is Vini−Vth. Thus, the voltage between the gate electrode and the source electrode of the driving transistor DRT reaches a cancel point (Vgs=Vth). A potential difference corresponding to the cancel point is stored (held) in a storage capacitance Cs. As in examples illustrated in FIG. 13 and FIG. 15, a plurality of offset cancel periods Po can be provided as necessary.

Subsequently, during the video signal write period Pw, the control signal SG is set to the level at which the pixel switch SST is turned on. The control signal BG is set to the level at which the output switch BCT is turned off. The control signal RG is set to the level at which the reset switch RST is turned off. The control signal RG2 is set to the level at which the reset switch RST2 is turned on. Then, the pixel switch SST and the reset switch RST2 are turned on, and the output switch BCT and the reset switch RST are turned off. A video signal write operation is started.

During the video signal write period Pw, the video signal Vsig from the video signal line VL is written to the gate electrode of the driving transistor DRT through the pixel switch SST. Furthermore, a current from the other reset power supply flows to a low-potential power supply electrode SLb through the reset switch RST2, the reset line Sgr, and the driving transistor DRT via a capacitance section (parasitic capacitance) of a diode OLED. Immediately after the pixel switch SST is turned on, the potential of the gate electrode of the driving transistor DRT is Vsig (R, G, B), and the potential of the source electrode of the driving transistor DRT is Vini−Vth+Cs(Vsig−Vini)/(Cs+Cel+Cad).

Subsequently, a current flows to a low-potential power supply electrode SLb via the capacitance section Cel of the diode OLED. At the end of the video signal write period Pw, the potential of the gate electrode of the driving transistor DRT is Vsig (R, G, B), and the potential of the source electrode of the driving transistor DRT is Vini−Vth+ΔV1+Cs(Vsig−Vini)/(Cs+Cel+Cad). This serves to correct a variation in the mobility in the driving transistor DRT.

Finally, during the display period Pd, the control signal SG is set to the level at which the pixel switch SST is turned off. The control signal BG is set to the level at which the output switch BCT is turned on. The control signal RG is set to the level at which the reset switch RST is turned off. The control signal RG2 is set to the level at which the reset switch RST2 is turned off. The output switch BCT is turned on, and the pixel switch SST, the reset switch RST, and the reset switch RST2 are turned off. A display operation is started.

The driving transistor DRT outputs a driving current Ie of a current amount corresponding to the gate control voltage written to the storage capacitance Cs. The driving current Ie is supplied to the diode OLED. Thus, the diode OLED emits light at a luminance according to the driving current Ie to perform a display operation. The diode OLED maintains the light emission state until, after one frame period, the control signal BG is set to the off potential again.

The above-described source initialization operation, gate initialization operation, offset cancel operation, video signal write operation, and display operation are sequentially and repetitively performed on each pixel PX to display the desired image.

In the display apparatus and the method of driving the display apparatus according to the second embodiment configured as described above, the display apparatus comprises the plurality of video signal lines VL, the plurality of scanning lines (first scanning lines Sga, second scanning lines Sgb, third scanning lines Sgc, and fourth scanning lines Sgd), the plurality of reset lines Sgr, and the plurality of pixels PX. Each of the pixels PX comprises the driving transistor DRT, the diode OLED, the pixel switch SST, the output switch BCT, the storage capacitance Cs, and the additional capacitance Cad.

A number of pixels PX of the plurality of pixels PX which are adjacent to one another in the column direction shares the output switch BCT. According to the second embodiment, four pixels PX share one output switch BCT.

Compared to the case where one output switch BCT is provided for each pixel PX, the second embodiment can reduce the number of the output switches BCT to one-quarter, reduce the numbers of the first scanning lines Sga, the third scanning lines Sgc, the fourth scanning lines Sgd, and the reset lines Sgr to half, and reduce the numbers of the reset switches RST and the reset switches RST2 to half. Consequently, the display apparatus can be configured to have a slim border and to achieve a high definition.

The scanning line driving circuit YDR2 comprises the reset switch RST2. During an offset cancel operation, the reset switch RST2 can switch a state between the other reset power supply and the driving transistor DRT to the electrically continuous state. This allows the value of the voltage (Vds) between the drain electrode and the source electrode of the driving transistor DRT obtained at the end of the offset cancel operation to be brought closer to the value of the voltage (Vds) obtained during a display operation (during white display). Thus, the second embodiment can obtain a display apparatus that is excellent in display quality compared to the display apparatus according to the first embodiment.

The display apparatus and the method of driving the display apparatus according to the second embodiment can exert other effects similar to the corresponding effects of the display apparatus and the method of driving the display apparatus according to the first embodiment.

Thus, a high-definition display apparatus and a method of driving the display apparatus can be obtained which allow the border to be made slimmer.

The first and second embodiments are only illustrative and are not intended to limit the scope of the invention. In a practical phase, the first and second embodiments can be embodied with components thereof modified and without departing from the spirits of the invention. Furthermore, various inventions can be formed by appropriately combining a plurality of components disclosed in the embodiments. For example, some of all the components disclosed in the embodiments may be deleted. Moreover, components of the different embodiments may be appropriately combined together.

Figure 16:
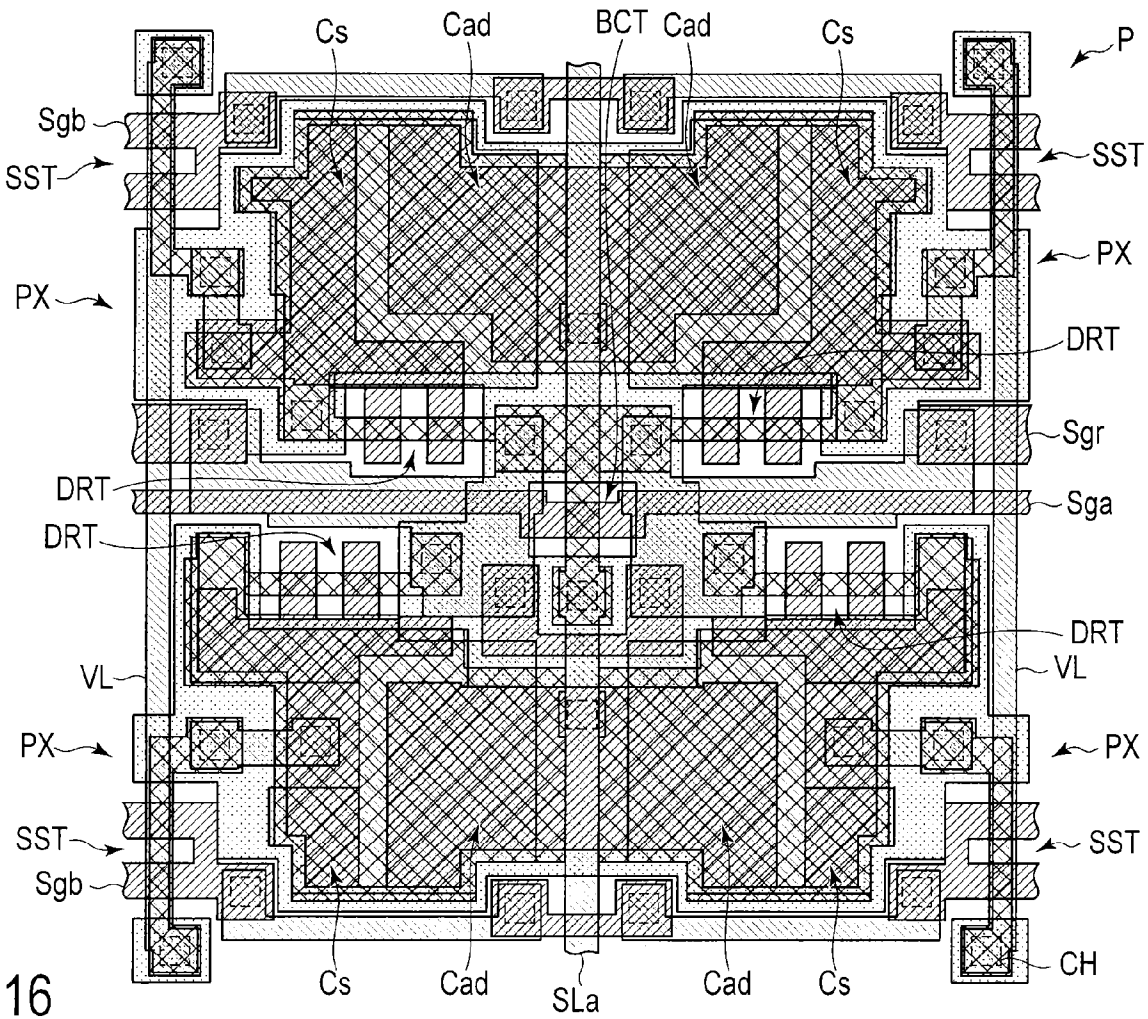
FIG. 16 is a plan view of a modification of the picture element shown in FIG. 6.

For example, picture elements (pixels PX) may be arranged as shown in FIG. 16. The video signal line VL is connected to a source region of a semiconductor layer in the pixel switch SST through a contact hole CH. In this case, the video signal line VL and the semiconductor layer (pixel switch SST) are provided opposite each other so as to sandwich an insulating film (gate insulating film GI and interlayer insulating film II). The contact hole CH is provided in the insulating film (gate insulating film GI and interlayer insulating film II).

Furthermore, in an example illustrated in FIG. 16, two pixels PX adjacent to each other in the column direction Y share the contact hole. In this case, the pixel switches SST of the two pixels PX adjacent to each other in the column direction Y share the contact hole CH. The two pixels PX form different picture elements.

A semiconductor layer in the TFT is not limited to polysilicon but may be formed of amorphous silicon. The TFT forming each switch or the driving transistor DRT is not limited to an N-channel TFT but may comprise a P-channel TFT. Similarly, each of the reset switches RST and RST2 may comprise a P-channel TFT or an N-channel TFT. The shapes and sizes of the driving transistor DRT and the switches are not limited to the shapes and sizes according to the above-described embodiments but may be changed as necessary.

Furthermore, one output switch BCT is provided for and shared by four pixels PX. However, the present invention is not limited to this configuration, and the number of the output switches BCT may be increased or reduced as necessary. For example, two pixels PX provided in two rows and one column may share one output switch BCT or eight pixels PX provided in two rows and four columns may share one output switch BCT.

Moreover, the self-illuminated element forming the pixel PX is not limited to the diode (organic EL diode) OLED but may be formed by using any of various display elements which can be self-illuminated.

The additional capacity Cad may be connected between the source electrode of the driving transistor DRT and a constant-potential line. Examples of the constant-potential line include the high-potential power supply line SLa, the low-potential power supply line (electrode) SLb, and the reset line Sgr.

The first and second embodiments are not limited to the above-described display apparatuses and methods of driving the display apparatus but may be applied to various display apparatuses and methods of driving the display apparatus.

Matters related to the first and second embodiments and modifications of the first and second embodiments are disclosed in (A1) to (A17).

(A1) A display apparatus comprising a plurality of pixels provided in a matrix along a row direction and a column direction, wherein each of the plurality of pixels comprises:

a display element connected between a high-potential power supply and a low-potential power supply;

a driving transistor comprising a source electrode connected to the display element, a drain electrode connected to a reset line, and a gate electrode;

an output switch connected between the high-potential power supply and the drain electrode of the driving transistor and configured to switch a state between the high-potential power supply and the drain electrode of the driving transistor to an electrically continuous state or an electrically discontinuous state;

a pixel switch connected between a video signal line and the gate electrode of the driving transistor and configured to determine, in a switchable manner, whether to load a signal provided through the video signal line onto the gate electrode side of the driving transistor; and a storage capacitance connected between the source electrode and the gate electrode of the driving transistor, and wherein a number of pixels PX of the plurality of pixels which are adjacent to each other in the column direction shares the output switch.

(A2) The display apparatus according to (A1), wherein the plurality of pixels comprises a first pixel, a second pixel adjacent to the first pixel in the column direction, a third pixel adjacent to the first pixel in the row direction, and a fourth pixel adjacent to the second pixel in the row direction and to the third pixel in the column direction, and the first to fourth pixels share the output switch.

(A3) The display apparatus according to (A2), wherein the first to fourth pixels are a pixel configured to display a red image, a pixel configured to display a green image, a pixel configured to display a blue image, and a pixel configured to display a white image.

(A4) The display apparatus according to (A2), wherein the plurality of pixels include pixels arranged in the row direction and including a pixel configured to display a red image, a pixel configured to display a green image, a pixel configured to display a blue image, and a pixel configured to display a white image, and pixels arranged in the column direction and configured to display images in an identical color.

(A5) The display apparatus according to (A2), wherein the output switch is provided in a central portion of the first to fourth pixels.

(A6) The display apparatus according to (A1), wherein the video signal line and the pixel switch are provided opposite each other across an insulating film and connected together through a contact hole provided in the insulating film, and two pixels of the plurality of pixels adjacent to each other in the row direction share the contact hole.

(A7) The display apparatus according to (A1), further comprising:

a first scanning line connected to the output switch;

a second scanning line connected to the pixel switch;

a scanning line driving circuit connected to the first scanning line and the second scanning line, and configured to apply a control signal to the first scanning line and the second scanning line and to switch a state of each of the output switch and the pixel switch; and a signal line driving circuit connected to the video signal line and configured to apply an initialization signal or a video signal to the video signal line.

(A8) The display apparatus according to (A7), wherein the scanning line driving circuit further comprises:

a first reset power supply;

a third scanning line; and a first reset switch connected between the first reset power supply and the reset line and configured to switch a state between the first reset power supply and the reset line to the electrically continuous state or the electrically discontinuous state, in accordance with a control signal provided through the third scanning line.

(A9) The display apparatus according to (A8), further comprising:

a second reset power supply;

a fourth scanning line; and a second reset switch connected between the second reset power supply and the reset line and configured to switch a state between the second reset power supply and the reset line to the electrically continuous state or the electrically discontinuous state, in accordance with a control signal provided through the fourth scanning line.

(A10) The display apparatus according to (A8), wherein each of the plurality of pixels further comprises an additional capacitance connected between the source electrode of the driving transistor and the reset line.

(A11) The display apparatus according to (A1), wherein each of the plurality of pixels further comprises an additional capacitance connected between the source electrode of the driving transistor and a constant-potential line.

(A12) The display apparatus according to (A11), wherein the constant-potential line is connected to the high-potential power supply.

(A13) The display apparatus according to (A1), wherein the driving transistor comprises an N-channel thin film transistor.

(A14) The display apparatus according to (A13), wherein each of the output switch and the pixel switch comprises one of an N-channel thin film transistor and a P-channel thin film transistor.

(A15) A method of driving a display apparatus comprising a plurality of pixels provided in a matrix along a row direction and a column direction, each of the plurality of pixels comprising a display element connected between a high-potential power supply and a low-potential power supply, a driving transistor comprising a source electrode connected to the display element, a drain electrode connected to a reset line, and a gate electrode, an output switch connected between the high-potential power supply and the drain electrode of the driving transistor and configured to switch a state between the high-potential power supply and the drain electrode of the driving transistor to an electrically continuous state or an electrically discontinuous state, a pixel switch connected between a video signal line and the gate electrode of the driving transistor and configured to determine, in a switchable manner, whether to load a signal provided through the video signal line onto the gate electrode side of the driving transistor, and a storage capacitance connected between the source electrode and the gate electrode of the driving transistor, wherein a number of pixels of the plurality of pixels which are adjacent to each other in the column direction shares the output switch, the method comprising:

during a source initialization period, applying a reset signal to the drain electrode of the driving transistor through the reset line;

during a gate initialization period following the drain initialization period, with the reset signal applied to the drain electrode of the driving transistor, applying an initialization signal to the gate electrode of the driving transistor through the video signal line and the pixel switch to initialize the driving transistor;

during an offset cancel period following the gate initialization period, with the initialization signal applied to the gate electrode of the driving transistor, passing a current from the high-potential power supply to the driving transistor through the output switch to cancel a threshold offset for the driving transistor;

during a video signal write period following the offset cancel period, applying a video signal to the gate electrode of the driving transistor through the video signal line and the pixel switch to pass a current from the high-potential power supply to the low-potential power supply through the output switch, the driving transistor, and the display element; and during a display period following the video signal write period, passing a driving current corresponding to the video signal from the high-potential power supply electrode to the display element through the output switch and the driving transistor.

(A16) The method of driving the display apparatus according to (A15), wherein, during one horizontal scanning period, the initialization signal and the video signal are sequentially applied to the video signal line.

(A17) The method of driving the display apparatus according to (A15), wherein a plurality of the offset cancel periods is provided between the gate initialization period and the video signal write period.

A display apparatus and a method of driving the display apparatus according to a third embodiment will be described below in detail with reference to the drawings. According to the third embodiment, the display apparatus is of an active matrix organic display apparatus, and more specifically, an active matrix EL (ElectroLuminescence) display apparatus. The same functional sections of the third embodiment as the corresponding functional sections of the first embodiment are denoted by the same reference numerals and will not be described in detail. FIG. 1, FIG. 3, and FIG. 6 and the description of FIG. 1, FIG. 3, and FIG. 6 are applicable to the description of the third embodiment.

Figure 17:
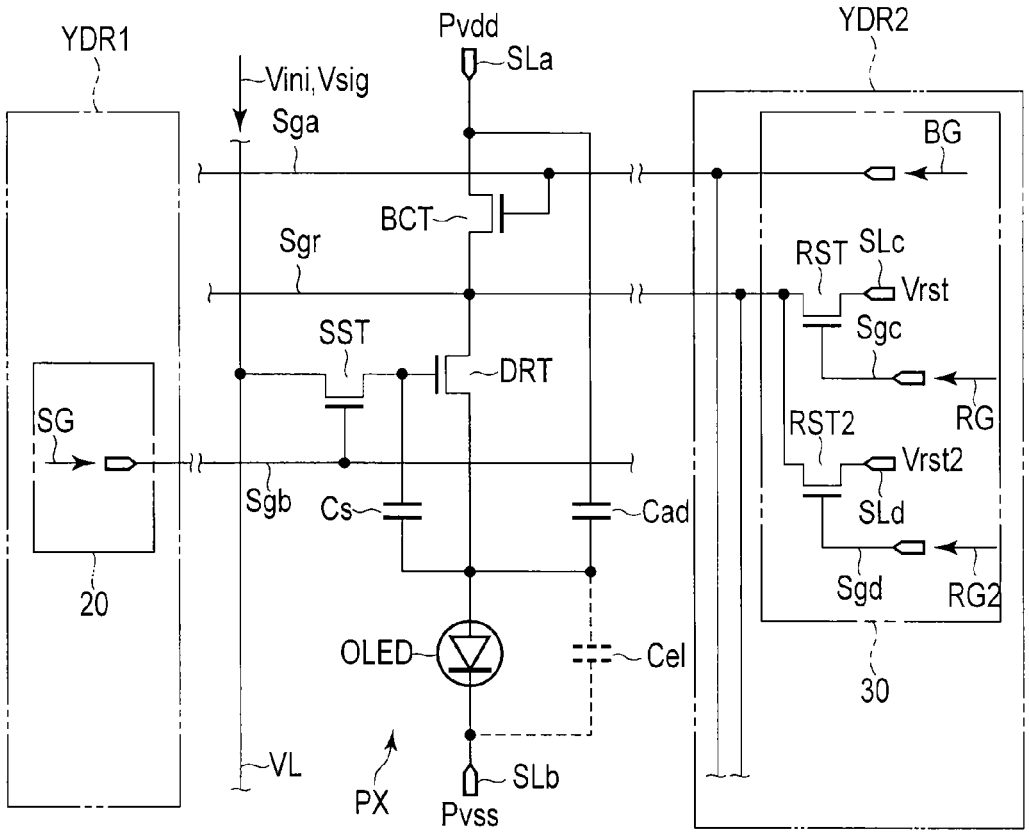
FIG. 17 is an equivalent circuit diagram of a pixel in a display apparatus according to a third embodiment.

FIG. 17 is an equivalent circuit diagram of a pixel in the display apparatus according to the third embodiment. The display apparatus is an upward-lighting organic EL display apparatus that adopts an active matrix driving scheme. The third embodiment uses an upper-lighting organic EL display apparatus but is easily applicable to a lower-lighting organic EL display apparatus.

As shown in FIG. 17, FIG. 1, and FIG. 3, a display panel DP comprises a plurality of control lines provided on an insulating substrate SUB. The plurality of control lines comprise a plurality of (m/2) first scanning lines Sga (1 to m/2), a plurality of (m) second scanning lines Sgb (1 to m), a plurality of (m/2) reset lines Sgr (1 to m/2), and a plurality of (n) video signal lines VL (1 to n). As described below, a plurality of (m/4) third scanning lines (1 to m/4) and a plurality of (m/4) fourth scanning lines Sgd (1 to m/4) are provided on the insulating substrate SUB.

A plurality of pixels PX adjacent to one another in a column direction Y may share an output switch BCT. This enables a reduction in the layout area of the pixel PX, leading to an increased definition. According to the third embodiment, four pixels PX adjacent to one another in a row direction X and the column direction Y share one output switch BCT.

Furthermore, a scanning line driving circuit YDR1 and a scanning line driving circuit YDR2 each comprise plurality of output sections. The scanning line driving circuit YDR1 comprises m output sections 20. Each of the output sections 20 is connected to the second scanning line Sgb on a one-to-one basis. Although not shown in the drawings, the output section 20 comprises shift registers and buffers.

The scanning line driving circuit YDR2 comprises m/4 output sections 30. Each of the output sections 30 is connected to a plurality of the first scanning lines Sga and a plurality of the reset lines Sgr. According to the third embodiment, each of the output sections 30 is connected to two first scanning lines Sga and two reset lines Sgr. The output section 30 comprises a reset switch RST and a reset switch RST2. Although not shown in the drawings, the output section 30 comprises shift registers and buffers.

As described above, compared to the case where each of the output sections 30 is connected to each of the first scanning line Sga and the reset line Sgr on a one-to-one basis, the third embodiment can reduce the number of the output sections 30 to half (½). Furthermore, since the pixels PX adjacent to one another in the column direction Y share one output switch BCT, the third embodiment can further reduce the number of the output sections 30 to half (¼) compared to a case where the output switch BCT is provided for each pixel PX. This enables a reduction in the layout area of the scanning line driving circuit YDR2, contributing to a slim border (a reduction in non-display area R2).

Each of a pixel switch SST, a driving transistor DRT, the output switch BCT, the reset switch RST, and the reset switch RST2 comprises a first terminal, a second terminal, and a control terminal. According to the third embodiment, the first terminal corresponds to a source electrode, the second terminal corresponds to a drain electrode, and the control terminal corresponds to a gate electrode.

The output switch BCT is controllably turned on (electrically continuous state) and off (electrically discontinuous state) in accordance with a control signal BG (1 to m/4) from the first scanning line Sga. The reset switch RST is provided every four rows in the scanning line driving circuit YDR2. The reset switch RST switches a state between a first reset power supply line SLc and the reset line Sgr to the electrically continuous state (on) or the electrically discontinuous state (off), in accordance with a control signal RG (1 to m/4) provided through the third scanning line Sgc.

The reset switch RST2 comprises a TFT with the same conductivity type as that of the reset switch RST and the like, for example, the N channel type. The reset switch RST2 is provided every four rows in the scanning line driving circuit YDR2. The reset switch RST is connected between a second reset power supply and the reset line Sgr. In the reset switch RST2, the source electrode is connected to a reset power supply line SLd connected to the second reset power supply, the drain electrode is connected to the reset line Sgr, and the gate electrode is connected to the fourth scanning line Sgd functioning as a gate line for reset control. As described above, the reset power supply line SLd is connected to the second reset power supply and fixed to a reset potential Vrst2 that is a constant potential. The value of the reset potential Vrst2 is different from the value of the reset potential Vrst. In this case, the second reset power supply (reset potential Vrst2) is set to, for example, 5 V.

The reset switch RST2 switches the state between the reset power supply line SLd and the reset line Sgr to the electrically continuous state or the electrically discontinuous state, in accordance with a control signal RG2 provided through the fourth scanning line Sgd. Switching the reset switch RST2 on cancels threshold offset for the driving transistor DRT.

Each of the scanning line driving circuits YDR1 and YDR2 includes shift registers and output buffers (not shown in the drawings) and sequentially transfers an externally supplied horizontal scanning start pulse to the next stage to supply four types of control signals, that is, control signals BG (1 to m/4), SG (1 to m), RG (1 to m/4), and RG2 (1 to m/4) to pixels PX in each row via the output buffer.

The pixel PX is not directly supplied with the control signal RG but is supplied with a predetermined voltage through the reset power supply line SLc fixed to a reset potential Vrst at a predetermined timing based on the control signal RG. Alternatively, the pixel PX is supplied, at a predetermined timing according to the control signal RG2, with a predetermined voltage through the reset power supply line SLd fixed to the reset potential Vrst2.

Thus, the first scanning line Sga, the second scanning line Sgb, the third scanning line Sgc, and the fourth scanning line Sgd are driven by the control signals BG, SG, RG, and RG2, respectively.

Figure 18:
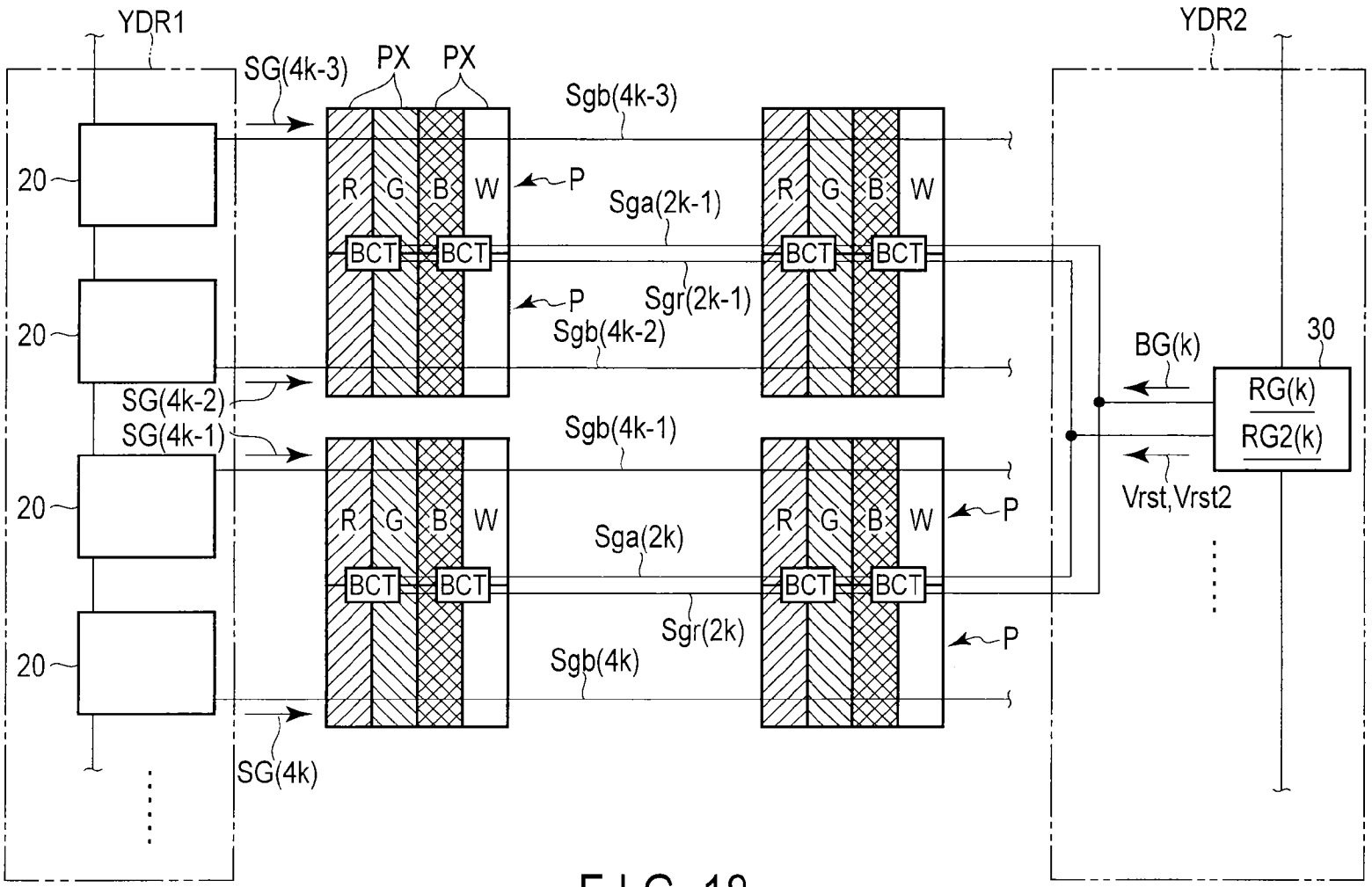
FIG. 18 is a schematic diagram showing a layout configuration of pixels in Example 1 according to the third embodiment.
Figure 19:
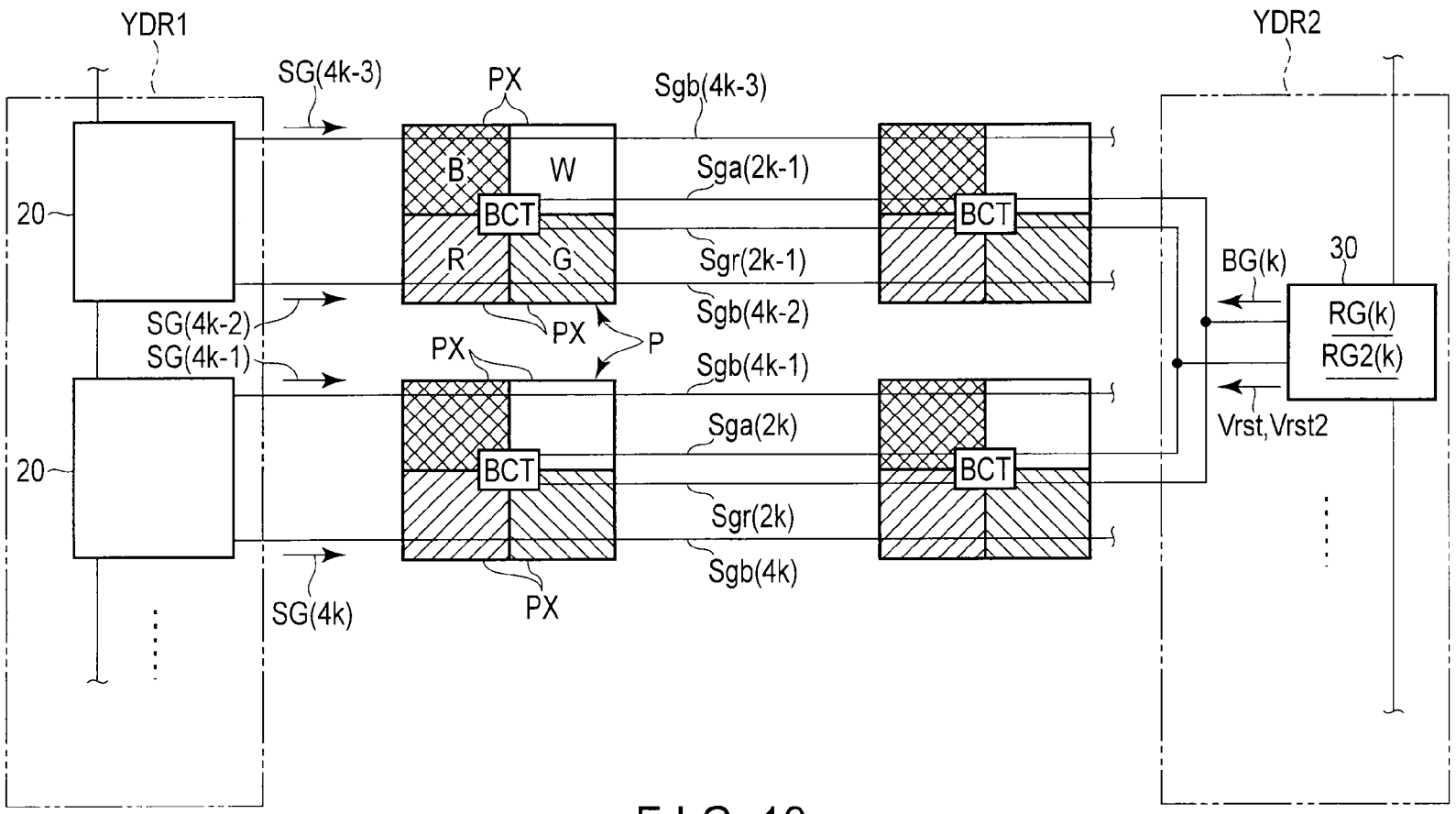
FIG. 19 is a schematic diagram showing a layout configuration of pixels in Example 2 according to the third embodiment.

Now, a layout configuration of a plurality of pixels PX will be described below. FIG. 18 is a schematic diagram showing a layout configuration of the pixels PX in Example 1 according to the third embodiment. FIG. 19 is a schematic diagram showing a layout configuration of the pixels PX in Example 2 according to the third embodiment.

As shown in FIG. 18, the pixels PX are so called vertical stripe pixels. In the row direction X, the following pixels are alternately arranged: a pixel PX configured to display a red image, a pixel PX configured to display a green image, a pixel PX configured to display a blue image, and a pixel PX configured to display a white (achromatic) image. In the column direction Y, pixels PX configured to display images in the same color are arranged.

The red (R) pixel PX, the green (G) pixel PX, the blue (B) pixel PX, and the white (W) pixel PX form a picture element P. In Example 1, the picture element P comprises four (four color) pixels PX. However, the picture element P is not limited to this and may be variously modified. For example, when no white pixel PX is provided, the picture element P may comprise three (three color) pixels, that is, the red pixel, the green pixel, and the blue pixel.

The output switch BCT is shared by four adjacent pixels PX (two adjacent pixels in the column direction Y and two adjacent pixels in the row direction X). In this case, the output switch BCT is shared by the pixels PX in the 4 k−3th row and the 4 k−2th row, and by the pixels PX in the 4 k−1th row and the 4 kth row. Thus, each of the numbers of the first scanning lines Sga and the reset lines Sgr is m/2. Here, $1 \leq k \leq m/4$.

The output section 30 in the kth stage is connected to the 2 k−1th and 2 kth first scanning lines Sga and to the 2 k−1th and 2 kth reset lines Sgr. Thus, the number of the output sections 30 is m/4.

The 4 k−3th output section 20 (in the 4 k−3th row) is connected to the 4 k−3th second scanning line Sgb (in the 4 k−3th row). The 4 k−2th output section 20 (in the 4 k−2th row) is connected to the 4 k−2th second scanning line Sgb (in the 4 k−2th row). The 4 k−1th output section 20 (in the 4 k−1th row) is connected to the 4 k−1th second scanning line Sgb (in the 4 k−1th row). The 4 kth output section 20 (in the 4 kth row) is connected to the 4 kth second scanning line Sgb (in the 4 kth row).

As shown in FIG. 19, the pixels PX are so called RGBW square pixels. The plurality of pixels PX comprises a first pixel, a second pixel adjacent to the first pixel in the column direction Y, a third pixel adjacent to the first pixel in the row direction X, and a fourth pixel adjacent to the second pixel in the row direction X and to the third pixel in the column direction Y. The first to fourth pixels are a red pixel PX, a green pixel PX, a blue pixel PX, and a white pixel PX. The picture element P comprises the first to fourth pixels.

For example, any two of the red pixel PX, the green pixel PX, the blue pixel PX, and the white pixel PX are arranged in each even-numbered row. The remaining two pixels are arranged in each odd-numbered row. In Example 2, the red pixel PX and the blue pixel PX are arranged in each even numbered row, and the green pixel PX and the white pixel PX are arranged in each odd numbered row. The output switch BCT is shared by the first to fourth pixels. Each of the numbers of the first scanning lines Sga and the reset lines Sgr is m/2, and the number of the output sections 30 is m/4.

Unlike in Example 1 (FIG. 18), in Example 2 (FIG. 19), the output section 20 is connected to two second scanning lines Sgb. Thus, in Example 2, the number of the output sections 20 is m/2.

Now, operation of the display apparatus (organic EL display apparatus) configured as described above will be described. FIG. 20, FIG. 21, FIG. 22, and FIG. 23 are timing charts showing control signals for the scanning line driving circuits YDR1 and YDR2 during display operation.

Figure 20:
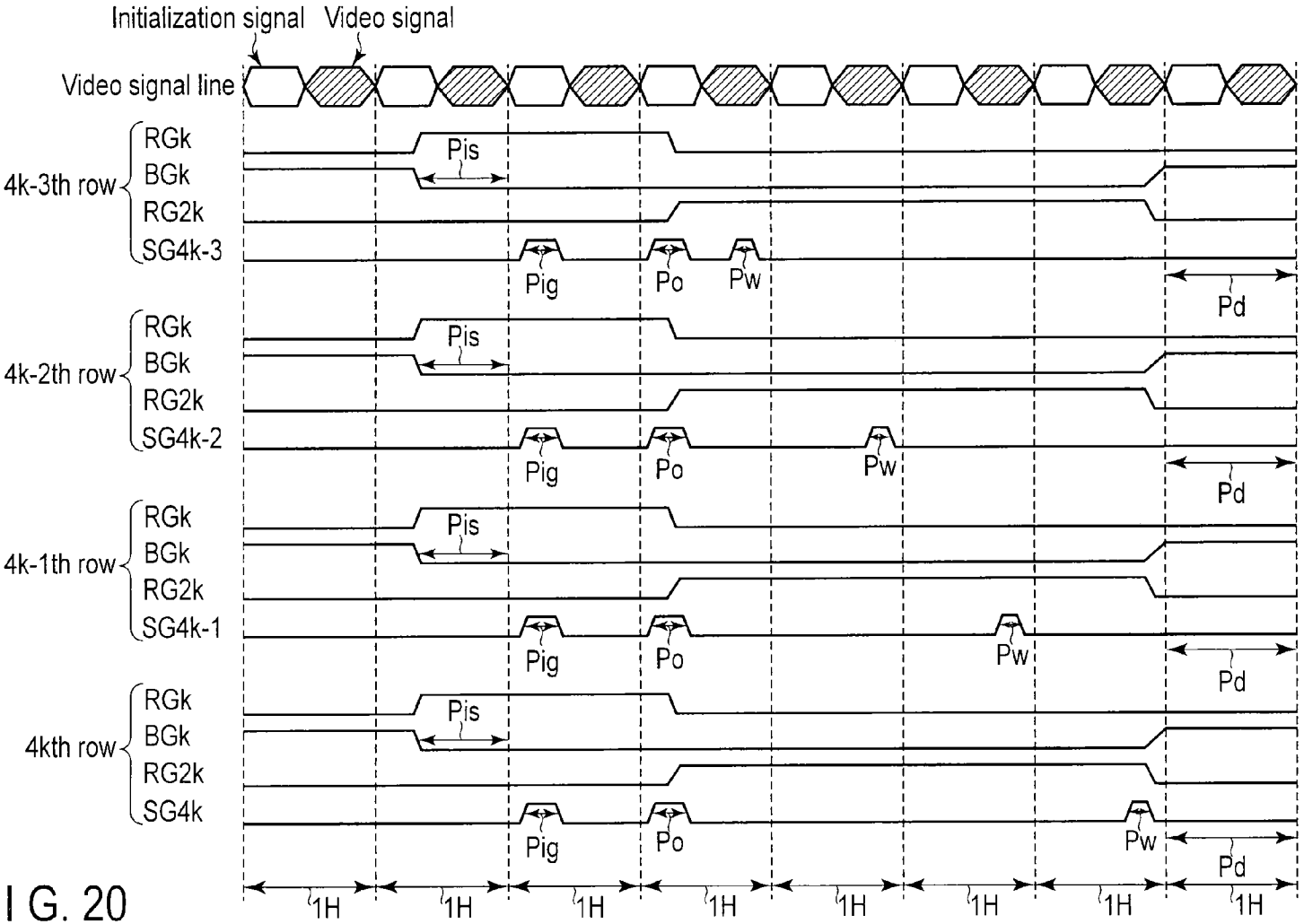
FIG. 20 is a timing chart showing control signals for a scanning line driving circuit obtained when the layout configuration of pixels in Example 1 according to the third embodiment is adopted and when one offset cancel operation is performed.
Figure 21:
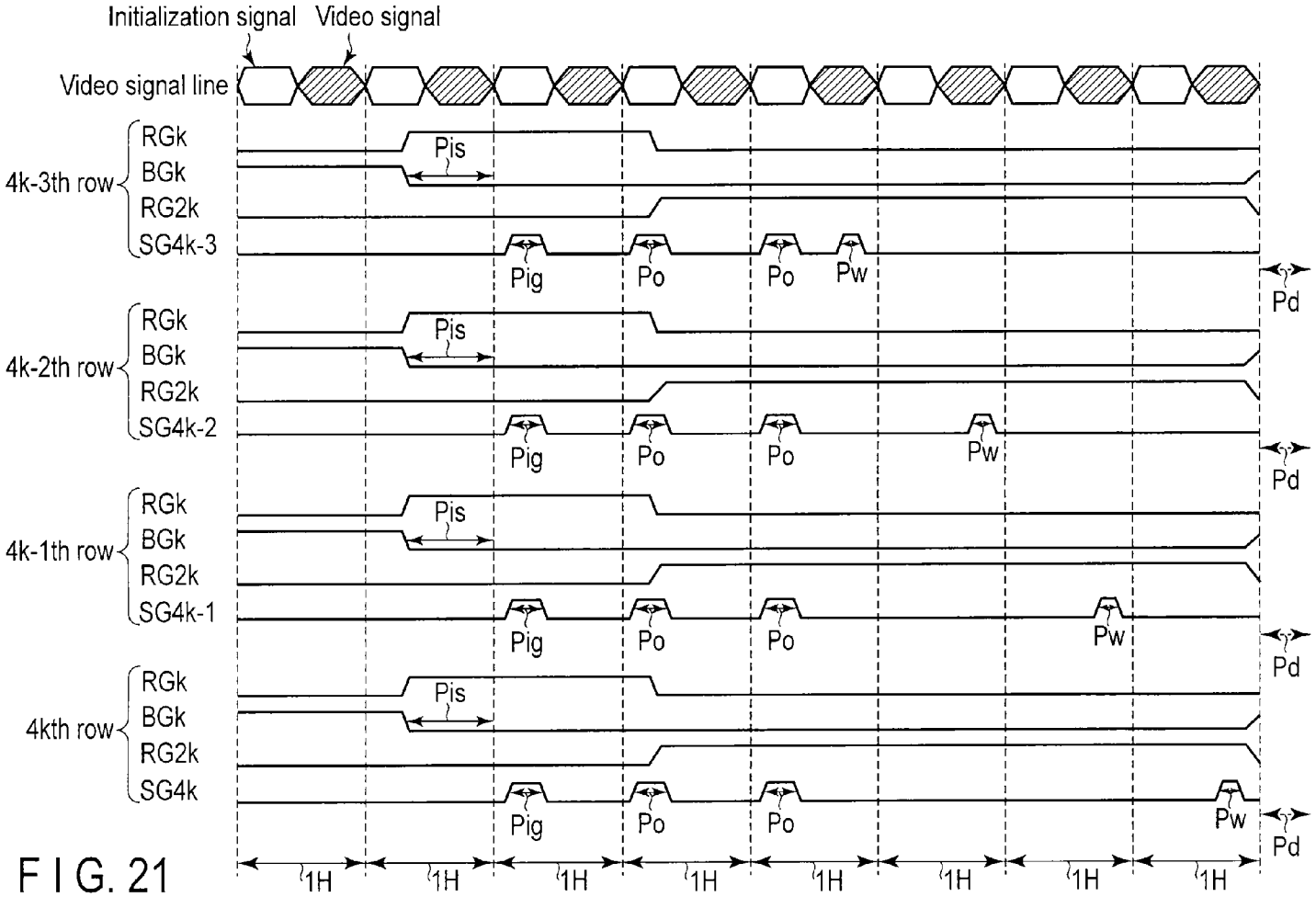
FIG. 21 is a timing chart showing control signals for the scanning line driving circuit obtained when the layout configuration of pixels in Example 1 according to the third embodiment is adopted and when two offset cancel operations are performed.
Figure 22:
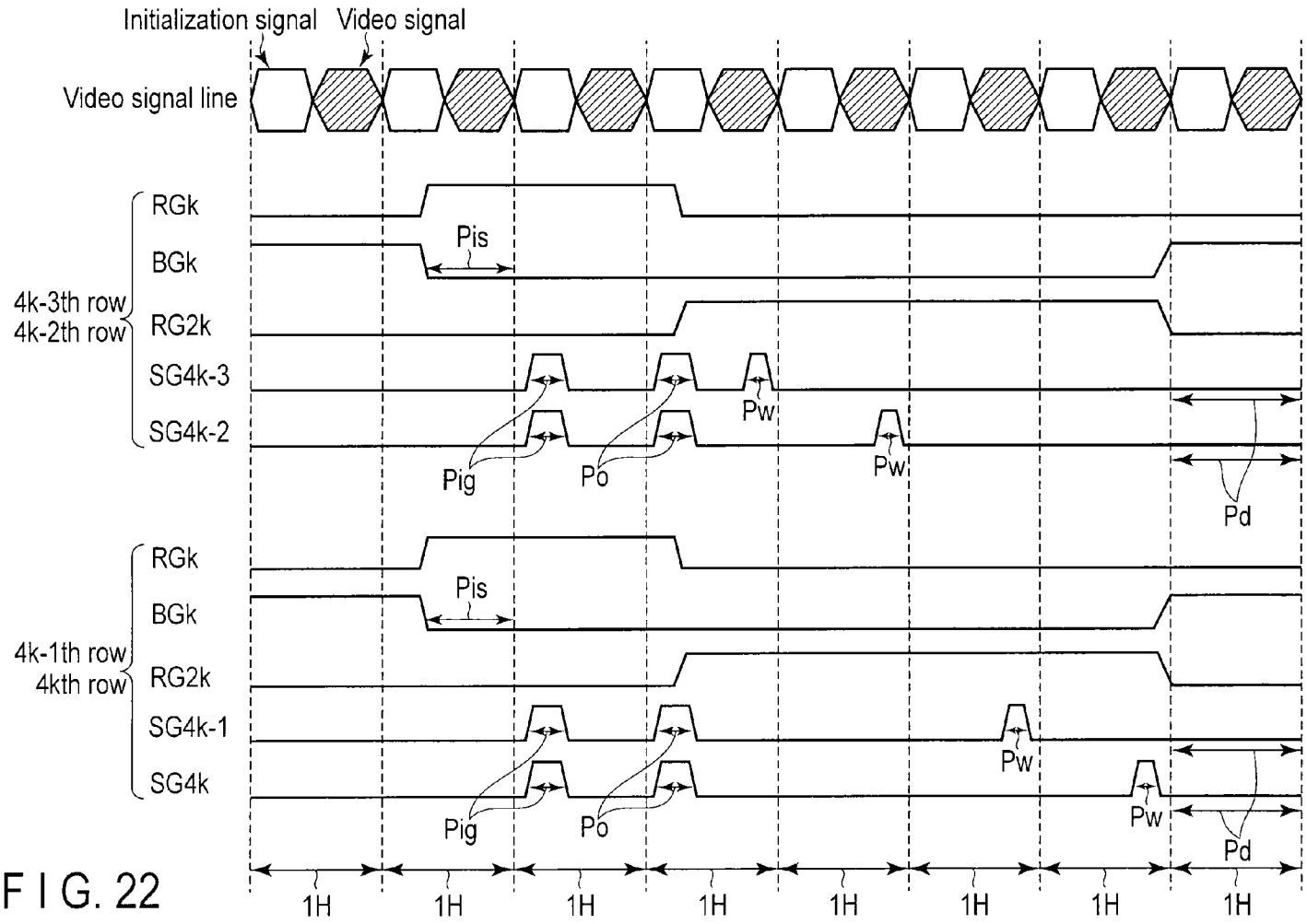
FIG. 22 is a timing chart showing control signals for a scanning line driving circuit obtained when the layout configuration of pixels in Example 2 according to the third embodiment is adopted and when one offset cancel operation is performed.
Figure 23:
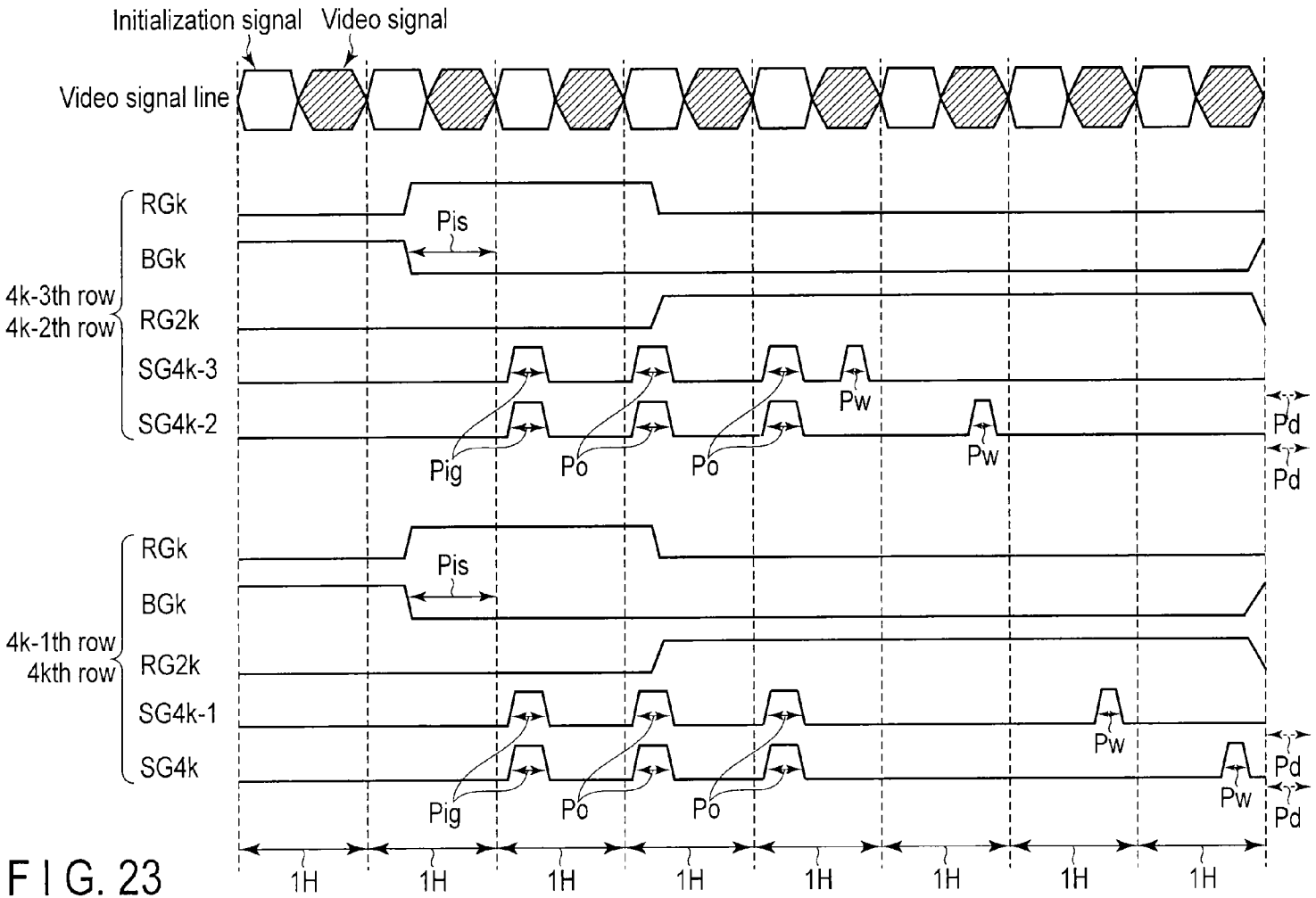
FIG. 23 is a timing chart showing control signals for the scanning line driving circuit obtained when the layout configuration of pixels in Example 2 according to the third embodiment and when two offset cancel operations are performed.

FIG. 20 illustrates a case where vertical stripe pixels are used and where one offset cancel period is provided. FIG. 21 illustrates a case where vertical stripe pixels are used and where a plurality of offset cancel periods (in this case, two offset cancel periods, as a typical example) is provided. FIG. 22 illustrates a case where RGBW square pixels are used and where one offset cancel period is provided. FIG. 23 illustrates a case where RGBW square pixels are used and where a plurality of offset cancel periods (in this case, two offset cancel period, as a typical example) is provided.

Thus, in Example 1, the display apparatus can be driven using the control signals in FIG. 20 or the control signals in FIG. 21. In Example 2, the display apparatus can be driven using the control signals in FIG. 22 or the control signals in FIG. 23.

Each of the scanning line driving circuits YDR1 and YDR2 generates, from a start signal and a clock, a pulse of a width equal to one horizontal scanning period corresponding to each horizontal scanning period, and outputs the pulse as the control signal BG (1 to m/4), SG (1 to m), or RG (1 to m/4). In this case, one horizontal scanning period is denoted by 1H.

The operation of a pixel circuit is divided into a source initialization operation performed during a source initialization period Pis, a gate initialization operation performed during a gate initialization period Pig, an offset cancel (CC) operation performed during an offset cancel period Po, a video signal write operation performed during a video signal write period Pw, and a display operation (light emission operation) performed during a display period Pd (light emission period).

As shown in FIG. 20 to FIG. 23, and FIG. 1 and FIG. 17, first, a driving section 10 performs a source initialization operation. During the source initialization operation, the scanning line driving circuits YDR1 and YDR2 set the control signal SG to the level at which the pixel switch SST is turned off (off potential: in this case, the low level), set the control signal BG to the level at which the output switch BCT is turned off (off potential: in this case, the low level), set the control signal RG to the level at which the reset switch RST is turned on (on potential: in this case, the high level), and set the control signal RG2 to the level at which the reset switch RST2 is turned off (off potential: in this case, the low level).

The output switch BCT, the pixel switch SST, and the reset switch RST2 are each turned off (electrically discontinuous state), and the reset switch RST is turned on (electrically continuous state). Thus, a source initialization operation is started. Turning the reset switch RST on resets the potentials of a source electrode and a drain electrode of the driving transistor DRT equal to the potential (reset potential Vrst) of the reset power supply. Then, the source initialization operation is completed. In this case, the reset power supply (reset potential Vrst) is set to, for example, −2 V.

Then, the driving section 10 performs a gate initialization operation. During the gate initialization operation, the scanning line driving circuits YDR1 and YDR2 set the control signal SG to the level at which the pixel switch SST is turned on (on potential: in this case, the high level), set the control signal BG to the level at which the output switch BCT is turned off, set the control signal RG to the level at which the reset switch RST is turned on, and set the control signal RG2 to the level at which the reset switch RST2 is turned off. The output switch BCT and the reset switch RST2 are turned off, and the pixel switch SST and the reset switch RST are turned on. Thus, a gate initialization operation is started.

During the gate initialization period Pig, an initialization signal Vini (initialization voltage) output through the video signal line VL is applied to a gate electrode of the driving transistor DRT through the pixel switch SST. Thus, the potential of the gate electrode of the driving transistor DRT is reset to a value corresponding to the initialization signal Vini to initialize information in the preceding frame. The voltage level of the initialization signal Vini is set to, for example, 2 V.

Subsequently, the driving section 10 performs an offset cancel operation. The control signal SG is set to the on potential, the control signal BG is set to the off potential, the control signal RG is set to the off potential (low level), and the control signal RG2 is set to the on potential (high level). Thus, the reset switch RST and the output switch BCT are turned off, and the pixel switch SST and the reset switch RST2 are turned on. An offset cancel operation for a threshold is started.

During the offset cancel period Po, the initialization signal Vini is applied to the gate electrode of the driving transistor DRT through the video signal line VL and the pixel switch SST. The potential of the gate electrode of the driving transistor DRT is fixed.

Furthermore, the reset switch RST2 is in the on state, so that a current from the other reset power supply flows into the driving transistor DRT through the reset switch RST2 and the reset line Sgr. In this case, the other reset power supply (reset potential Vrst2) is set to, for example, 5 V. The potential of the source electrode of the driving transistor DRT has an initial value equal to the potential (reset potential Vrst) written during the source initialization period Pis. While gradually reducing a current flowing into the driving transistor DRT through between the drain electrode and the source electrode of the driving transistor DRT, the potential of the source electrode of the driving transistor DRT shifts toward higher potentials while absorbing and compensating for a variation in the TFT property of the driving transistor DRT. According to the third embodiment, the offset cancel period Po is set to a time of, for example, 1 μsec.

At the end of the offset cancel period Po, the potential of the source electrode of the driving transistor DRT is Vini−Vth. The voltage value of the initialization signal Vini is denoted by Vini, and the threshold voltage of the driving transistor DRT is denoted by Vth. Thus, the voltage between the gate electrode and the source electrode of the driving transistor DRT reaches a cancel point (Vgs=Vth). The potential difference corresponding to the cancel point is stored (held) in a storage capacitance Cs. As in examples illustrated in FIG. 21 and FIG. 23, a plurality of offset cancel periods Po can be provided as necessary.

Subsequently, during the video signal write period Pw, the control signal SG is set to the level at which the pixel switch SST is turned on. The control signal BG is set to the level at which the output switch BCT is turned off. The control signal RG is set to the level at which the reset switch RST is turned off. The control signal RG2 is set to the level at which the reset switch RST2 is turned on. Then, the pixel switch SST and the reset switch RST2 are turned on, and the output switch BCT and the reset switch RST are turned off. A video signal write operation is started.

During the video signal write period Pw, the video signal Vsig from the video signal line VL is written to the gate electrode of the driving transistor DRT through the pixel switch SST. Furthermore, a current from the other reset power supply flows to the driving transistor DRT through the reset switch RST2 and the reset line Sgr. Immediately after the pixel switch SST is turned on, the potential of the gate electrode of the driving transistor DRT is Vsig (R, G, B), and the potential of the source electrode of the driving transistor is Vini−Vth+Cs(Vsig−Vini)/(Cs+Cel+Cad).

The voltage value of the video signal Vsig is denoted by Vsig, the capacity of the storage capacitance Cs is denoted by Cs, the capacity of a capacitance section Cel is denoted by Cel, and the capacity of the additional capacitance Cad is denoted by Cad.

Subsequently, a current flows to a low-potential power supply electrode SLb via the capacitance section Cel of a diode OLED. At the end of the video signal write period Pw, the potential of the gate electrode of the driving transistor DRT is Vsig (R, G, B), and the potential of the source electrode of the driving transistor DRT is Vini−Vth+ΔV1+Cs(Vsig−Vini)/(Cs+Cel+Cad).

The relation between a current Idrt flowing through the driving transistor DRT and the capacitance Cs+Cel+Cad is expressed by the formula (Formula 1) described above. The relation serves to correct a variation in the mobility in the driving transistor DRT.

Finally, during the display period Pd, the control signal SG is set to the level at which the pixel switch SST is turned off. The control signal BG is set to the level at which the output switch BCT is turned on. The control signal RG is set to the level at which the reset switch RST is turned off. The control signal RG2 is set to the level at which the reset switch RST2 is turned off. Then, the output switch BCT are turned on, and the pixel switch SST, the reset switch RST, and the reset switch RST2 are turned off. A display operation is started.

The driving transistor DRT outputs a driving current Tel of a current amount corresponding to the gate control voltage written to the storage capacitance Cs. The driving current Iel is supplied to the diode OLED. Thus, the diode OLED emits light at a luminance according to the driving current Iel to perform a display operation. The diode OLED maintains the light emission state until, after one frame period, the control signal BG is set to the off potential again.

The above-described source initialization operation, gate initialization operation, offset cancel operation, video signal write operation, and display operation are sequentially and repetitively performed on each pixel PX to display the desired image.

In the display apparatus and the method of driving the display apparatus according to the third embodiment configured as described above, the display apparatus comprises the plurality of pixels PX, the plurality of control lines, and the scanning line driving circuits YDR1 and YDR2 comprising the plurality of output sections 20 and 30, respectively. The pixel PX comprises the diode OLED and the pixel circuit that controls driving of the diode OLED. The plurality of control lines extends in the row direction X and is connected to the pixel circuits of the plurality of pixels PX. The output section 30 is connected to the plurality of control lines to apply control signals to the plurality of pixels PX provided in the plurality of rows.

Thus, the number of the output sections 30 can be set smaller than the number of the rows in which the pixels PX are provided. For example, the number of the output sections 30 can be reduced to one-quarter of the number of the rows in which the pixels PX are provided.

More specifically, the display apparatus comprises the plurality of video signal lines VL, the plurality of scanning lines (first scanning lines Sga, second scanning lines Sgb, third scanning lines Sgc, and fourth scanning lines Sgd), the plurality of reset lines Sgr, and the plurality of pixels PX. Each of the pixels PX comprises the driving transistor DRT, the diode OLED, the pixel switch SST, the output switch BCT, the storage capacitance Cs, and the additional capacitance Cad.

The diode OLED is connected between a high-potential power supply line SLa and the low-potential power supply electrode SLb. The driving transistor DRT comprises the source electrode connected to the diode OLED, the drain electrode connected to the reset line Sgr, and the gate electrode. The output switch BCT is connected between the high-potential power supply line SLa and the drain electrode of the driving transistor DRT to switch the state between the high-potential power supply line SLa and the drain electrode of the driving transistor DRT to the electrically continuous state or the electrically discontinuous state.

The pixel switch SST is connected between the video signal line VL and the gate electrode of the driving transistor DRT to determine, in a switchable manner, whether to load the initialization signal Vini or the video signal Vsig provided through the video signal line VL onto the gate electrode side of the driving transistor. The storage capacitance Cs is connected between the source electrode and the gate electrode of the driving transistor DRT.

Each of the output sections 30 is connected to two first scanning lines Sga and two reset lines Sgr. Compared to the case where each of the output sections 30 is connected to each of the first scanning line Sga and the reset line Sgr on a one-to-one basis, the third embodiment can reduce the number of the output sections 30 (reset switches RST and RST2).

Furthermore, since a number of pixels PX of the plurality of pixels PX which are adjacent to one another in the column direction Y share the output switch BCT. According to the third embodiment, four pixels PX share one output switch BCT.

Compared to the case where one output switch BCT is provided for each pixel PX, the third embodiment can reduce the number of the output switches BCT to one-quarter, reduce the numbers of the first scanning lines Sga, the third scanning lines Sgc, the forth scanning lines Sgd, and the reset lines Sgr to half, and further reduce the numbers of the reset switches RST and RST2. According to the third embodiment, the number of the output sections 30 (reset switches RST and RST2) is m/4. Consequently, the display apparatus can be configured to have a slim border and to achieve a high definition. Furthermore, the number of elements can be reduced, and the number of the output switches BCT within a display area R1 can be reduced.

The scanning line driving circuit YDR2 comprises the reset switch RST2. During an offset cancel operation, the reset switch RST2 can switch the other reset power supply and the driving transistor DRT to the electrically continuous state. This allows the value of the voltage (Vds) between the drain electrode and the source electrode of the driving transistor DRT obtained at the end of the offset cancel operation to be brought closer to the value of the voltage (Vds) obtained during a display operation (during white display). Thus, the third embodiment can obtain a display apparatus that is more excellent in display quality.

The display apparatus and the method of driving the display apparatus according to the third embodiment can exert other effects similar to the corresponding effects of the display apparatus and the method of driving the display apparatus according to the first embodiment.

Thus, a high-definition display apparatus and a method of driving the display apparatus can be obtained which allow the border to be made slimmer.

Figure 24:
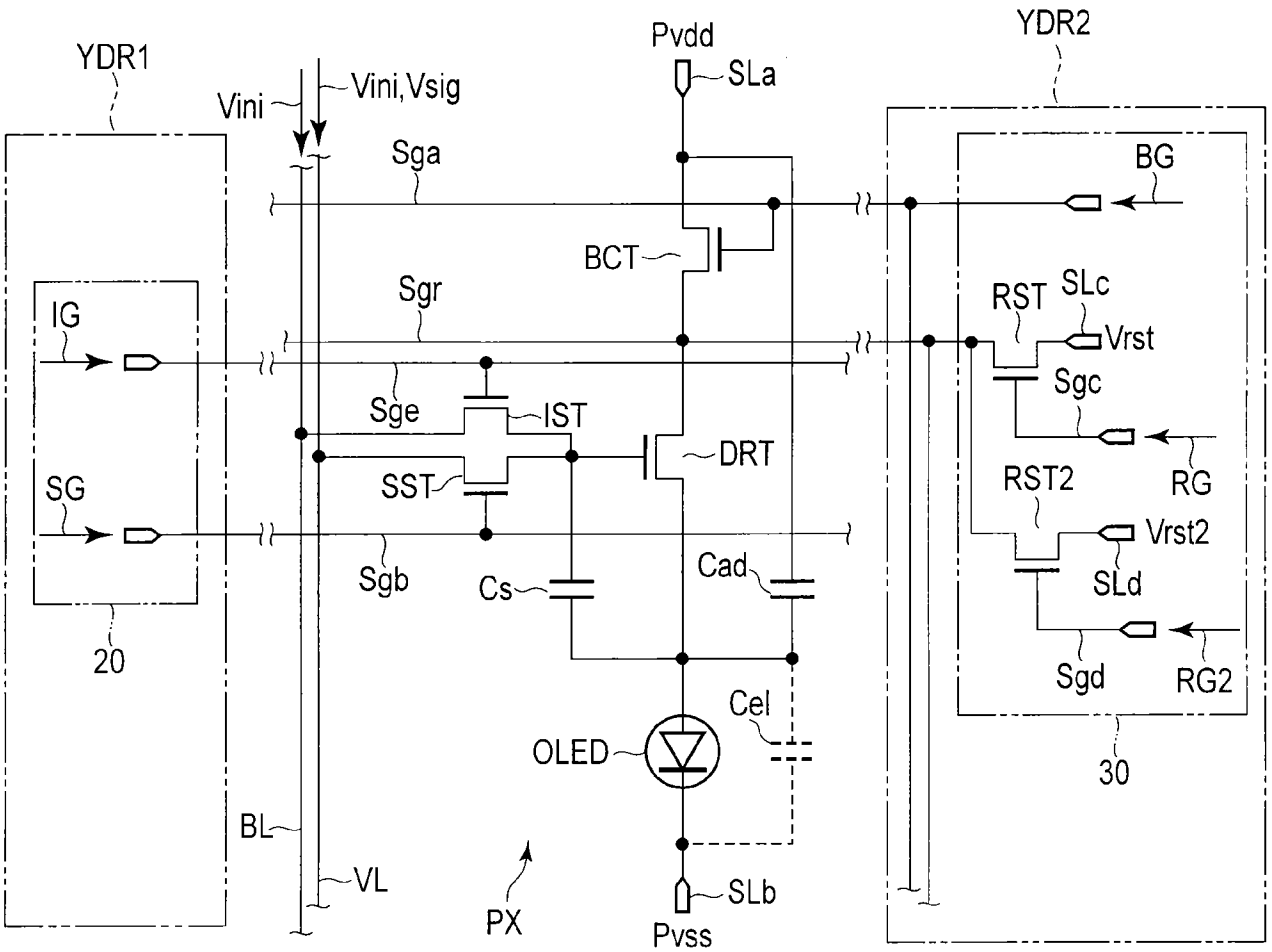
FIG. 24 is an equivalent circuit diagram of a pixel in a display apparatus according to a fourth embodiment.

Now, a display apparatus and a method of driving the display apparatus according to a fourth embodiment will be described. The same functional sections of the fourth embodiment as the corresponding functional sections of the third embodiment are denoted by the same reference numerals and will not be described in detail. FIG. 24 is an equivalent circuit diagram of a pixel in the display apparatus according to the fourth embodiment.

As shown in FIG. 24, a display panel DP comprises a plurality of (m) fifth scanning lines Sge (1 to m) and a plurality of (n) reference signal lines BL (1 to n). Each output section 20 is connected to the fifth scanning line Sge on a one-to-one basis. Each pixel PX comprises an initialization switch IST. The initialization switch IST comprises a TFT with the same conductivity type as that of a driving transistor DRT, for example, the N channel type.

Also in the fourth embodiment, all thin film transistors included in the driving transistors and the switches are formed during the same step so as to have the same layer structure, and have a top gate structure that uses polysilicon in a semiconductor layer.

In the initialization switch IST, a source electrode is connected to the reference signal line BL (1 to n), a drain electrode is connected to a gate electrode of the driving transistor DRT, and a gate electrode is connected to the fifth scanning line Sge (1 to m). The initialization switch IST is controllably turned on and off in accordance with a control signal IG (1 to m) supplied through the fifth scanning line Sge. In response to the control signals IG (1 to m), the initialization switch IST controls connects and disconnects between the pixel circuit and the reference signal line BL (1 to n), and captures the initialization signal Vini from the corresponding reference signal line BL (1 to n) into the pixel circuit.

Figure 25:
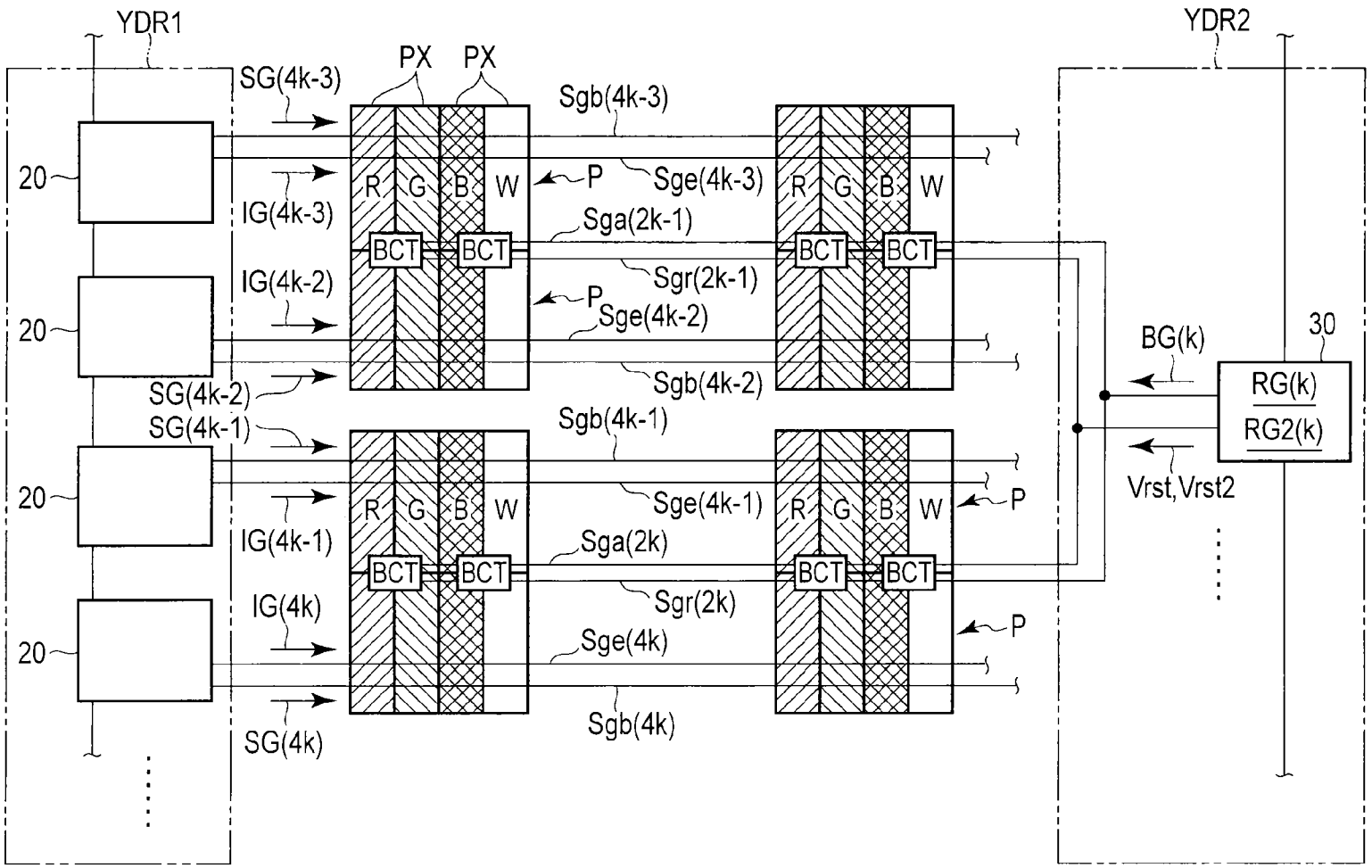
FIG. 25 is a schematic diagram showing a layout configuration of pixels in Example 1 according to the fourth embodiment.
Figure 26:
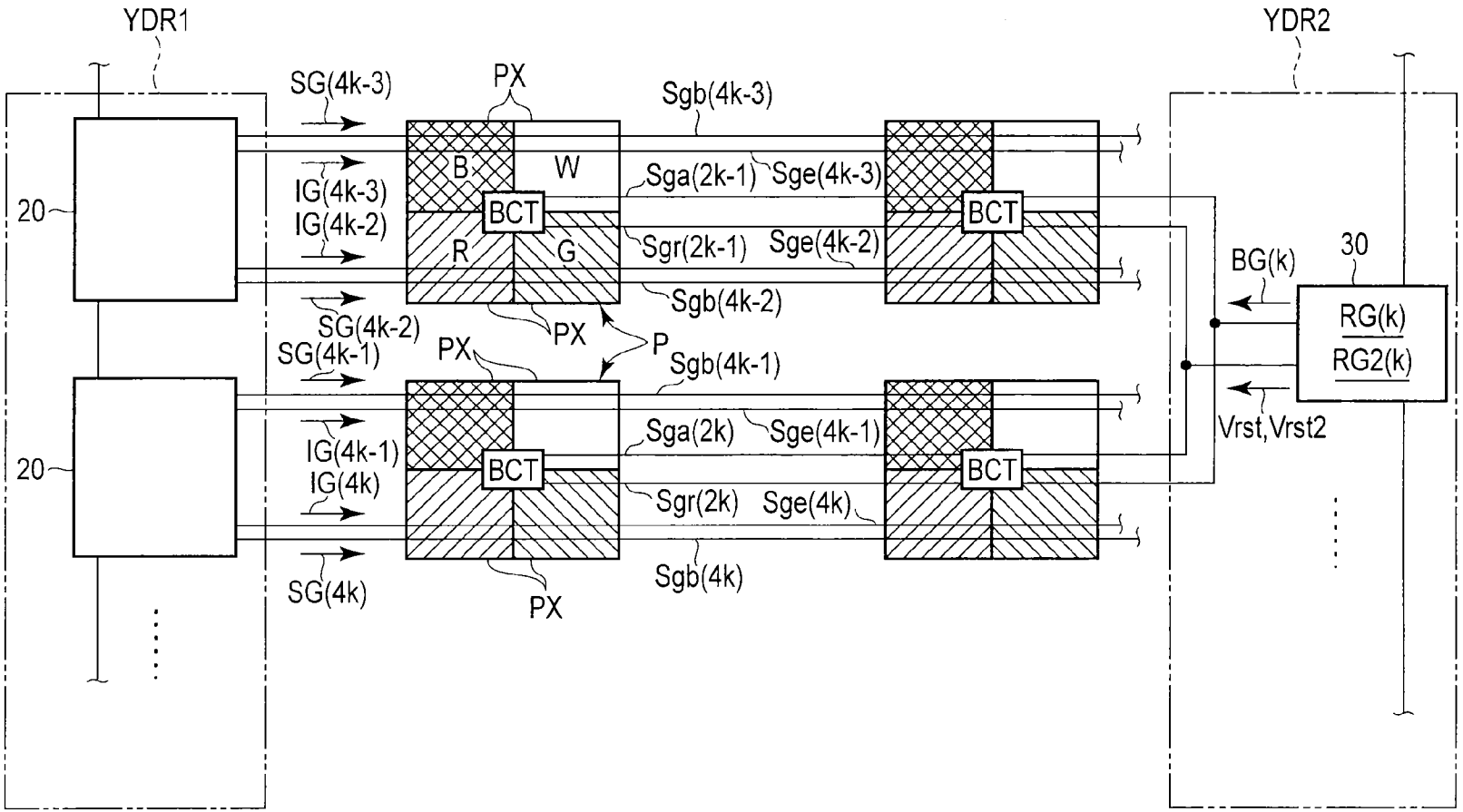
FIG. 26 is a schematic diagram showing a layout configuration of pixels in Example 2 according to the fourth embodiment.

Now, a layout configuration of the plurality of pixels PX according to the fourth embodiment will be described. FIG. 25 is a schematic diagram showing a layout configuration of the pixels PX in Example 1 according to the fourth embodiment. FIG. 26 is a schematic diagram showing a layout configuration of the pixels PX in Example 2 according to the fourth embodiment.

As shown in FIG. 25, the pixels PX are so called vertical stripe pixels. An output switch BCT is shared by four adjacent pixels PX (two pixels adjacent to each other in the column direction Y and two pixels adjacent to each other in the row direction X).

The 4 k−3th output section 20 (in the 4 k−3th row) is connected to the 4 k−3th fifth scanning line Sge (in the 4 k−3th row). The 4 k−2th output section 20 (in the 4 k−2th row) is connected to the 4 k−2th fifth scanning line Sge (in the 4 k−2th row). The 4 k−1th output section 20 (in the 4 k−1th row) is connected to the 4 k−1th fifth scanning line Sge (in the 4 k−1th row). The 4 kth output section 20 (in the 4 kth row) is connected to the 4 kth fifth scanning line Sge (in the 4 kth row).

As shown in FIG. 26, the pixels PX are so called RGBW square pixels. The plurality of pixels PX comprises a first pixel, a second pixel adjacent to the first pixel in the column direction Y, a third pixel adjacent to the first pixel in the row direction X, and a fourth pixel adjacent to the second pixel in the row direction X and to the third pixel in the column direction Y. The output switch BCT is shared by the first to fourth pixels.

Unlike in Example 1 (FIG. 25), in Example 2 (FIG. 26), the output section 20 is connected to two fifth scanning lines Sge. Thus, in Example 2, the number of the output sections 30 is m/2.

Figure 27:
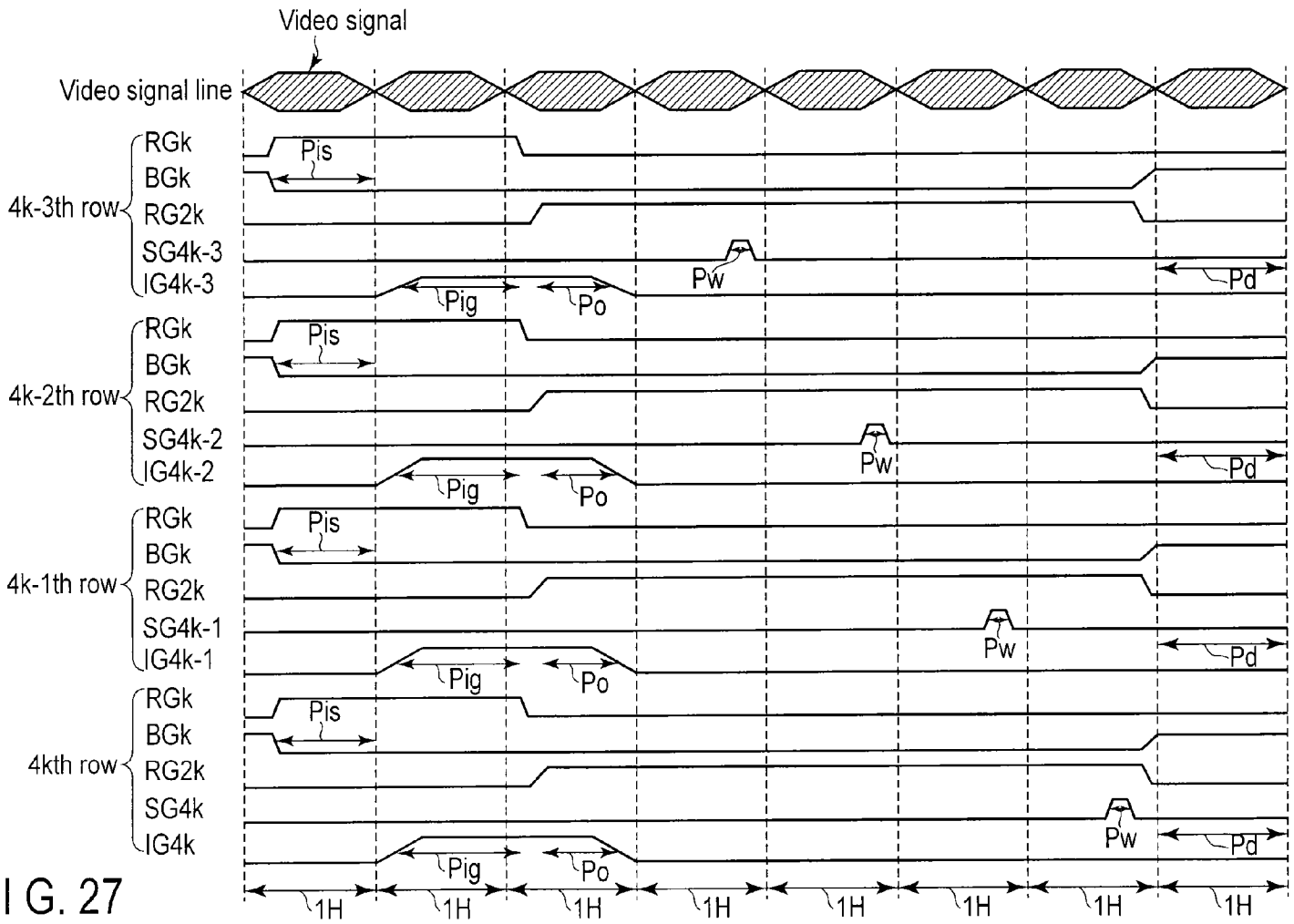
FIG. 27 is a timing chart showing control signals for a scanning line driving circuit obtained when the layout configuration of pixels in Example 1 according to the fourth embodiment is adopted.
Figure 28:
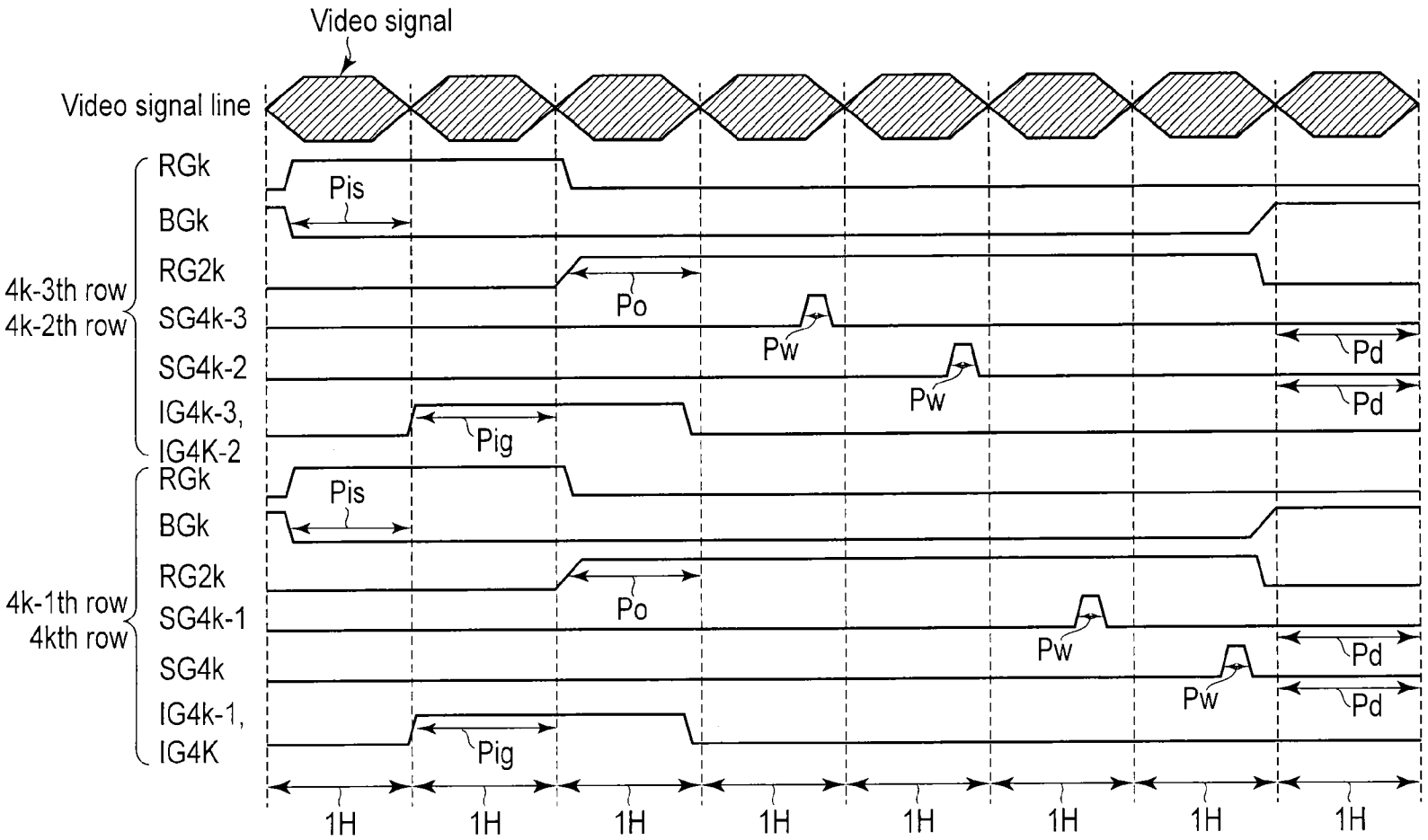
FIG. 28 is a timing chart showing control signals for the scanning line driving circuit obtained when the layout configuration of pixels in Example 2 according to the fourth embodiment is adopted.

Now, operation of the display apparatus (organic EL display apparatus) configured as described above will be described. FIG. 27 and FIG. 28 are timing charts showing control signals for the scanning line driving circuits YDR1 and YDR2 during display operation. FIG. 27 illustrates a case where the display apparatus according to the fourth embodiment comprises vertical stripe pixels. FIG. 28 illustrates a case where the display apparatus according to the fourth embodiment comprises RGBW square pixels.

Thus, in Example 1, the display apparatus can be driven using the control signals in FIG. 27. In Example 2, the display apparatus can be driven using the control signals in FIG. 28.

Each of the scanning line driving circuits YDR1 and YDR2 generates, from a start signal and a clock, a pulse of a width equal to one horizontal scanning period corresponding to each horizontal scanning period, and outputs the pulses as control signals BG (1 to m/4), SG (1 to m), IG (1 to m), and RG (1 to m/4). In this case, one horizontal scanning period is denoted by 1H.

The operation of a pixel circuit is divided into a source initialization operation performed during a source initialization period Pis, a gate initialization operation performed during a gate initialization period Pig, an offset cancel (CC) operation performed during an offset cancel period Po, a video signal write operation performed during a video signal write period Pw, and a display operation (light emission operation) performed during a display period Pd (light emission period).

As shown in FIG. 27 and FIG. 28, and FIG. 1 and FIG. 24, first, a driving section 10 performs a source initialization operation. During the source initialization operation, the scanning line driving circuits YDR1 and YDR2 set the control signal SG to the level at which a pixel switch SST is turned off, set the control signal BG to the level at which the output switch BCT is turned off, set the control signal RG to the level at which a reset switch RST is turned on, set a control signal RG2 to the level at which a reset switch RST2 is turned off, and set the control signal IG to the level at which the initialization switch IST is turned off (off potential: in this case, the low level).

The output switch BCT, the pixel switch SST, the initialization switch IST, and the reset switch RST2 are each turned off (electrically discontinuous state), and the reset switch RST is turned on (electrically continuous state). Thus, a source initialization operation is started. Turning the reset switch RST on resets the potentials of a source electrode and a drain electrode of the driving transistor DRT equal to the potential (reset potential Vrst) of a reset power supply. Then, the source initialization operation is completed. In this case, the reset power supply (reset potential Vrst) is set to, for example, −2 V.

Then, the driving section 10 performs a gate initialization operation. During the gate initialization operation, the scanning line driving circuits YDR1 and YDR2 set the control signal SG to the level at which the pixel switch SST is turned off, set the control signal BG to the level at which the output switch BCT is turned off, set the control signal RG to the level at which the reset switch RST is turned on, set the control signal RG2 to the level at which the reset switch RST2 is turned off, and set the control signal IG to the level at which the initialization switch IST is turned on. The output switch BCT, the pixel switch SST, and the reset switch RST2 are turned off, and the initialization switch IST and the reset switch RST are turned on. Thus, a gate initialization operation is started.

During the gate initialization operation Pig, an initialization signal Vini (initialization voltage) output through the reference signal line BL is applied to a gate electrode of the driving transistor DRT through the initialization switch IST. Thus, the potential of the gate electrode of the driving transistor DRT is reset to a value corresponding to the initialization signal Vini to initialize information in the preceding frame. The voltage level of the initialization signal Vini is set to, for example, 2 V.

Subsequently, the driving section 10 performs an offset cancel operation. The control signal SG is set to the off potential, the control signal BG is set to the off potential, the control signal RG is set to the off potential, the control signal RG2 is set to the on potential, and the control signal IG is set to the on potential. Thus, the reset switch RST, the pixel switch SST, and the output switch BCT are turned off, and the initialization switch IST and the reset switch RST2 are turned on. An offset cancel operation for a threshold is started.

During the offset cancel period Po, the initialization signal Vini is applied to the gate electrode of the driving transistor DRT through the reference signal line BL and the initialization switch IST. The potential of the gate electrode of the driving transistor DRT is fixed.

Furthermore, the reset switch RST2 is in the on state, so that a current from other reset power supply flows into the driving transistor DRT through the reset switch RST2 and a reset line Sgr. In this case, the other reset power supply (reset potential Vrst2) is set to, for example, 5 V. The potential of the source electrode of the driving transistor DRT has an initial value equal to the potential (reset potential Vrst) written during the source initialization period Pis. While gradually reducing a current flowing into the driving transistor DRT through between the drain electrode and the source electrode of the driving transistor DRT, the potential of the source electrode of the driving transistor DRT shifts toward higher potentials while absorbing and compensating for a variation in the TFT property of the driving transistor DRT.

According to the fourth embodiment, the display apparatus comprises the reference signal line BL and the initialization switch IST, used only to apply the initialization signal Vini to the pixel PX. Thus, unlike the first embodiment, the fourth embodiment can ensure a sufficient length of the offset cancel period Po.

At the end of the offset cancel period Po, the potential of the source electrode of the driving transistor DRT is Vini−

Vth. Thus, the voltage between the gate electrode and the source electrode of the driving transistor DRT reaches a cancel point (Vgs=Vth). The potential difference corresponding to the cancel point is stored (held) in a storage capacitance Cs.

Subsequently, during the video signal write period Pw, the control signal SG is set to the level at which the pixel switch SST is turned on. The control signal BG is set to the level at which the output switch BCT is turned off. The control signal RG is set to the level at which the reset switch RST is turned off. The control signal RG2 is set to the level at which the reset switch RST2 is turned on. The control signal IG is set to the level at which the initialization switch IST is turned off. Then, the pixel switch SST and the reset switch RST2 are turned on, and the output switch BCT, the initialization switch IST, and the reset switch RST are turned off. A video signal write operation is started.

During the video signal write period Pw, a video signal Vsig from the video signal line VL is written to the gate electrode of the driving transistor DRT through the pixel switch SST. Furthermore, a current from the other reset power supply flows to the driving transistor DRT through the reset switch RST2 and the reset line Sgr. Immediately after the pixel switch SST is turned on, the potential of the gate electrode of the driving transistor DRT is Vsig (R, G, B), and the potential of the source electrode of the driving transistor is Vini−Vth+Cs(Vsig−Vini)/(Cs+Cel+Cad).

Subsequently, a current flows to a low-potential power supply electrode SLb via the capacitance section Cel of a diode OLED. At the end of the video signal write period Pw, the potential of the gate electrode of the driving transistor DRT is Vsig (R, G, B), and the potential of the source electrode of the driving transistor DRT is Vini−Vth+ΔV1+Cs(Vsig−Vini)/(Cs+Cel+Cad). The variation of the mobility of the driving transistor DRT is thereby corrected.

Finally, during the display period Pd, the control signal SG is set to the level at which the pixel switch SST is turned off. The control signal BG is set to the level at which the output switch BCT is turned on. The control signal RG is set to the level at which the reset switch RST is turned off. The control signal RG2 is set to the level at which the reset switch RST2 is turned off. The control signal IG is set to the level at which the initialization switch IST is turned off. Then, the output switch BCT are turned on, and the pixel switch SST, the initialization switch IST, the reset switch RST, and the reset switch RST2 are turned off. A display operation is started.

The driving transistor DRT outputs a driving current Iel of a current amount corresponding to the gate control voltage written to the storage capacitance Cs. The driving current Iel is supplied to the diode OLED. Thus, the diode OLED emits light at a luminance according to the driving current Iel to perform a display operation. The diode OLED maintains the light emission state until, after one frame period, the control signal BG is set to the off potential again.

The above-described source initialization operation, gate initialization operation, offset cancel operation, video signal write operation, and display operation are sequentially and repetitively performed on each pixel PX to display the desired image.

In the display apparatus and the method of driving the display apparatus according to the fourth embodiment configured as described above, the display apparatus comprises the plurality of pixels PX, the plurality of control lines, and the scanning line driving circuits YDR1 and YDR2 comprising the plurality of output sections 20 and 30, respectively. The pixel PX comprises the diode OLED and the pixel circuit that controls driving of the diode OLED. The plurality of control lines extends in the row direction X and is connected to the pixel circuits of the plurality of pixels PX. The output section 30 is connected to the plurality of control lines to apply control signals to the plurality of pixels provided in the plurality of rows.

Thus, the number of the output sections 30 can be set smaller than the number of the rows in which the pixels PX are provided. For example, the number of the output sections 30 can be reduced to one-quarter of the number of the rows in which the pixels PX are provided. Furthermore, a number of pixels PX of the plurality of pixels X which are adjacent to one another in the column direction shares the output switch BCT.

The fourth embodiment can reduce the numbers of the first scanning lines Sga, the third scanning lines Sgc, the fourth scanning lines Sgd, and the reset lines Sgr, further reducing the numbers of the reset switches RST and RST2. Thus, the display apparatus can be configured to have a slim border and to achieve a high definition.

The display apparatus comprises the reference signal line BL and the initialization switch IST. A sufficient length of the offset cancel period Po can be ensured, allowing the voltage between the gate electrode and the source electrode of the driving transistor DRT to reach a threshold voltage. This enables suppression of the adverse effect of a variation in the threshold voltage of the driving transistor DRT.

As seen in FIG. 27 and FIG. 28, control signals IG4k−3, IG4k−2, IG4k−1, and IG4k have the same waveform. Thus, in a modification, one output source may be provided for the control signals IG4k−3, IG4k−2, IG4k−1, and IG4k. This enables a reduction in, for example, the number of buffers used to output the control signal IG and thus in the layout area of the scanning line driving circuit YDR1.

The display apparatus and the method of driving the display apparatus according to the fourth embodiment can exert other effects similar to the corresponding effects of the display apparatus and the method of driving the display apparatus according to the third embodiment.

Thus, a high-definition display apparatus and a method of driving the display apparatus can be obtained which allow the border to be made slimmer.

The third and fourth embodiments are only illustrative and are not intended to limit the scope of the invention. In a practical phase, the third and fourth embodiments can be embodied with components thereof modified and without departing from the spirits of the invention. Furthermore, various inventions can be formed by appropriately combining a plurality of components disclosed in the embodiments. For example, some of all the components disclosed in the embodiments may be deleted. Moreover, components of the different embodiments may be appropriately combined together.

For example, the scanning line driving circuit YDR2 may comprise less than m/4 output sections 30 such as m/6 or m/8 output sections 30. This enables a further reduction in the layout area of the scanning line driving circuit YDR2. Each of the output sections 30 can apply control signals to the pixel circuits of the plurality of pixels PX provided in four rows or more. When the scanning line driving circuit YDR2 according to the first embodiment comprises m/6 output sections 30 by way of example, each of the output sections 30 is connected to three first scanning lines Sga and three reset lines Sgr.

The output section 30 need not necessarily have the reset switch RST2.

A semiconductor layer in the TFT is not limited to polysilicon but may be formed of amorphous silicon. The TFT forming each switch or the driving transistor DRT is not limited to an N-channel TFT but may comprise a P-channel TFT. Similarly, each of the reset switches RST and RST2 may comprise a P-channel TFT or an N-channel TFT. The shapes and sizes of the driving transistor DRT and the switches are not limited to the shapes and sizes according to the above-described embodiments but may be changed as necessary.

Furthermore, one output switch BCT is provided for and shared by four pixels PX. However, the present invention is not limited to this configuration, and the number of the output switches BCT may be increased or reduced as necessary. For example, two pixels PX provided in two rows and one column may share one output switch BCT or eight pixels PX provided in two rows and four columns may share one output switch BCT.

Moreover, a self-illuminated element forming the pixel PX is not limited to the diode (organic EL diode) OLED but may be formed by using any of various display elements which can be self-illuminated.

The additional capacity Cad may be connected between the source electrode of the driving transistor DRT and a constant-potential line. Examples of the constant-potential line include a high-potential power supply line SLa, the low-potential power supply electrode (line) SLb, and the reset line Sgr.

The third and fourth embodiments are not limited to the above-described display apparatuses and methods of driving the display apparatus but may be applied to various display apparatuses and methods of driving the display apparatus.

Matters related to the third and fourth embodiments and modifications of the third and fourth embodiments are disclosed in (B1) to (B10).

(B1) A display apparatus comprising: a plurality of pixels each comprising a display element and a pixel circuit controlling driving of the display element, the pixels being provided in a matrix along a row direction and a column direction;

a plurality of control lines extending in the row direction and connected to the pixel circuits of the plurality of pixels; and a scanning line driving circuit comprising a plurality of output sections, wherein each of the output sections is connected to the control lines and configured to apply a control signal to the pixel circuits of the pixels provided in a plurality of rows.

(B2) The display apparatus according to (B1), wherein the control lines comprises a plurality of reset lines, the display element is connected between a high-potential power supply and a low-potential power supply, the pixel circuit comprises:

a driving transistor comprising a source electrode connected to the display element, a drain electrode connected to the reset line, and a gate electrode;

an output switch connected between the high-potential power supply and the drain electrode of the driving transistor and configured to switch a state between the high-potential power supply and the drain electrode of the driving transistor to an electrically continuous state or an electrically discontinuous state;

a pixel switch connected between a video signal line and the gate electrode of the driving transistor and configured to determine, in a switchable manner, whether to load a signal provided through the video signal line onto the gate electrode side of the driving transistor; and a storage capacitance connected between the source electrode and the gate electrode of the driving transistor, the control lines connected to each of the plurality of output sections are the reset lines, and the control signal is a reset signal.

(B3) The display apparatus according to (B2), wherein each of the plurality of output sections comprises a reset switch connected between a reset power supply and the reset line and configured to switch a state between the reset power supply and the reset line to the electrically continuous state or the electrically discontinuous state in accordance with a control signal.

(B4) The display apparatus according to (B3), wherein each of the plurality of output sections comprises other reset switch connected between other reset power supply and the reset line and configured to switch a state between the other reset power supply and the reset line to the electrically continuous state or the electrically discontinuous state in accordance with a control signal.

(B5) The display apparatus according to (B2), wherein a number of pixels of the plurality of pixels which are adjacent to one another in the column direction share the output switch, and each of the plurality of output sections applies a control signal to the pixel circuits of the plurality of pixels provided in four or more rows.

(B6) The display apparatus according to (B5), wherein the plurality of pixels comprises a first pixel, a second pixel adjacent to the first pixel in the column direction, a third pixel adjacent to the first pixel in the row direction, and a fourth pixel adjacent to the second pixel in the row direction and to the third pixel in the column direction, and the first to fourth pixels share the output switch.

(B7) The display apparatus according to (B6), wherein the first to fourth pixels comprise a pixel configured to display a red image, a pixel configured to display a green image, a pixel configured to display a blue image, and a pixel configured to display a white image.

(B8) The display apparatus according to (B5), wherein the plurality of pixels include pixels arranged in the row direction and including a pixel configured to display a red image, a pixel configured to display a green image, a pixel configured to display a blue image, and a pixel configured to display a white image are arranged in the row direction, and pixels arranged in the column direction and configured to display images in an identical color.

(B9) The display apparatus according to (B5), wherein the plurality of pixels include pixels arranged in the row direction and including a pixel configured to display a red image, a pixel configured to display a green image, a pixel configured to display a blue image, and a pixel configured to display a white image are arranged in the row direction, and pixels arranged in the column direction and configured to display images in an identical color.

(B10) A method of driving a display apparatus comprising a plurality of pixels each comprising a display element and a pixel circuit controlling driving of the display element, the pixels being provided in a matrix along a row direction and a column direction, a plurality of control lines extending in the row direction and connected to the pixel circuits of the plurality of pixels, and a scanning line driving circuit comprising a plurality of output sections, the display element being connected between a high-potential power supply and a low-potential power supply, the pixel circuit comprising a driving transistor comprising a source electrode connected to the display element, a drain electrode connected to the reset line, and a gate electrode, an output switch connected between the high-potential power supply and the drain electrode of the driving transistor configured to switch a state between the high-potential power supply and the drain electrode of the driving transistor to an electrically continuous state or an electrically discontinuous state, a pixel switch connected between a video signal line and the gate electrode of the driving transistor and configured to determine, in a switchable manner, whether to load a signal provided through the video signal line onto the gate electrode side of the driving transistor, and a storage capacitance connected between the source electrode and the gate electrode of the driving transistor, each of the output sections being connected to the reset lines and configured to apply a reset signal to the pixel circuits of the pixels provided in a plurality of rows, the method comprising:

during a source initialization period, applying the reset signal to the drain electrode of the driving transistor through the reset line;

during a gate initialization period following the source initialization period, with the reset signal applied to the drain electrode of the driving transistor, applying an initialization signal to the gate electrode of the driving transistor through the video signal line and the pixel switch to initialize the driving transistor;

during an offset cancel period following the gate initialization period, with the initialization signal applied to the gate electrode of the driving transistor, passing a current through the reset line to the driving transistor to cancel a threshold offset for the driving transistor;

during a video signal write period following the offset cancel period, applying a video signal to the gate electrode of the driving transistor through the video signal line and the pixel switch to pass a current through the reset line to the driving transistor; and during a display period following the video signal write period, passing a driving current corresponding to the video signal from the high-potential power supply to the display element through the output switch and the driving transistor.

A display apparatus and a method of driving the display apparatus according to a fifth embodiment will be described below in detail with reference to the drawings. According to the fifth embodiment, the display apparatus is an active matrix display apparatus, and more specifically, an active matrix organic EL (ElecroLuminescence) display apparatus. The same functional sections of the fifth embodiment as the corresponding functional sections of the first embodiment are denoted by the same reference numerals and will not be described in detail. FIG. 1, FIG. 2, and FIG. 3 and the description of FIG. 1, FIG. 2, and FIG. 3 are applicable to the description of the fifth embodiment.

Each pixel PX comprises an output switch BCT. A plurality of pixels PX adjacent to one another in a column direction Y shares the output switch BCT. According to the fifth embodiment, four or six pixels PX adjacent to one another in a row direction X and the column direction Y share one output switch BCT. Furthermore, the above-described several embodiments have been described in conjunction with the low-potential power supply electrode SLb. However, the fifth embodiment will be described in conjunction with a low-potential power supply line SLb.

Figure 29:
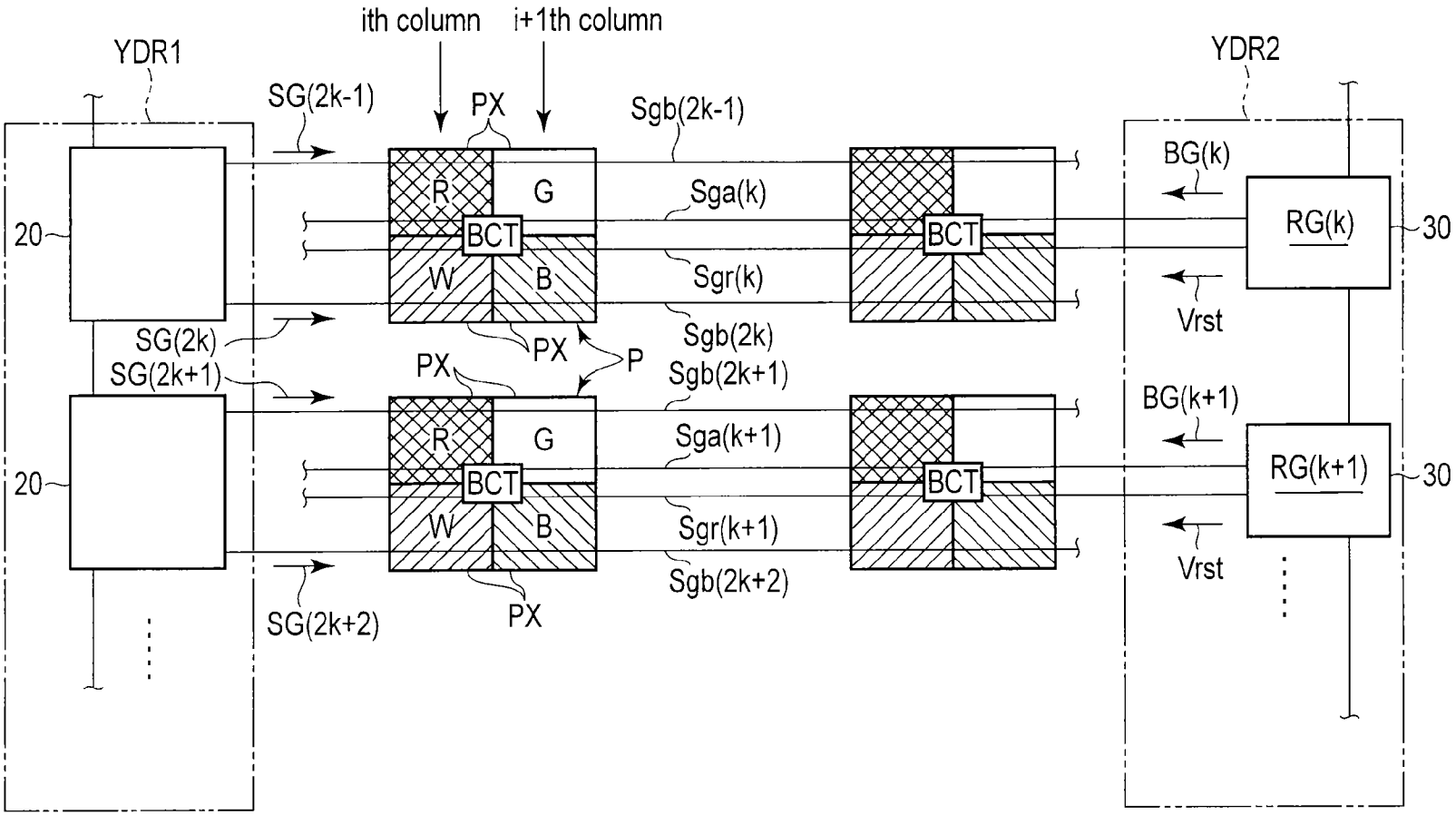
FIG. 29 is a schematic diagram showing a layout configuration of pixels in a display apparatus in Example 1 according to a fifth embodiment.
Figure 30:
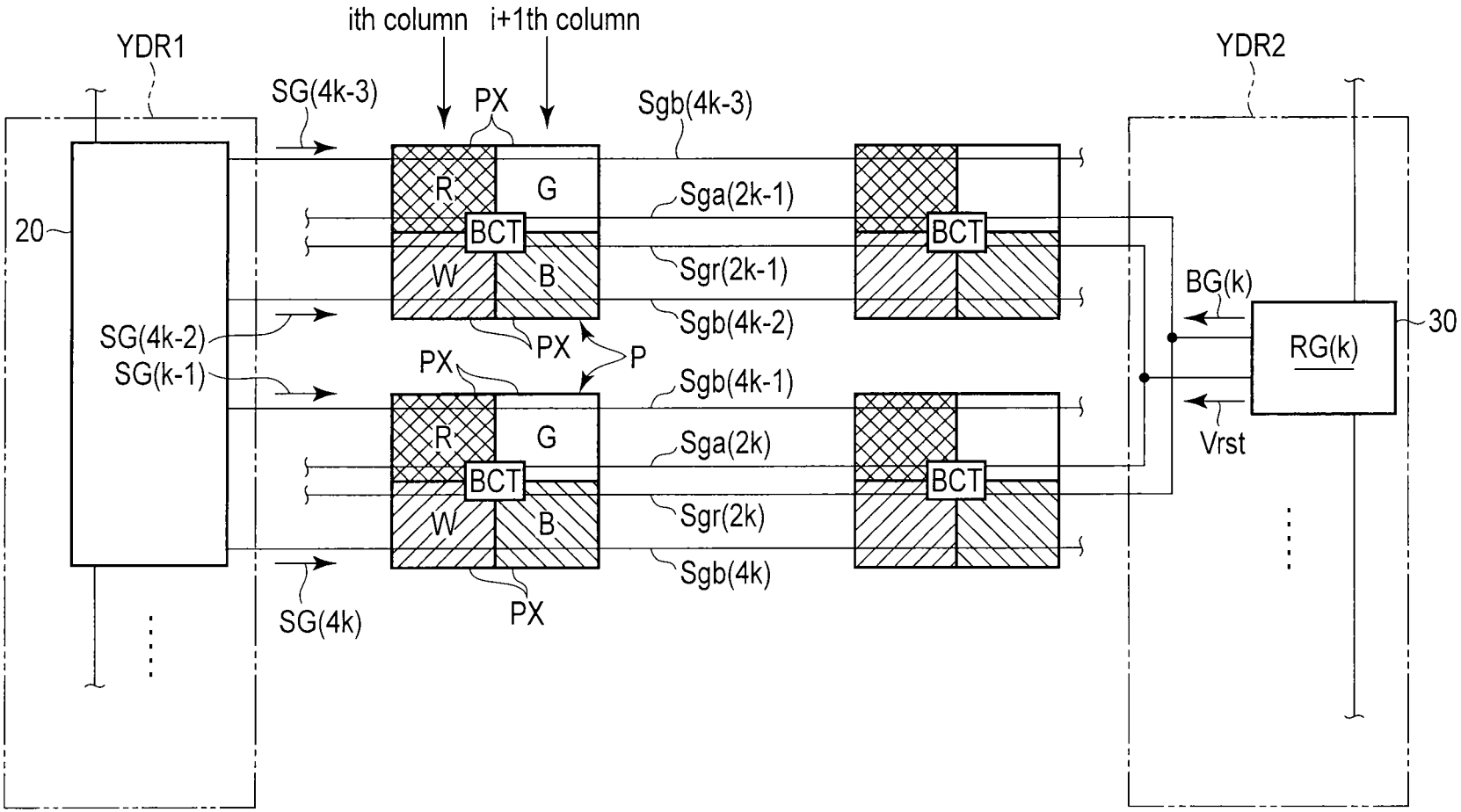
FIG. 30 is a schematic diagram showing a layout configuration of pixels in a display apparatus in Example 2 according to the fifth embodiment.
Figure 31:
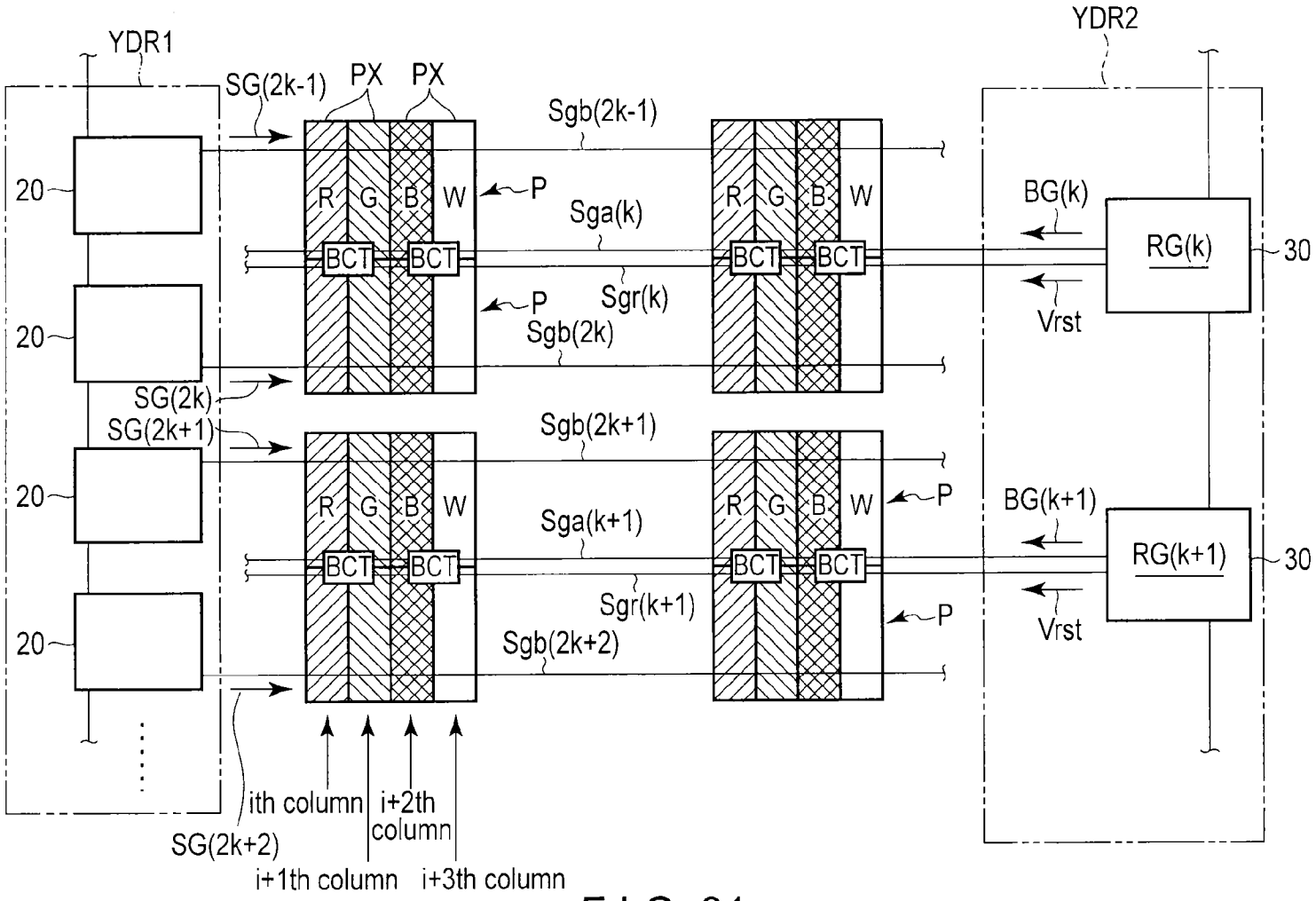
FIG. 31 is a schematic diagram showing a layout configuration of pixels in a display apparatus in Example 3 according to the fifth embodiment.
Figure 32:
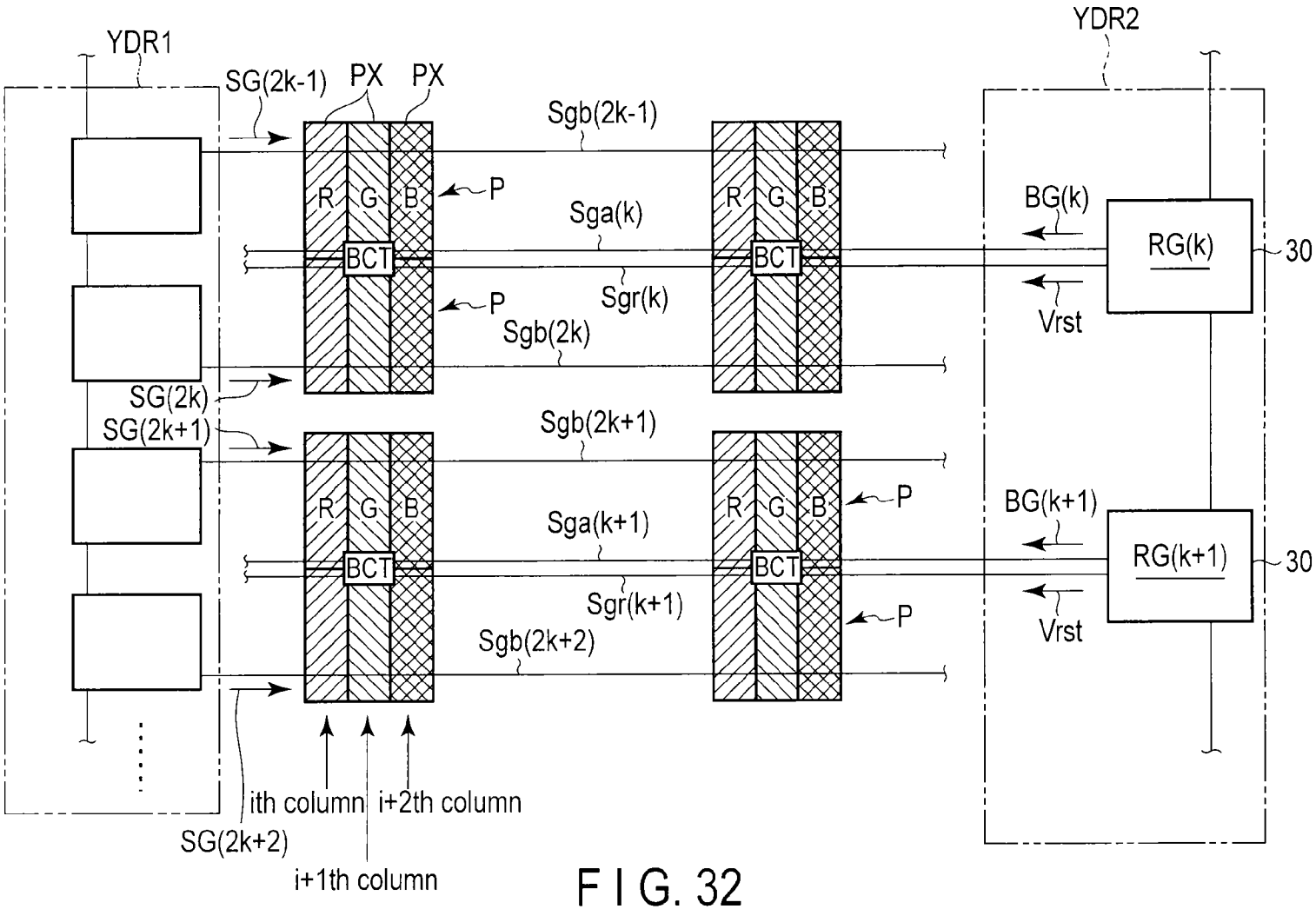
FIG. 32 is a schematic diagram showing a layout configuration of pixels in a display apparatus in Example 4 according to the fifth embodiment.

Now, a layout configuration of the plurality of pixels PX will be described. FIG. 29 is a schematic diagram showing a layout configuration of the pixels PX in Example 1 according to the fifth embodiment. FIG. 30 is a schematic diagram showing a layout configuration of the pixels PX in Example 2 according to the fifth embodiment. FIG. 31 is a schematic diagram showing a layout configuration of the pixels PX in Example 3 according to the fifth embodiment. FIG. 32 is a schematic diagram showing a layout configuration of the pixels PX in Example 4 according to the fifth embodiment.

As shown in FIG. 29, the pixels PX are so called RGBW square pixels. The plurality of pixels PX comprises a first pixel, a second pixel adjacent to the first pixel in the column direction Y, a third pixel adjacent to the first pixel in the row direction X, and a fourth pixel adjacent to the second pixel in the row direction X and to the third pixel in the column direction Y. The first to fourth pixels are a pixel PX configured to display a red image, a pixel PX configured to display a green image, a pixel PX configured to display a blue image, and a pixel PX configured to display a white (achromatic) image. A picture element P comprises the first to fourth pixels.

For example, any two of the red pixel PX, the green pixel PX, the blue pixel PX, and the white pixel PX are arranged in each even-numbered row. The remaining two pixels are arranged in each odd-numbered row. In Example 1, the red pixel PX and the green pixel PX are arranged in each odd numbered row, and the white pixel PX and the blue pixel PX are arranged in each even numbered row. The output switch BCT is shared by the first to fourth pixels.

In this case, the output switch BCT is shared by the pixels in the 2 k−1th row and the 2 kth row and by the pixels in the 2 k+1th row and the 2 k+2th row. Thus, each of the numbers of first scanning lines Sga and reset lines Sgr is m/2.

An output section 30 in the kth stage is connected to the kth first scanning line Sga and the kth reset line Sgr. Thus, the number of the output sections 30 is m/2. An output section 20 in the kth stage connects to the 2 k−1th second scanning line Sgb (in the 2 k−1th row) and the 2 kth second scanning line Sgb (in the 2 kth row). Since the output section 20 is connected to two second scanning lines Sgb, the number of the output sections 20 is m/2.

As shown in FIG. 30, the output section 30 in the kth stage is connected to the 2 k−1th and 2 kth first scanning lines Sga and to the 2 k−1th and 2 kth reset lines Sgr. Thus, the number of the output sections 30 is m/4.

The output section 20 in the kth stage connects to the 4 k−3th second scanning line (in the 4 k−3th row), the 4 k−2th second scanning line (in the 4 k−2th row), the 4 k−1th second scanning line (in the 4 k−1th row), and the 4 kth second scanning line (in the 4 kth row). Since the output section 20 is connected to four second scanning lines Sgb, the number of the output sections 20 is m/4.

As shown in FIG. 31, the pixela PX are so called vertical stripe pixels. In the row direction X, a red pixel PX, a green pixel PX, a blue pixel PX, and a white pixel are alternately arranged. In the column direction Y, pixels PX configured to display images in the same color are arranged.

The red (R) pixel PX, the green (G) pixel PX, the blue (B) pixel PX, and the white (W) pixel PX form a picture element P. In Example 3, the picture element P comprises four (four color) pixels PX.

The output switch BCT is shared by four adjacent pixels (two pixels adjacent to each other in the column direction Y and two pixels adjacent to each other in the row direction) PX. Thus, each of the numbers of the first scanning lines Sga and third scanning lines Sgc is m/2.

As shown in FIG. 32, the pixels PX are so called vertical stripe pixels. In the row direction X, a red pixel PX, a green pixel PX, and a blue pixel PX are alternately arranged. In the column direction Y, pixels PX configured to display images in the same color are arranged.

The red (R) pixel PX, the green (G) pixel PX, and the blue (B) pixel PX form a picture element P. In Example 3, the picture element P comprises three (three color) pixels PX.

The output switch BCT is shared by six adjacent pixels (two pixels adjacent to each other in the column direction Y and three pixels adjacent to one another in the row direction) PX. Thus, each of the numbers of the first scanning lines Sga and the third scanning lines Sgc is m/2.

Figure 33:
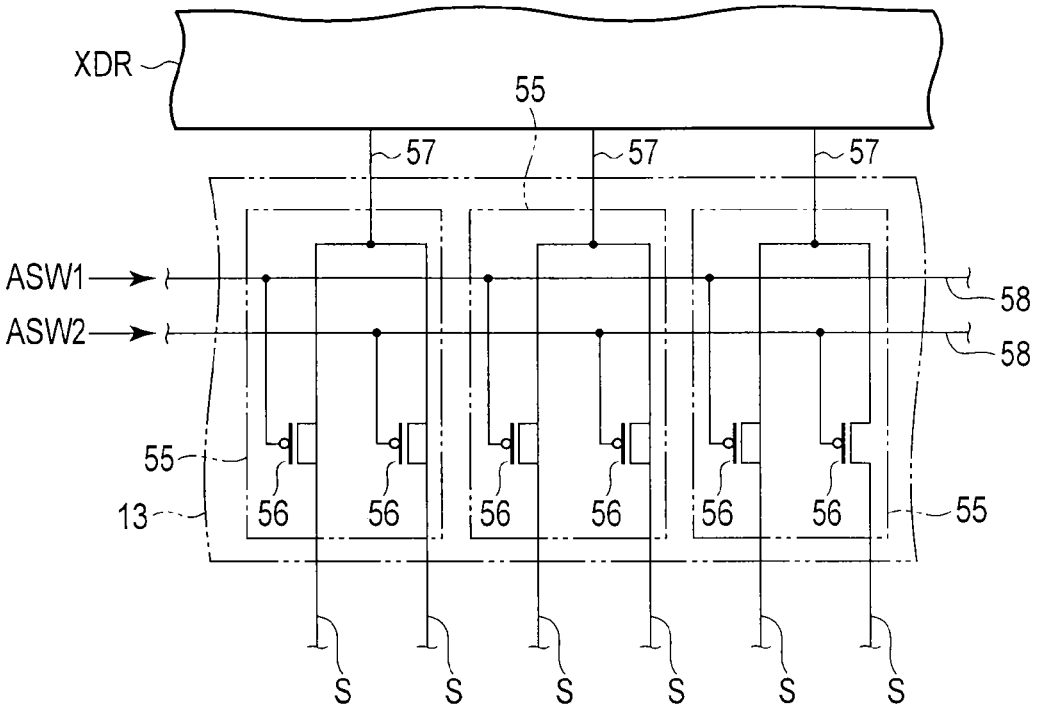
FIG. 33 is an enlarged plan view showing a non-display area of the display apparatus in Example 3 according to the fifth embodiment and is also a circuit diagram showing a switching circuit.
Figure 34:
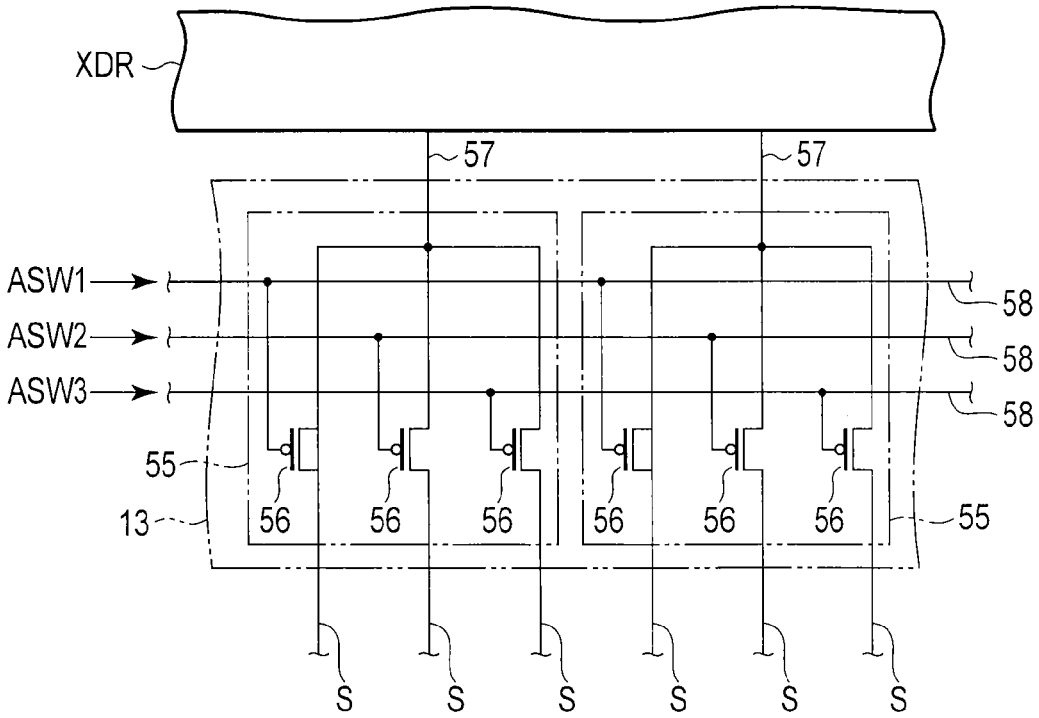
FIG. 34 is an enlarged plan view showing a non-display area of the display apparatus in Example 4 according to the fifth embodiment and is also a circuit diagram showing a switching circuit.

Now, a switching circuit will be described. The display apparatus further comprises the switching circuit. According to the fifth embodiment, the display apparatuses in Examples 3 and 4 further comprise the switching circuit. The display apparatuses in Examples 1 and 2 do not comprise the switching circuit. FIG. 33 is an enlarged plan view showing a non-display area R2 of the display apparatus in Example 3 and showing a switching circuit 13. FIG. 34 is an enlarged plan view showing the non-display area R2 of the display apparatus in Example 4 and showing the switching circuit 13.

As shown in FIG. 33, in Example 3, the switching circuit 13 comprises a plurality of switching element groups 55. Each of the switching element groups 55 comprises a plurality of switching elements 56. Each of the switching element groups 55 comprises two switching elements 56. The switching circuit 13 is a ½ multiplexer circuit. The switching element 56 comprises, for example, a p-channel TFT but may comprise an n-channel TFT.

The switching circuit 13 is connected to a plurality of video signal lines VL. Furthermore, the switching circuit 13 is connected to a signal line driving circuit XDR via a connection line 57. The number of the connection lines 57 is half the number of the video signal lines VL.

The switching element 56 is switched on and off in accordance with control signals ASW1 and ASW2 so that time-sharing drive of two video signal lines VL per output (connection line 57) of the signal line driving circuit XDR. The control signals ASW1 and ASW2 are applied to each of the switching elements 56 via a plurality of control lines 58. During j horizontal scanning periods, the control signals ASW1 and ASW2 for the on state are applied to the switching element 56 a plurality of times at predetermined timings to write an initialization signal Vini and a desired video signal Vsig to a corresponding one of pixels PX arranged in a row direction X. In this case, the reference character j denotes a natural number of 2 or more.

As shown in FIG. 34, in Example 4, each of the switching element groups 55 comprises three switching elements 56. The switching circuit 13 is a ⅓ multiplexer circuit. The number of the connection lines 57 is one-third of the number of the video signal lines VL.

The switching element 56 is switched on and off in accordance with control signals ASW1 to ASW3 so that time-sharing drive of three video signal lines VL per output (connection line 57) of the signal line driving circuit XDR. The control signals ASW1 to ASW3 are applied to each of the switching elements 56 via a plurality of the control lines 58. During j horizontal scanning periods, the control signals ASW1 to ASW3 for the on state are applied to the switching element 56 a plurality of times at predetermined timings to write the initialization signal Vini and the desired video signal Vsig to a corresponding one of the pixels PX arranged in the row direction X. In this case, the reference character j denotes a natural number of 2 or more. The switching circuit 13 in Example 4 is otherwise formed similarly to the switching circuit 13 in Example 3, described above.

Figure 35:
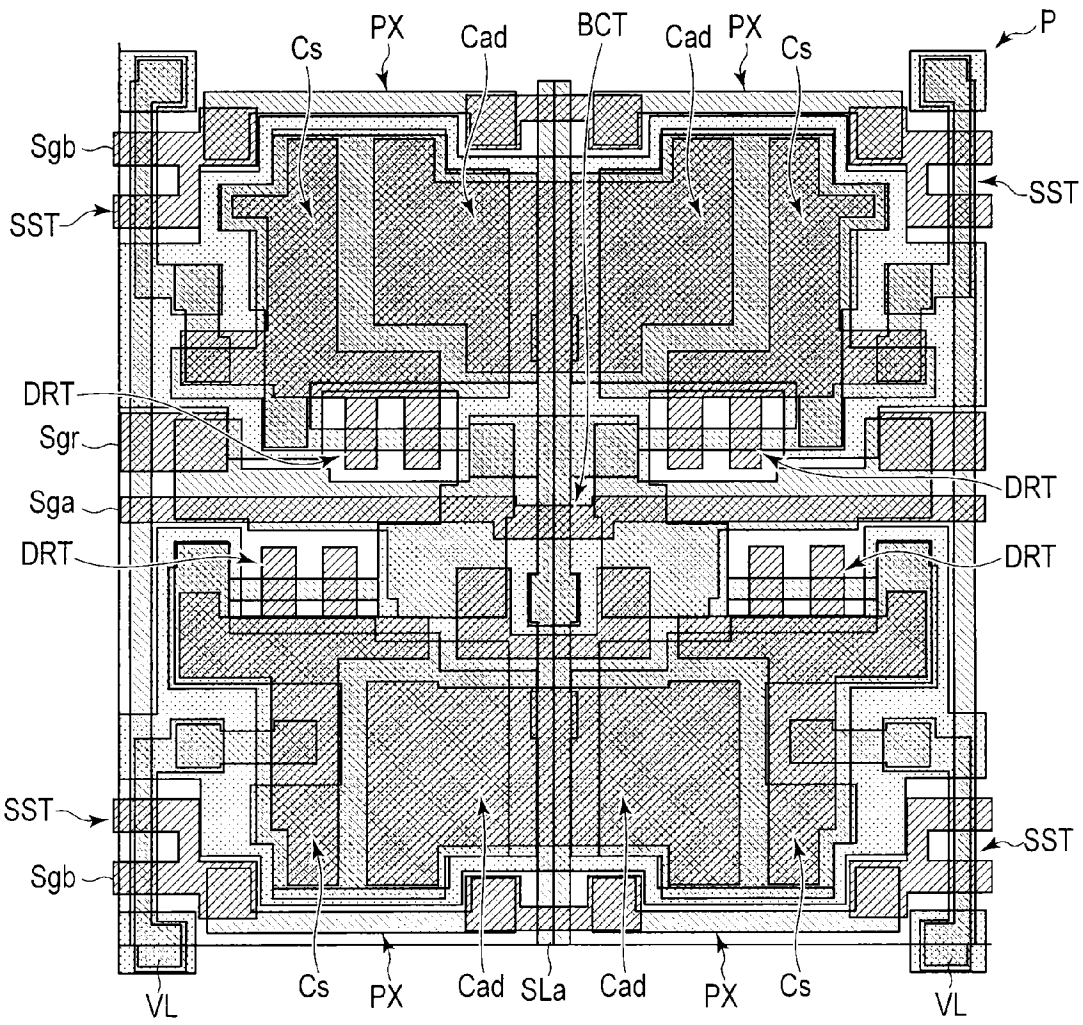
FIG. 35 is a plan view showing the pixel in the display apparatuses in Examples 1 and 2 according to the fifth embodiment.

Now, the planar structure of the pixels PX according to the fifth embodiment. In this case, RGBW square configuration pixels will be described as a typical example. FIG. 35 is a plan view showing the pixels PX in the display apparatuses in Examples 1 and 2 according to the fifth embodiment.

As shown in FIG. 35, the output switch BCT is shared by four pixels PX (one picture element). For efficient arrangement of elements in a pixel circuit, the four pixels PX sharing the output switch BCT are arranged such that driving transistors DRT, pixel switches SST, the video signal lines VL, storage capacitances Cs, additional capacitances Cad, and the second scanning lines Sgb are approximately symmetric with respect to the output switch BCT in the column direction and the row direction.

The terms "pixel PX" and "picture element P" have been used to describe the fifth embodiment. However, the pixel may be replaced with a term "sub-pixel". In this case, the picture element corresponds to a pixel.

The arrangement of the picture elements P (pixels PX) is not limited to the example in FIG. 35 but may be variously modified. For example, two pixels PX adjacent to each other in the column direction may share a contact hole. Specifically, the pixel switches SST for two pixels PX adjacent to each other in the column direction Y may share a contact hole formed in an insulating film (gate insulating film G1 and interlayer insulating film II). The two pixels PX form different picture elements P. The use of the contact hole allows the video signal line VL to be connected to a source region of a semiconductor layer in the pixel switch SST.

Now, operation of the display apparatus (organic EL display apparatus) configured as described above will be described. FIG. 36, FIG. 37, FIG. 38, and FIG. 39 are timing charts showing control signals for scanning line driving circuits YDR1 and YDR2 during display operation.

Figure 36:
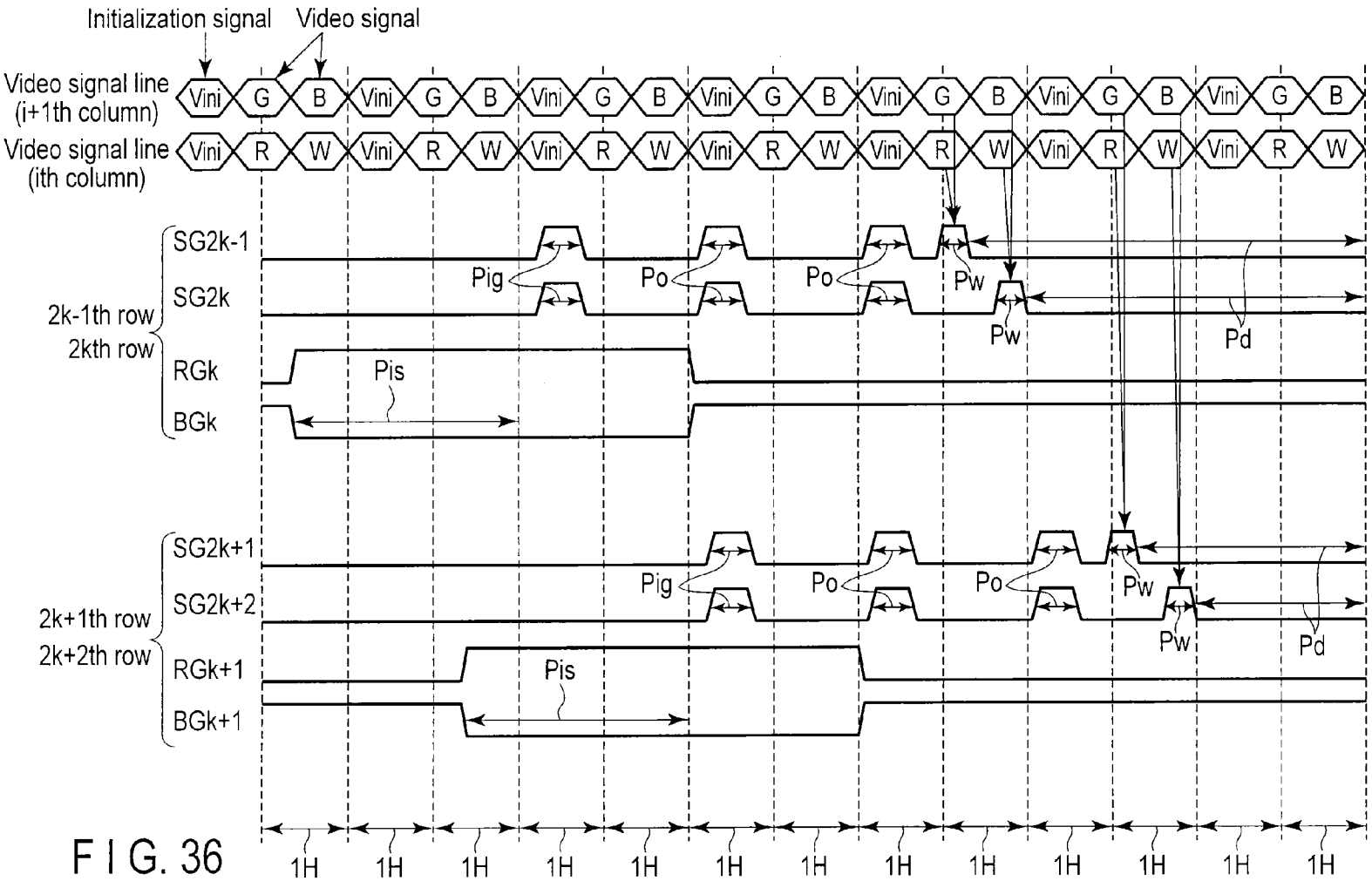
FIG. 36 is a timing chart showing control signals for a scanning line driving circuit obtained when a layout configuration of RGBW square pixels in Example 1 according to the fifth embodiment is adopted and when one initialization operation and two video signal write operations are performed during two horizontal scanning periods.
Figure 37:
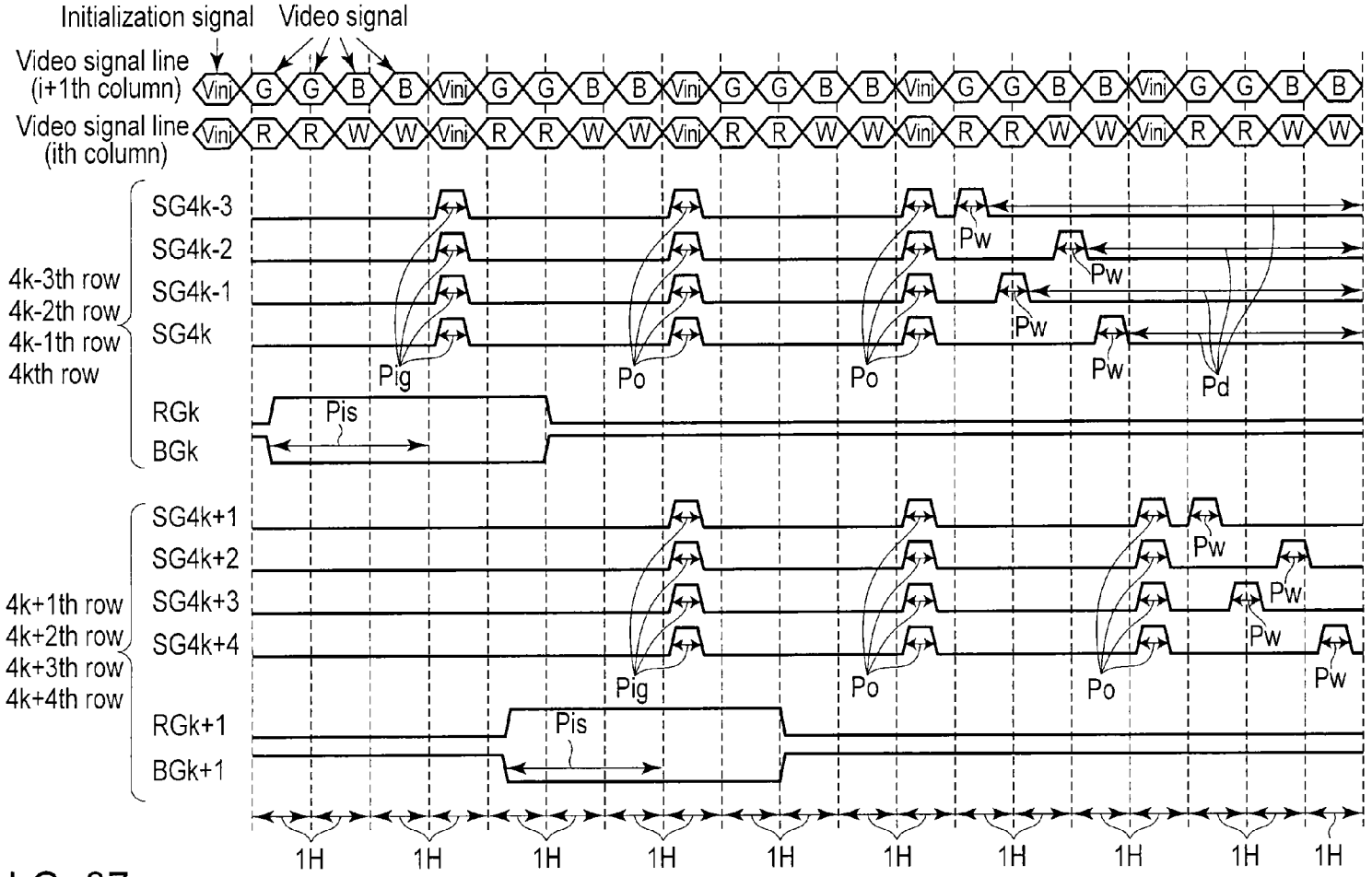
FIG. 37 is a timing chart showing control signals for the scanning line driving circuit obtained when a layout configuration of RGBW square pixels in Example 2 according to the fifth embodiment is adopted and when one initialization operation and four video signal write operations are performed during four horizontal scanning periods.

FIG. 36 is a timing chart showing control signals for the scanning line driving circuits obtained when a layout configuration of RGBW square pixels in Example 1 according to the fifth embodiment (FIG. 29) is adopted and when one initialization operation and two video signal write operations are performed during two horizontal scanning periods. FIG. 37 is a timing chart showing control signals for the scanning line driving circuits obtained when a layout configuration of RGBW square pixels in Example 2 according to the fifth embodiment (FIG. 30) is adopted and when one initialization operation and four video signal write operations are performed during four horizontal scanning periods.

Figure 38:
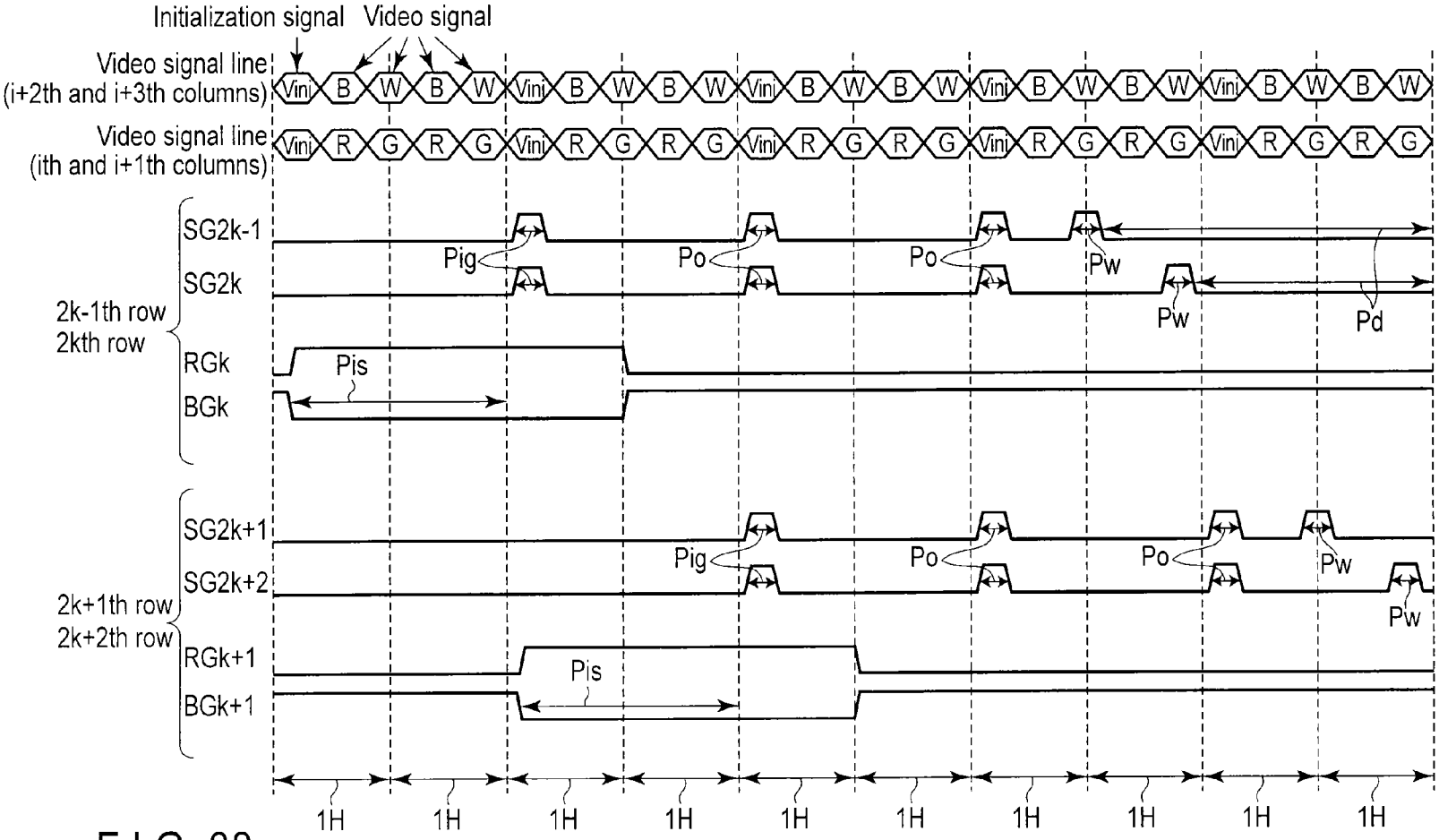
FIG. 38 is a timing chart showing control signals for the scanning line driving circuit obtained when a layout configuration of RGBW vertical-stripe pixels in Example 3 according to the fifth embodiment is adopted and when one initialization operation and four video signal write operations are performed during two horizontal scanning periods.
Figure 39:
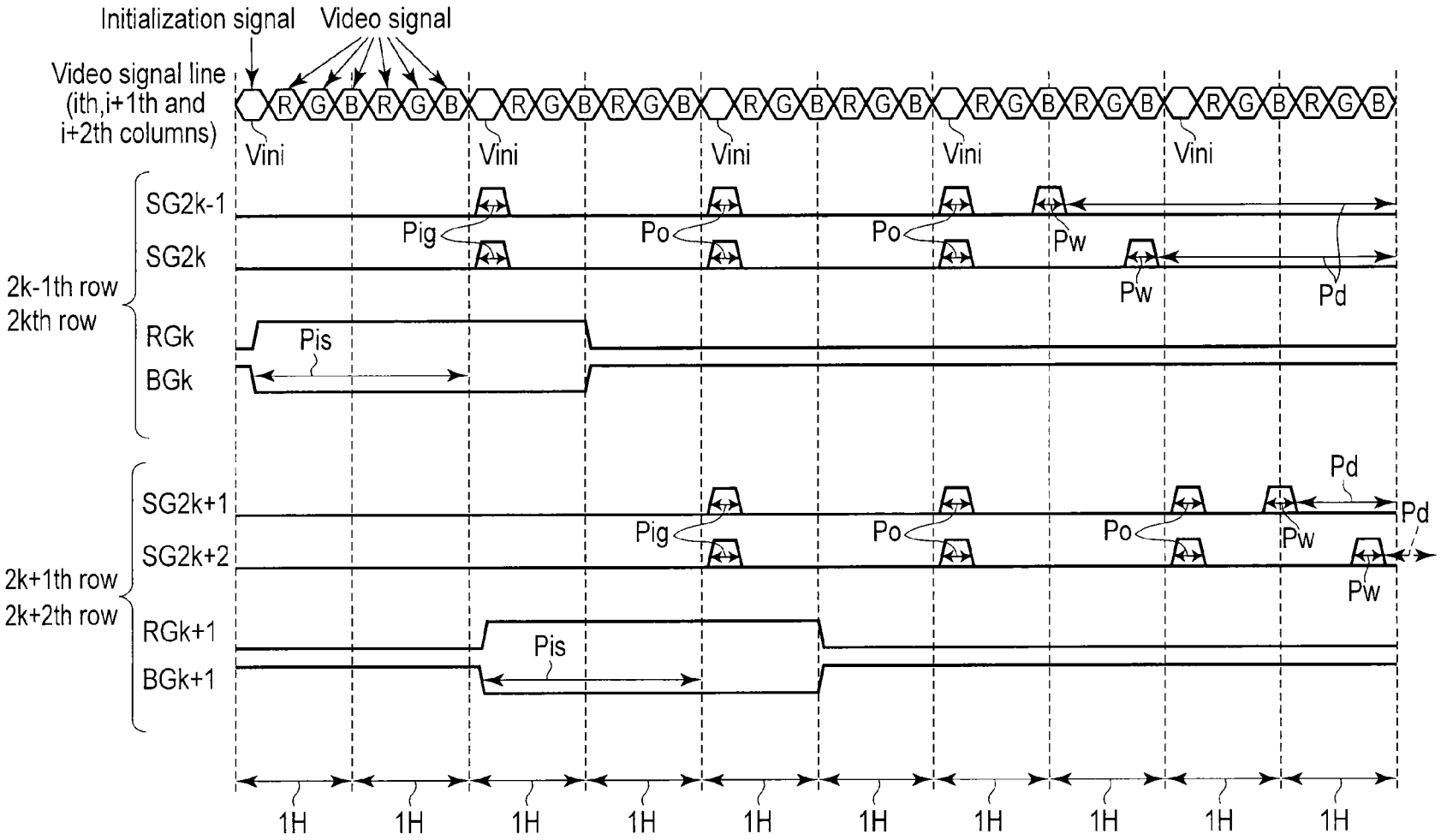
FIG. 39 is a timing chart showing control signals for the scanning line driving circuit obtained when a layout configuration of RGB vertical-stripe pixels in Example 4 according to the fifth embodiment is adopted and when one initialization operation and six video signal write operations are performed during two horizontal scanning periods.

FIG. 38 is a timing chart showing control signals for the scanning line driving circuits obtained when a layout configuration of RGBW vertical stripe pixels in Example 3 according to the fifth embodiment (FIG. 31) is adopted and when one initialization operation and four video signal write operations are performed during two horizontal scanning periods. FIG. 39 is a timing chart showing control signals for the scanning line driving circuits obtained when a layout configuration of RGB vertical stripe pixels in Example 4 according to the fifth embodiment (FIG. 32) is adopted and when one initialization operation and six video signal write operations are performed during two horizontal scanning periods.

According to a method of driving the display apparatuses in Example 1 to Example 4, two offset cancel operations are provided to allow the pixels PX to display images (emit light). However, the number of offset cancel operations is not limited to two but may be one or three or more.

Each of the scanning line driving circuits YDR1 and YDR2 generates, from a start signal and a clock, a pulse of a width equal to one horizontal scanning period corresponding to each horizontal scanning period, and outputs the pulses as control signals BG, SG, and RG. In this case, one horizontal scanning period is denoted by 1H.

The operation of the pixel circuit is divided into a source initialization operation performed during a source initialization period Pis, a gate initialization operation performed during a gate initialization period Pig, an offset cancel (OC) operation performed during an offset cancel period Po, a video signal write operation performed during a video signal write period Pw, and a display operation (light emission operation) performed during a display period Pd (light emission period).

As shown in FIG. 36 to FIG. 39, and FIG. 1 and FIG. 2, first, a driving section 10 performs a source initialization operation. During the source initialization operation, the scanning line driving circuits YDR1 and YDR2 set the control signal SG to the level at which the pixel switch SST is turned off (off potential: in this case, the low level), set the control signal BG to the level at which the output switch BCT is turned off (off potential: in this case, the low level), and set the control signal RG to the level at which a reset switch RST is turned on (on potential: in this case, the high level).

Each of the output switch BCT and the pixel switch SST is turned off (electrically discontinuous state), and the reset switch RST is turned on (electrically continuous state). Thus, a source initialization operation is started. Turning the reset switch RST on resets the potentials of a source electrode and a drain electrode of the driving transistor DRT equal to the potential (reset potential Vrst) of a reset power supply. Then, the source initialization operation is completed. In this case, the reset power supply (reset potential Vrst) is set to, for example, −2 V.

Then, the driving section 10 performs a gate initialization operation. During the gate initialization operation, the scanning line driving circuits YDR1 and YDR2 set the control signal SG to the level at which the pixel switch SST is turned on (on potential: in this case, the high level), set the control signal BG to the level at which the output switch BCT is turned off, and set the control signal RG to the level at which the reset switch RST is turned on. The output switch BCT is turned off, and the pixel switch SST and the reset switch RST are turned off. Thus, a gate initialization operation is started.

During the gate initialization operation Pig, an initialization signal Vini (initialization voltage) output through the video signal line VL is applied to a gate electrode of the driving transistor DRT through the pixel switch SST. Thus, the potential of the gate electrode of the driving transistor DRT is reset to a value corresponding to the initialization signal Vini to initialize information in the preceding frame. The voltage level of the initialization signal Vini is set to, for example, 2 V.

In the display apparatus comprising the switching circuit 13, all the switching elements 56 are switched on in accordance with the control signals (ASW1, ASW2, and ASW3) during the gate initialization period Pig. Thus, the initialization signal Vini is applied to all the video signal lines VL.

Subsequently, the driving section 10 performs an offset cancel operation. The control signal SG is set to the on potential, the control signal BG is set to the on potential (high level), and the control signal RG is set to the off potential (low level). Thus, the reset switch RST is turned off, and the pixel switch SST and the output switch BCT are turned on. An offset cancel operation for a threshold is started.

During the offset cancel period Po, the initialization signal Vini is applied to the gate electrode of the driving transistor DRT through the video signal line VL and the pixel switch SST. The potential of the gate electrode of the driving transistor DRT is fixed. Even during the offset cancel period Po, all the switching elements 56 in the display apparatus comprising the switching circuit 13 are switched on.

Furthermore, the output switch BCT is in the on state, so that a current flows into the driving transistor DRT through the high-potential power supply line SLa. The potential of the source electrode of the driving transistor DRT has an initial value equal to the potential (reset potential Vrst) written during the source initialization period Pis. While gradually reducing a current flowing into the driving transistor DRT through between the drain electrode and the source electrode of the driving transistor DRT, the potential of the source electrode of the driving transistor DRT shifts toward higher potentials while absorbing and compensating for a variation in the TFT property of the driving transistor DRT. According to the first embodiment, the offset cancel period Po is set to a time of, for example, 1 μsec.

At the end of the offset cancel period Po, the potential of the source electrode of the driving transistor DRT is Vini−Vth. The voltage value of the initialization signal Vini is denoted by Vini, and the threshold voltage of the driving transistor DRT is denoted by Vth. Thus, the voltage between the gate electrode and the source electrode of the driving transistor DRT reaches a cancel point (Vgs=Vth). A potential difference corresponding to the cancel point is stored (held) in the storage capacitance Cs. As in examples illustrated in FIG. 36 and FIG. 39, two offset cancel periods Po can be provided as necessary.

Subsequently, during the video signal write period Pw, the control signal SG is set to a level at which the pixel switch SST is turned on. The control signal BG is set to a level at which the output switch BCT is turned on. The control signal RG is set to a level at which the reset switch RST is turned off. Then, the pixel switch SST and the output switch BCT are turned on, and the reset switch RST is turned off. A video signal write operation is started.

During the video signal write period Pw, the video signal Vsig from the video signal line VL is written to the gate electrode of the driving transistor DRT through the pixel switch SST. Furthermore, a current from the high-potential power supply line SLa flows to the driving transistor DRT via the output switch BCT. Immediately after the pixel switch SST is turned on, the potential of the gate electrode of the driving transistor DRT is Vsig (R, G, B, W), and the potential of the source electrode of the driving transistor is Vini−Vth+Cs(Vsig−Vini)/(Cs+Cel+Cad).

The voltage value of the video signal Vsig is denoted by Vsig, the capacity of the storage capacitance Cs is denoted by Cs, the capacity of a capacitance section Cel is denoted by Cel, and the capacity of the additional capacitance Cad is denoted by Cad.

Subsequently, a current flows to the low-potential power supply line SLb via the capacitance section Cel of a diode OLED. At the end of the video signal write period Pw, the potential of the gate electrode of the driving transistor DRT is Vsig (R, G, B, W), and the potential of the source electrode of the driving transistor DRT is Vini−Vth+ΔV1+Cs(Vsig−Vini)/(Cs+Cel+Cad). The relation between a current Idrt flowing through the driving transistor DRT and the capacitance Cs+Cel+Cad is expressed by the formula described above (Formula 1). Thus, a variation in the mobility in the driving transistor DRT is corrected.

In the display apparatus comprising the switching circuit 13, the switching elements 56 of each of the switching element groups 55 are switched on in order in accordance with the control signals (ASW1, ASW2, and ASW3) during the video signal write period Pw. Driving the video signal lines VL in a time division manner allows all the video signal lines VL to be provided with the video signal Vsig in order.

Finally, during the display period Pd, the control signal SG is set to the level at which the pixel switch SST is turned off. The control signal BG is set to the level at which the output switch BCT is turned on. The control signal RG is set to the level at which the reset switch RST is turned off. Then, the output switch BCT is turned on, and the pixel switch SST and the reset switch RST are turned off. A display operation is started.

The driving transistor DRT outputs a driving current Iel of a current amount corresponding to the gate control voltage written to the storage capacitance Cs. The driving current Iel is supplied to the diode OLED. Thus, the diode OLED emits light at a luminance according to the driving current Iel to perform a display operation. The diode OLED maintains the light emission state until, after one frame period, the control signal BG is set to the off potential again.

The above-described source initialization operation, gate initialization operation, offset cancel operation, video signal write operation, and display operation are sequentially and repetitively performed on each pixel PX to display the desired image.

Now, an operation of writing the initialization signal and the video signal in the methods of driving the display apparatus in Example 1 to Example 4 will be described.

The operation of writing the initialization signal and the video signal in the method of driving the display apparatus in Example 1 will be described.

As shown in FIG. 1, FIG. 2, FIG. 29, and FIG. 36, a method of driving one picture element P in the display apparatus in Example 1 is focused on. In this case, the one picture element P comprises four pixels positioned in the 2 k−1th and the 2 kth rows and in the ith and i+1th columns. The method of driving performs one initialization operation and then two video signal write operations, during two horizontal scanning periods. Although not described, a plurality of picture elements P arranged in the row direction X is similarly driven during the two horizontal scanning periods.

First, during the initialization operation, the signal line driving circuit XDR applies the initialization signal Vini to the video signal lines VL in the ith and i+1th columns. The scanning line driving circuit YDR1 applies the control signal SG at the level at which the pixel switch SST is turned on, to the second scanning lines Sgb in the 2 k−1th and 2 kth rows.

Then, the signal line driving circuit XDR applies the video signal Vsig for red display to the video signal line VL in the ith column. The signal line driving circuit XDR applies the video signal Vsig for green display to the video signal line VL in the i+1th column. The scanning line driving circuit YDR1 applies the control signal SG at the level at which the pixel switch SST is turned on, to the second scanning line Sgb in the 2 k−1th row. The scanning line driving circuit YDR1 applies the control signal SG at the level at which the pixel switch SST is turned off, to the second scanning line Sgb in the 2 kth row.

Subsequently, the signal line driving circuit XDR applies the video signal Vsig for white display to the video signal line VL in the ith column. The signal line driving circuit XDR applies the video signal Vsig for blue display to the video signal line VL in the i+1th column. The scanning line driving circuit YDR1 applies the control signal SG at the level at which the pixel switch SST is turned off, to the second scanning line Sgb in the 2 k−1th row. The scanning line driving circuit YDR1 applies the control signal SG at the level at which the pixel switch SST is turned on, to the second scanning line Sgb in the 2 kth row.

Adopting the above-described method of driving the display apparatus enables contiguous pixels PX of two rows to be provided with the initialization signal Vini at a time. This allows the number of initialization operations during two horizontal scanning periods to be reduced to one.

The operation of writing the initialization signal and the video signal in the method of driving the display apparatus in Example 2 will be described.

As shown in FIG. 1, FIG. 2, FIG. 30, and FIG. 37, a method of driving two picture elements P in the display apparatus in Example 2 is focused on. In this case, the two picture elements P comprise eight pixels positioned in the 4 k−3th, 4*k*−2th, 4*k*−1th, and 4 kth rows and in the ith and i+1th columns. The method of driving performs one initialization operation and then four video signal write operations, during four horizontal scanning periods. Although not described, a plurality of picture elements P arranged in the row direction X is similarly driven during the four horizontal scanning periods.

First, during the initialization operation, the signal line driving circuit XDR applies the initialization signal Vini to the video signal lines VL in the ith and i+1th columns. The scanning line driving circuit YDR1 applies the control signal SG at the level at which the pixel switch SST is turned on, to the second scanning lines Sgb in the 4 k−3th, 4 k−2th, 4 k−1, and 4 kth rows.

Then, the signal line driving circuit XDR applies the video signal Vsig for red display to the video signal line VL in the ith column. The signal line driving circuit XDR applies the video signal Vsig for green display to the video signal line VL in the i+1th column. The scanning line driving circuit YDR1 applies the control signal SG at the level at which the pixel switch SST is turned on, to the second scanning line Sgb in the 4 k−3th row. The scanning line driving circuit YDR1 applies the control signal SG at the level at which the pixel switch SST is turned off, to the second scanning lines Sgb in the 4 k−2th, 4 k−1th, and 4 kth rows.

Subsequently, the signal line driving circuit XDR applies the video signal Vsig for red display to the video signal line VL in the ith column. The signal line driving circuit XDR applies the video signal Vsig for green display to the video signal line VL in the i+1th column. The scanning line driving circuit YDR1 applies the control signal SG at the level at which the pixel switch SST is turned on, to the second scanning line Sgb in the 4 k−1th row. The scanning line driving circuit YDR1 applies the control signal SG at the level at which the pixel switch SST is turned off, to the second scanning lines Sgb in the 4 k−3th, 4 k−2th, and 4 kth rows.

Then, the signal line driving circuit XDR applies the video signal Vsig for white display to the video signal line VL in the ith column. The signal line driving circuit XDR applies the video signal Vsig for blue display to the video signal line VL in the i+1th column. The scanning line driving circuit YDR1 applies the control signal SG at the level at which the pixel switch SST is turned on, to the second scanning line Sgb in the 4 k−2th row. The scanning line driving circuit YDR1 applies the control signal SG at the level at which the pixel switch SST is turned off, to the second scanning lines Sgb in the 4 k−3th, 4 k−1th, and 4 kth rows.

Subsequently, the signal line driving circuit XDR applies the video signal Vsig for white display to the video signal line VL in the ith column. The signal line driving circuit XDR applies the video signal Vsig for blue display to the video signal line VL in the i+1th column. The scanning line driving circuit YDR1 applies the control signal SG at the level at which the pixel switch SST is turned on, to the second scanning line Sgb in the 4 kth row. The scanning line driving circuit YDR1 applies the control signal SG at the level at which the pixel switch SST is turned off, to the second scanning lines Sgb in the 4 k−3th, 4 k−2th, and 4 k−1th rows.

Adopting the above-described method of driving the display apparatus enables contiguous pixels PX of four rows to be provided with the initialization signal Vini at a time. This allows the number of initialization operations during four horizontal scanning periods to be reduced to one. Furthermore, when the video signals Vsig are sequentially provided, a plurality of pixels PX displaying images in the same color can be continuously provided with the video signal Vsig.

The operation of writing the initialization signal and the video signal in the method of driving the display apparatus in Example 3 will be described.

As shown in FIG. 1, FIG. 2, FIG. 31, FIG. 33, and FIG. 38, a method of driving two picture elements P in the display apparatus in Example 3 is focused on. In this case, the two picture elements P comprise eight pixels positioned in the 2 k−1th and 2 kth rows and in the ith, i+1th, i+2th, and i+3th columns. The method of driving performs one initialization operation and then four video signal write operations, during two horizontal scanning periods. Although not described, a plurality of picture elements P arranged in the row direction X is similarly driven during the two horizontal scanning periods.

First, during the initialization operation, the control signals ASW1 and ASW2 for the on state are applied to the switching elements 56 to switch on all the switching elements 56 connected to the video signal lines VL in the ith, i+1th, i+2th, and i+3th columns. The signal line driving circuit XDR applies the initialization signal Vini to the video signal lines VL in the ith, i+1th, i+2th, and i+3th columns. The scanning line driving circuit YDR1 applies the control signal SG at the level at which the pixel switch SST is turned on, to the second scanning lines Sgb in the 2 k−1th and 2 kth rows.

Then, the control signal ASW1 for the on state and the control signal ASW2 for the off state are applied to the switching elements 56 to switch on the switching elements 56 connected to the video signal lines in the VL ith and i+2th columns, while switching off the switching elements 56 connected to the video signal lines VL in the i+1th and i+3th columns. The signal line driving circuit XDR applies the video signal Vsig for red display to the video signal line VL in the ith column. The signal line driving circuit XDR applies the video signal Vsig for blue display to the video signal line VL in the i+2th column. The scanning line driving circuit YDR1 applies the control signal SG at the level at which the pixel switch SST is turned on, to the second scanning line Sgb in the 2 k−1th row. The scanning line driving circuit YDR1 applies the control signal SG at the level at which the pixel switch SST is turned off, to the second scanning line Sgb in the 2 kth row.

Subsequently, the control signal ASW1 for the off state and the control signal ASW2 for the on state are applied to the switching elements 56 to switch on the switching elements 56 connected to the video signal lines VL in the i+1th and i+3th columns, while switching off the switching elements 56 connected to the video signal lines VL in the ith and i+2th columns. The signal line driving circuit XDR applies the video signal Vsig for green display to the video signal line VL in the i+1th column. The signal line driving circuit XDR applies the video signal Vsig for white display to the video signal line VL in the i+3th column. The scanning line driving circuit YDR1 applies the control signal SG at the level at which the pixel switch SST is turned on, to the second scanning line Sgb in the 2 k−1th row. The scanning line driving circuit YDR1 applies the control signal SG at the level at which the pixel switch SST is turned off, to the second scanning line Sgb in the 2 kth row.

Then, the control signal ASW1 for the on state and the control signal ASW2 for the off state are applied to the switching elements 56 to switch on the switching elements 56 connected to the video signal lines VL in the ith and i+2th columns, while switching off the switching elements 56 connected to the video signal lines VL in the i+1th and i+3th columns. The signal line driving circuit XDR applies the video signal Vsig for red display to the video signal line VL in the ith column. The signal line driving circuit XDR applies the video signal Vsig for blue display to the video signal line VL in the i+2th column. The scanning line driving circuit YDR1 applies the control signal SG at the level at which the pixel switch SST is turned off, to the second scanning line Sgb in the 2 k−1th row. The scanning line driving circuit YDR1 applies the control signal SG at the level at which the pixel switch SST is turned on, to the second scanning line Sgb in the 2 kth row.

Subsequently, the control signal ASW1 for the off state and the control signal ASW2 for the on state are applied to the switching elements 56 to switch on the switching elements 56 connected to the video signal lines VL in the i+1th and i+3th columns, while switching off the switching elements 56 connected to the video signal lines VL in the ith and i+2th columns. The signal line driving circuit XDR applies the video signal Vsig for green display to the video signal line VL in the i+1th column. The signal line driving circuit XDR applies the video signal Vsig for white display to the video signal line VL in the i+3th column. The scanning line driving circuit YDR1 applies the control signal SG at the level at which the pixel switch SST is turned off, to the second scanning line Sgb in the 2 k−1th row. The scanning line driving circuit YDR1 applies the control signal SG at the level at which the pixel switch SST is turned on, to the second scanning line Sgb in the 2 kth row.

Adopting the above-described method of driving the display apparatus enables pixels PX in two contiguous rows to be provided with the initialization signal Vini at a time, allowing the number of initialization operations during two horizontal scanning periods to be reduced to one. Furthermore, each picture element P can be driven with the voltage level of the control signal SG fixed.

The operation of writing the initialization signal and the video signal in the method of driving the display apparatus in Example 4 will be described. As shown in FIG. 1, FIG. 2, FIG. 32, FIG. 34, and FIG. 39, a method of driving two picture elements P in the display apparatus in Example 4 is focused on. In this case, the two picture elements P comprise six pixels positioned in the 2 k−1th and 2 kth rows and in the ith, i+1th, and i+2th columns. The method of driving performs one initialization operation and then six video signal write operations during two horizontal scanning periods. Although not described, a plurality of picture elements P arranged in the row direction X is similarly driven during the two horizontal scanning periods.

First, during the initialization operation, the control signals ASW1 to ASW3 for the on state are applied to the switching elements 56 to switch on all the switching elements 56 connected to the video signal lines VL in the ith, i+1th, and i+2th columns. The signal line driving circuit XDR applies the initialization signal Vini to the video signal lines VL in the ith, i+1th, and i+2th columns. The scanning line driving circuit YDR1 applies the control signal SG of the level at which the pixel switch SST is turned on, to the second scanning lines Sgb in the 2 k−1th and 2 kth rows.

Then, the control signal ASW1 for the on state and the control signals ASW2 and ASW3 for the off state are applied to the switching elements 56 to switch on the switching elements 56 connected to the video signal line VL in the ith column, while switching off the switching elements 56 connected to the video signal lines VL in the i+1th and i+2th columns. The signal line driving circuit XDR applies the video signal Vsig for red display to the video signal line VL in the ith column. The scanning line driving circuit YDR1 applies the control signal SG of the level at which the pixel switch SST is turned on, to the second scanning line Sgb in the 2 k−1th row. The scanning line driving circuit YDR1 applies the control signal SG of the level at which the pixel switch SST is turned off, to the second scanning line Sgb in the 2 kth row.

Subsequently, the control signal ASW2 for the on state and the control signals ASW1 and ASW3 for the off state are applied to the switching elements 56 to switch on the switching elements 56 connected to the video signal line VL in the i+1th column, while switching off the switching elements 56 connected to the video signal lines VL in the ith and i+2th columns. The signal line driving circuit XDR applies the video signal Vsig for green display to the video signal line VL in the i+1th column. The scanning line driving circuit YDR1 applies the control signal SG of the level at which the pixel switch SST is turned on, to the second scanning line Sgb in the 2 k−1th row. The scanning line driving circuit YDR1 applies the control signal SG of the level at which the pixel switch SST is turned off, to the second scanning line Sgb in the 2 kth row.

Subsequently, the control signal ASW3 for the on state and the control signals ASW1 and ASW2 for the off state are applied to the switching elements 56 to switch on the switching elements 56 connected to the video signal line VL in the i+2th column, while switching off the switching elements 56 connected to the video signal lines VL in the ith and i+1th columns. The signal line driving circuit XDR applies the video signal Vsig for blue display to the video signal line VL in the i+2th column. The scanning line driving circuit YDR1 applies the second scanning line Sgb in the 2 k−1th row with the control signal SG of the level at which the pixel switch SST is turned on. The scanning line driving circuit YDR1 applies the control signal SG of the level at which the pixel switch SST is turned off, to the second scanning line Sgb in the 2 kth row.

Then, the control signal ASW1 for the on state and the control signals ASW2 and ASW3 for the off state are applied to the switching elements 56 to switch on the switching elements 56 connected to the video signal line VL in the ith column, while switching off the switching elements 56 connected to the video signal lines VL in the i+1th and i+2th columns. The signal line driving circuit XDR applies the video signal Vsig for red display to the video signal line VL in the ith column. The scanning line driving circuit YDR1 applies the control signal SG of the level at which the pixel switch SST is turned off, to the second scanning line Sgb in the 2 k−1th row. The scanning line driving circuit YDR1 applies the control signal SG of the level at which the pixel switch SST is turned on, to the second scanning line Sgb in the 2 kth row.

Subsequently, the control signal ASW2 for the on state and the control signals ASW1 and ASW3 for the off state are applied to the switching elements 56 to switch on the switching elements 56 connected to the video signal line VL in the i+1th column, while switching off the switching elements 56 connected to the video signal lines VL in the ith and i+2th columns. The signal line driving circuit XDR applies the video signal Vsig for green display to the video signal line VL in the i+1th column. The scanning line driving circuit YDR1 applies the control signal SG of the level at which the pixel switch SST is turned off, to the second scanning line Sgb in the 2 k−1th row. The scanning line driving circuit YDR1 applies the control signal SG of the level at which the pixel switch SST is turned on, to the second scanning line Sgb in the 2 kth row.

Subsequently, the control signal ASW3 for the on state and the control signals ASW1 and ASW2 for the off state are applied to the switching elements 56 to switch on the switching elements 56 connected to the video signal line VL in the i+2th column, while switching off the switching elements 56 connected to the video signal lines VL in the ith and i+1th columns. The signal line driving circuit XDR applies the video signal Vsig for blue display to the video signal line VL in the i+2th column. The scanning line driving circuit YDR1 applies the control signal SG of the level at which the pixel switch SST is turned off, to the second scanning line Sgb in the 2 k−1th row. The scanning line driving circuit YDR1 applies the control signal SG of the level at which the pixel switch SST is turned on, to the second scanning line Sgb in the 2 kth row.

Adopting the above-described method of driving the display apparatus enables pixels PX in two contiguous rows to be provided with the initialization signal Vini at a time, allowing the number of initialization operations during two horizontal scanning periods to be reduced to one. Furthermore, each picture element P can be driven with the voltage level of the control signal SG fixed.

In the display apparatus and the method of driving the display apparatus according to the fifth embodiment configured as described above, the display apparatus comprises the plurality of video signal lines VL, the plurality of scanning lines (first scanning lines Sga, second scanning lines Sgb, and third scanning lines Sgc), the plurality of reset lines Sgr, and the plurality of pixels PX. Each of the pixels PX comprises the driving transistor DRT, the diode OLED, the pixel switch SST, the output switch BCT, the storage capacitance Cs, and the additional capacitance Cad.

The diode OLED is connected between the high-potential power supply line SLa and the low-potential power supply line SLb. The driving transistor DRT comprises the source electrode connected to the diode OLED, the drain electrode connected to the reset line Sgr, and the gate electrode. The output switch BCT is connected between the high-potential power supply line SLa and the drain electrode of the driving transistor DRT to switch the state between the high-potential power supply line SLa and the drain electrode of the driving transistor DRT to the electrically continuous state or the electrically discontinuous state.

The pixel switch SST is connected between the video signal line VL and the gate electrode of the driving transistor DRT to determine, in a switchable manner, whether or not to load the video signal Vsig provided through the video signal line VL onto the gate electrode side of the driving transistor. The storage capacitance Cs is connected between the source electrode and the gate electrode of the driving transistor DRT.

The method of driving the display apparatus comprises the source initialization operation, the gate initialization operation, the offset cancel operation, the video signal write operation, and the display operation (light emission operation). In Example 1, during two horizontal scanning periods, the video signals Vsig for two rows can be provided in order after the initialization signal Vini is applied to the video signal line VL. In Example 2, during four horizontal scanning periods, the video signals Vsig for four rows can be provided in order after the initialization signal Vini is applied to the video signal line VL.

In Example 3, during two horizontal scanning periods, the video signals Vsig for two rows can be provided in order after the initialization signal Vini is applied to the video signal line VL. In Example 4, during two horizontal scanning periods, the video signals Vsig for two rows can be provided in order after the initialization signal Vini is applied to the video signal line VL.

As described above, during j horizontal scanning periods, the video signals Vsig for j rows can be provided in order after the initialization signal Vini is applied to the video signal line VL. This eliminates the need to provide the initialization signal Vini for every horizontal scanning period (in units of rows). Thus, even if the definition of the display apparatus is further increased to relatively reduce each horizontal scanning period, limitations on the write of the video signal Vsig can be mitigated. For example, a sufficient write period for video signals can be ensured, or the number of times the video signal Vsig can be written can be increased.

In Example 2, when the video signals Vsig for four rows are provided in order, the video signals Vsig are consecutively applied to two pixels PX displaying images in the same color. This enables a reduction in driving frequency for the video signal line VL (the frequency the video signal Vsig). Thus, driving conditions for the video signal line VL can be eased, and power consumption can be reduced.

A number of pixels PX of the plurality of pixels PX which are adjacent to one another in the column direction share the output switch BCT. According to the fifth embodiment, four or six pixels PX share one output switch BCT.

Compared to the case where one output switch BCT is provided for each pixel PX, the fifth embodiment can reduce the number of the output switches BCT to one-quarter or one-sixth, reduce the numbers of the first scanning lines Sga, the third scanning lines Sgc, and the reset lines Sgr to half, and reduce the number of the reset switches RST to half. In Example 2, the number of the third scanning lines Sgc can be reduced to one-quarter. Thus, the display apparatus can be configured to have a slim border and to achieve a high definition.

The display apparatus and the method of driving the display apparatus according to the fifth embodiment can exert other effects similar to the corresponding effects of the display apparatus and the method of driving the display apparatus according to the first embodiment.

As described above, a method of driving a high-definition display apparatus can be obtained which allows the limitations on the write of the video signal Vsig to be mitigated. Furthermore, a display apparatus allowing the slim border can be obtained.

Now, a display apparatus and a method of driving the display apparatus according to a sixth embodiment will be described. The same functional sections of the sixth embodiment as the corresponding functional sections of the fifth embodiment are denoted by the same reference numerals and will not be described in detail. FIG. 11 and the description of FIG. 11 are applicable to the description of the sixth embodiment.

As shown FIG. 11, if the number of reset switches RST is m/4 and the number of third scanning lines Sgc is m/4, the number of reset switches RST2 is also m/4 and the number of fourth scanning lines Sgd is m/4.

The reset switch RST2 is provided, for example, every two rows in the scanning line driving circuit YDR2. Now, operation of the display apparatus (organic EL display apparatus) configured as described above will be described. FIG. 40, FIG. 41, FIG. 42, and FIG. 43 are each a timing chart showing control signals for scanning line driving circuits YDR1 and YDR2 during display operation.

Figure 40:
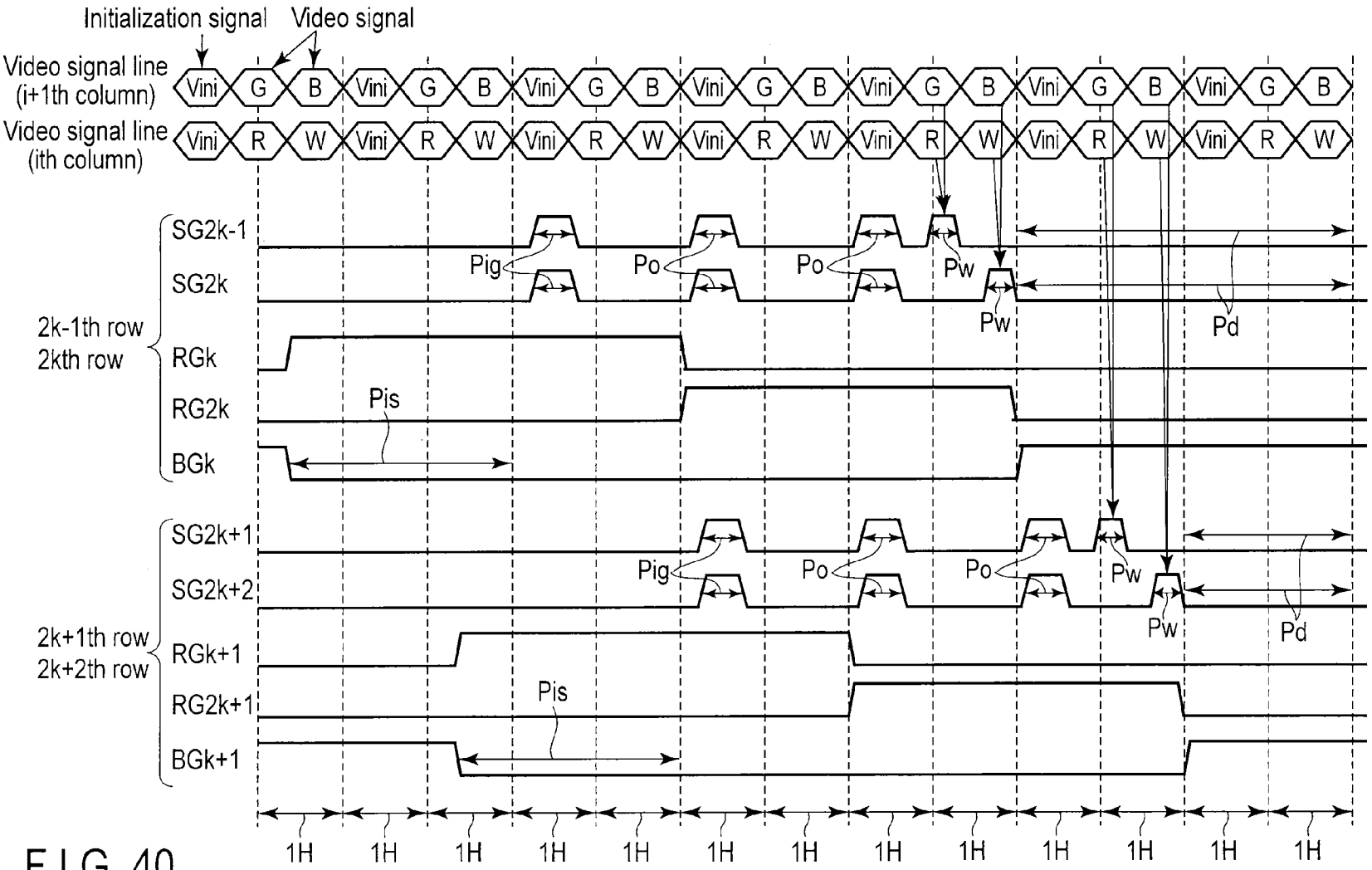
FIG. 40 is a timing chart showing control signals for a scanning line driving circuit obtained when a layout configuration of RGBW square pixels in Example 1 according to a sixth embodiment is adopted and when one initialization operation and two video signal write operations are performed during two horizontal scanning periods.

FIG. 40 is a timing chart showing control signals for the scanning line driving circuit obtained when a layout configuration of RGBW square pixels in Example 1 according to the sixth embodiment is adopted and when one initialization operation and two video signal write operations are performed during two horizontal scanning periods. The display apparatus in Example 1 according to the sixth embodiment corresponds to the display apparatus in Example 1 according to the fifth embodiment additionally provided with the reset switch RST2, the fourth scanning line Sgd, and the reset power supply line SLd.

Figure 41:
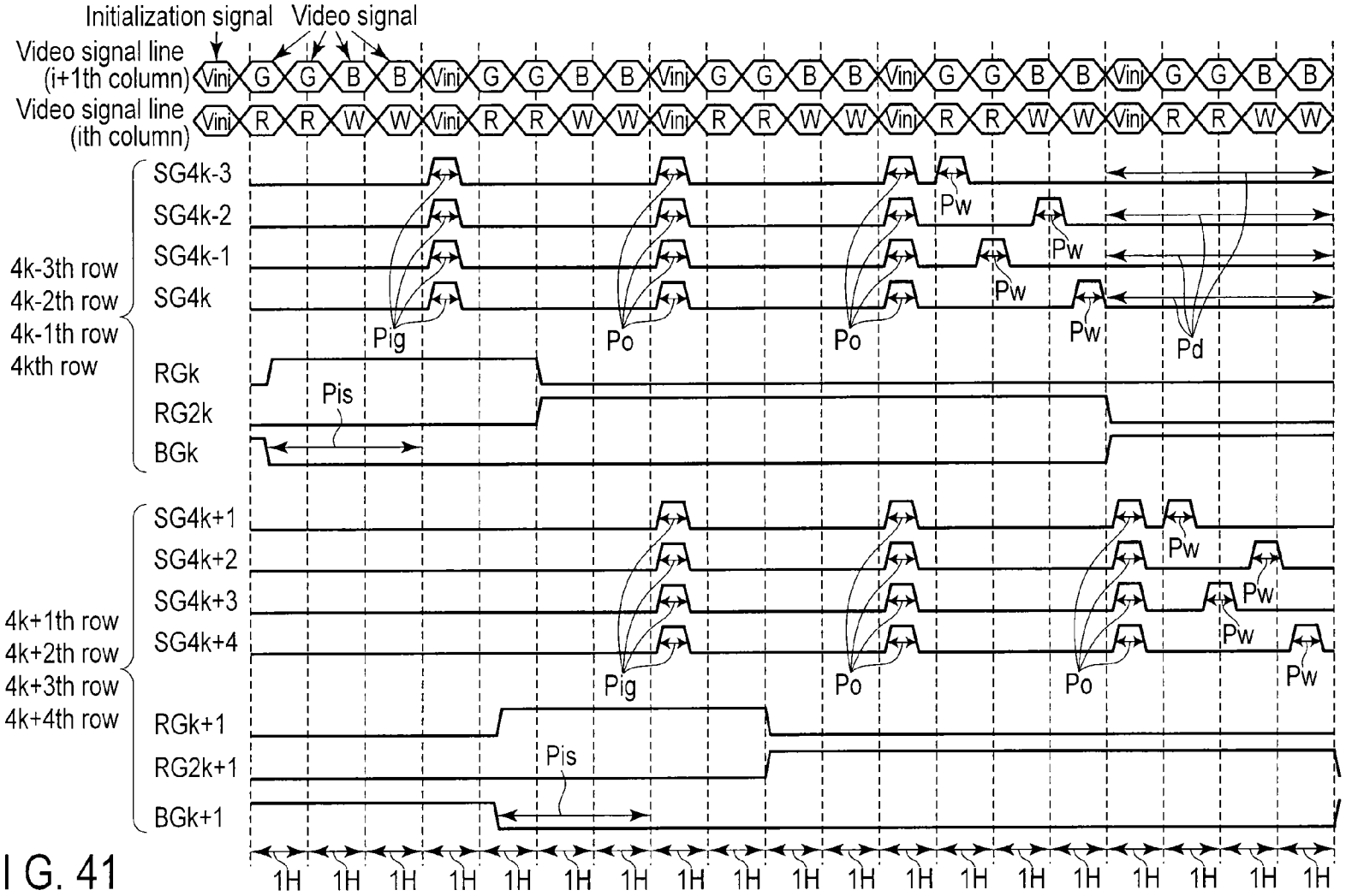
FIG. 41 is a timing chart showing control signals for the scanning line driving circuit obtained when a layout configuration of RGBW square pixels in Example 2 according to the sixth embodiment is adopted and when one initialization operation and four video signal write operations are performed during four horizontal scanning periods.

FIG. 41 is a timing chart showing control signals for the scanning line driving circuit obtained when a layout configuration of RGBW square pixels in Example 2 according to the sixth embodiment is adopted and when one initialization operation and four video signal write operations are performed during four horizontal scanning periods. The display apparatus in Example 2 according to the sixth embodiment corresponds to the display apparatus in Example 2 according to the fifth embodiment additionally provided with the reset switch RST2, the fourth scanning line Sgd, and the reset power supply line SLd.

Figure 42:
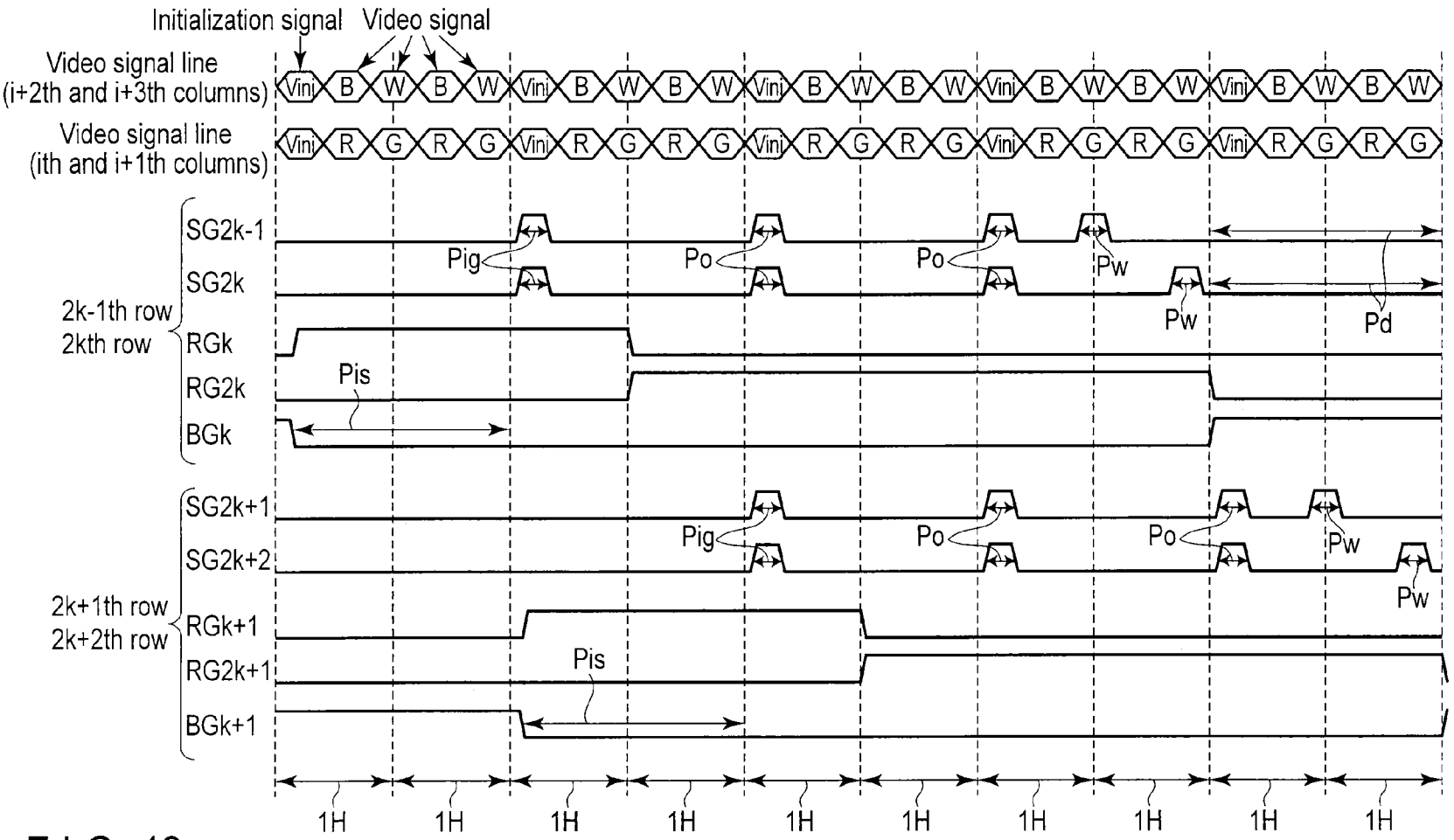
FIG. 42 is a timing chart showing control signals for the scanning line driving circuit obtained when a layout configuration of RGBW vertical-stripe pixels in Example 3 according to the sixth embodiment is adopted and when one initialization operation and four video signal write operations are performed during two horizontal scanning periods.

FIG. 42 is a timing chart showing control signals for the scanning line driving circuit obtained when a layout configuration of RGBW vertical stripe pixels in Example 3 according to the sixth embodiment is adopted and when one initialization operation and four video signal write operations are performed during two horizontal scanning periods. The display apparatus in Example 3 according to the sixth embodiment corresponds to the display apparatus in Example 3 according to the fifth embodiment additionally provided with the reset switch RST2, the fourth scanning line Sgd, and the reset power supply line SLd.

Figure 43:
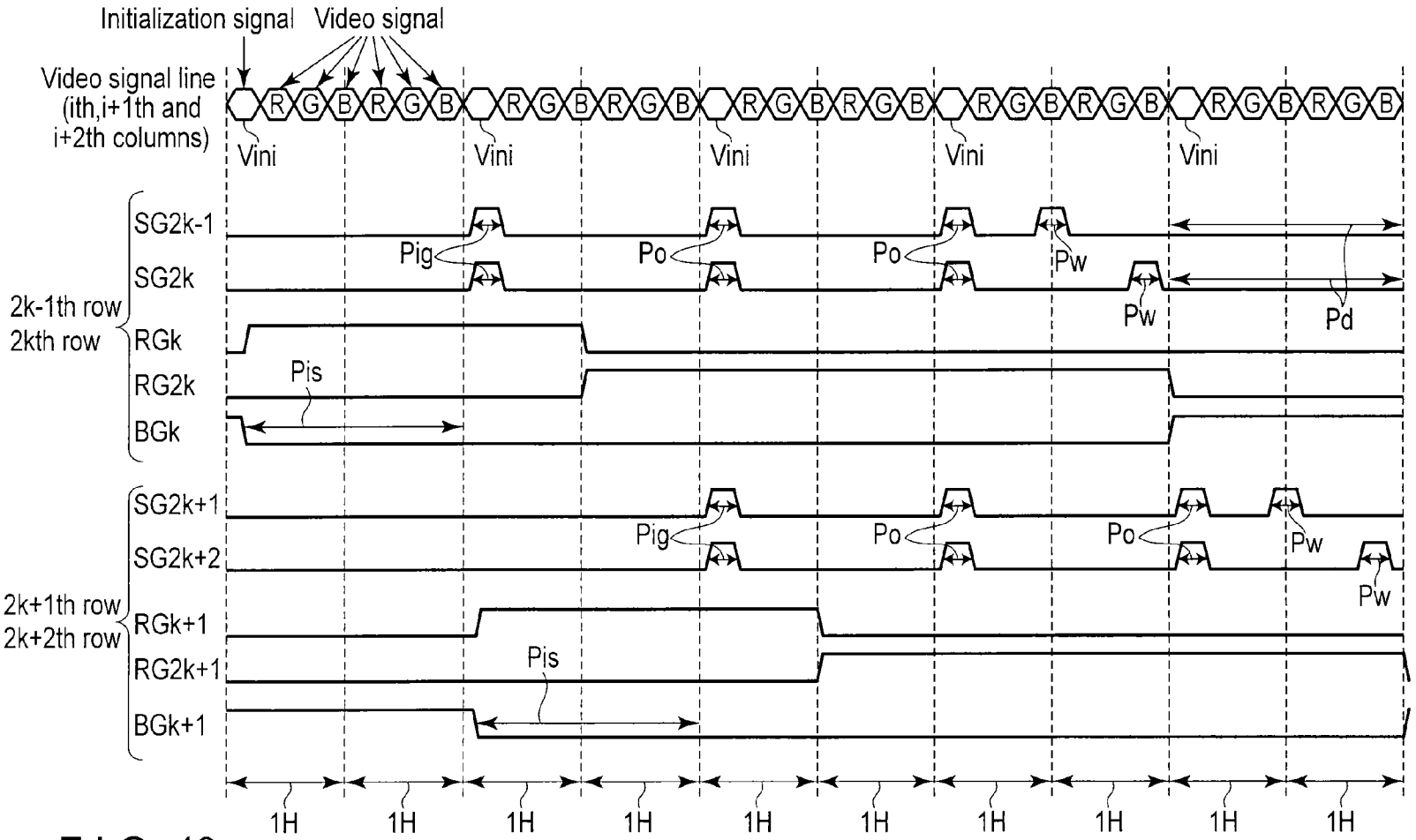
FIG. 43 is a timing chart showing control signals for the scanning line driving circuit obtained when a layout configuration of RGB vertical-stripe pixels in Example 4 according to the sixth embodiment is adopted and when one initialization operation and six video signal write operations are performed during two horizontal scanning periods.

FIG. 43 is a timing chart showing control signals for the scanning line driving circuit obtained when a layout configuration of RGB vertical stripe pixels in Example 4 according to the sixth embodiment is adopted and when one initialization operation and six video signal write operations are performed during two horizontal scanning periods. The display apparatus in Example 4 according to the sixth embodiment corresponds to the display apparatus in Example 4 according to the fifth embodiment additionally provided with the reset switch RST2, the fourth scanning line Sgd, and the reset power supply line SLd.

The methods of driving the display apparatus according to Example 1 to Example 4 each provide two offset cancel operations so that the pixel PX can display an image (emit light). However, the number of offset cancel operations is not limited to two but may be one or three or more.

Each of the scanning line driving circuits YDR1 and YDR2 generates, from a start signal and a clock, a pulse of a width equal to one horizontal scanning period corresponding to each horizontal scanning period, and outputs the pulse as a control signal BG, SG, RG or RG2.

The operation of a pixel circuit is divided into a source initialization operation performed during a source initialization period Pis, a gate initialization operation performed during a gate initialization period Pig, an offset cancel (OC) operation performed during an offset cancel period Po, a video signal write operation performed during a video signal write period Pw, and a display operation (light emission operation) performed during a display period Pd (light emission period).

As shown in FIG. 40 to FIG. 43, and FIG. 1 and FIG. 2, first, a driving section 10 performs a source initialization operation. During the source initialization operation, the scanning line driving circuits YDR1 and YDR2 set the control signal SG to the level at which a pixel switch SST is turned off, set the control signal BG to the level at which an output switch BCT is turned off, set the control signal RG to the level at which a reset switch RST is turned on, and set a control signal RG2 to the level at which a reset switch RST2 is turned off (off potential: in this case, the low level).

The output switch BCT, the pixel switch SST, and the reset switch RST2 are each turned off, and the reset switch RST is turned on. Thus, a source initialization operation is started. Turning the reset switch RST on resets the potentials of a source electrode and a drain electrode of a driving transistor DRT equal to the potential (reset potential Vrst) of a reset power supply. Then, the source initialization operation is completed. In this case, the reset power supply (reset potential Vrst) is set to, for example, −2 V.

Then, the driving section 10 performs a gate initialization operation. During the gate initialization operation, the scanning line driving circuits YDR1 and YDR2 set the control signal SG to the level at which the pixel switch SST is turned off, set the control signal BG to the level at which the output switch BCT is turned off, set the control signal RG to the level at which the reset switch RST is turned on, and set the control signal RG2 to the level at which the reset switch RST2 is turned off. The output switch BCT and the reset switch RST2 are turned off, and the pixel switch SST and the reset switch RST are turned on. Thus, a gate initialization operation is started.

During the gate initialization operation Pig, an initialization signal Vini (initialization voltage) output through a video signal line VL is applied to a gate electrode of the driving transistor DRT through the pixel switch SST. Thus, the potential of the gate electrode of the driving transistor DRT is reset to a value corresponding to the initialization signal Vini to initialize information in the preceding frame. The voltage level of the initialization signal Vini is set to, for example, 2 V.

In a display apparatus comprising a switching circuit 13, all switching element 56 are switched on in accordance with control signals (ASW1, ASW2, and ASW3) during the gate initialization period Pig. Thus, all the video signal lines VL are provided with the initialization signal Vini.

Subsequently, the driving section 10 performs an offset cancel operation. The control signal SG is set to the on potential, the control signal BG is set to the off potential, the control signal RG is set to the off potential, and the control signal RG2 is set to the on potential. Thus, the reset switch RST and the output switch BCT are turned off, and the pixel switch SST and the reset switch RST2 are turned on. An offset cancel operation for a threshold is started.

During the offset cancel period Po, the initialization signal Vini is applied to the gate electrode of the driving transistor DRT through the video signal line VL and the pixel switch SST. The potential of the gate electrode of the driving transistor DRT is fixed. Even during the offset cancel period Po, all the switching element 56 in the display apparatus comprising the switching circuit 13 are switched on.

Furthermore, the reset switch RST2 is in the on state, so that a current from other reset power supply flows into the driving transistor DRT through the reset switch RST2 and a reset line Sgr. In this case, the other reset power supply (reset potential Vrst2) is set to, for example, 5 V. The potential of the source electrode of the driving transistor DRT has an initial value equal to the potential (reset potential Vrst) written during the source initialization period Pis. While gradually reducing a current flowing into the driving transistor DRT through between the drain electrode and the source electrode of the driving transistor DRT, the potential of the source electrode of the driving transistor DRT shifts toward higher potentials while absorbing and compensating for a variation in the TFT property of the driving transistor DRT. According to the sixth embodiment, the offset cancel period Po is set to a time of, for example, 1 μsec.

At the end of the offset cancel period Po, the potential of the source electrode of the driving transistor DRT is Vini−Vth. Thus, the voltage between the gate electrode and the source electrode of the driving transistor DRT reaches a cancel point (Vgs=Vth). A potential difference corresponding to the cancel point is stored (held) in a storage capacitance Cs. As in examples illustrated in FIG. 40 to FIG. 43, two offset cancel periods Po can be provided as necessary.

Subsequently, during the video signal write period Pw, the control signal SG is set to the level at which the pixel switch SST is turned on. The control signal BG is set to the level at which the output switch BCT is turned off. The control signal RG is set to the level at which the reset switch RST is turned off. The control signal RG2 is set to the level at which the reset switch RST2 is turned on. Then, the pixel switch SST and the reset switch RST2 are turned on, and the output switch BCT and the reset switch RST are turned off. A video signal write operation is started.

During the video signal write period Pw, a video signal Vsig from the video signal line VL is written to the gate electrode of the driving transistor DRT through the pixel switch SST. Furthermore, a current from other reset power supply flows to the driving transistor DRT via the reset switch RST2 and the reset line Sgr. Immediately after the pixel switch SST is turned on, the potential of the gate electrode of the driving transistor DRT is Vsig (R, G, B, W), and the potential of the source electrode of the driving transistor is Vini−Vth+Cs(Vsig−Vini)/(Cs+Cel+Cad).

Subsequently, a current flows to a low-potential power supply line SLb via a capacitance section Cel of a diode OLED. At the end of the video signal write period Pw, the potential of the gate electrode of the driving transistor DRT is Vsig (R, G, B, W), and the potential of the source electrode of the driving transistor DRT is Vini−Vth+ΔV1+Cs(Vsig−Vini)/(Cs+Cel+Cad). Thus, a variation in the mobility in the driving transistor DRT is corrected.

In the display apparatus comprising the switching circuit 13, the switching elements 56 of each switching element group 55 are switched on in order in accordance with the control signals (ASW1, ASW2, and ASW3) during the video signal write period Pw. Driving the video signal lines VL in a time division manner allows all the video signal lines VL to be provided with the video signal Vsig in order.

Finally, during the display period Pd, the control signal SG is set to the level at which the pixel switch SST is turned off. The control signal BG is set to the level at which the output switch BCT is turned on. The control signal RG is set to the level at which the reset switch RST is turned off. The control signal RG2 is set to the level at which the reset switch RST2 is turned off. Then, the output switch BCT is turned on, and the pixel switch SST, the reset switch RST, and the reset switch RST2 are turned off. A display operation is started.

The driving transistor DRT outputs a driving current Iel of a current amount corresponding to the gate control voltage written to the storage capacitance Cs. The driving current Iel is supplied to the diode OLED. Thus, the diode OLED emits light at a luminance according to the driving current Iel to perform a display operation. The diode OLED maintains the light emission state until, after one frame period, the control signal BG is set to the off potential again.

The above-described source initialization operation, gate initialization operation, offset cancel operation, video signal write operation, and display operation are sequentially and repetitively performed on each pixel PX to display the desired image.

In the display apparatus and the method of driving the display apparatus according to the sixth embodiment configured as described above, the display apparatus comprises the plurality of video signal lines VL, the plurality of scanning lines (first scanning lines Sga, second scanning lines Sgb, third scanning lines Sgc, and fourth scanning lines Sgd), the plurality of reset lines Sgr, and the plurality of pixels PX.

The method of driving the display apparatus comprises the source initialization operation, the gate initialization operation, the offset cancel operation, the video signal write operation, and the display operation (light emission operation). In Example 1, during two horizontal scanning periods, the video signals Vsig for two rows can be provided in order after the initialization signal Vini is applied to the video signal line VL. In Example 2, during four horizontal scanning periods, the video signals Vsig for four rows can be provided in order after the initialization signal Vini is applied to the video signal line VL.

In Example 3, during two horizontal scanning periods, the video signals Vsig for two rows can be provided in order after the initialization signal Vini is applied to the video signal line VL. In Example 4, during two horizontal scanning periods, the video signals Vsig for two rows can be provided in order after the initialization signal Vini is applied to the video signal line VL.

As described above, during j horizontal scanning periods, the video signals Vsig for j rows can be provided in order after the initialization signal Vini is applied to the video signal line VL. This allows effects similar to the effects of the first embodiment to be produced.

The scanning line driving circuit YDR2 comprises the reset switch RST2. In the offset cancel operation, the reset switch RST2 can switch the other reset power supply and the driving transistor DRT to the electrically continuous state. This allows the value of the voltage (Vds) between the drain electrode and the source electrode of the driving transistor DRT obtained at the end of the offset cancel operation to be brought closer to the value of the voltage (Vds) obtained during a display operation (during white display). Thus, the sixth embodiment can obtain a display apparatus that is excellent in display quality compared to the display apparatus according to the first embodiment.

As described above, a method for driving a high-definition display apparatus can be obtained which allows the limitations on the write of the video signal Vsig to be mitigated. Furthermore, a display apparatus allowing a slim border can be obtained.

The fifth and sixth embodiments are only illustrative and are not intended to limit the scope of the invention. In a practical phase, the fifth and sixth embodiments can be embodied with components thereof modified and without departing from the spirits of the invention. Furthermore, various inventions can be formed by appropriately combining a plurality of components disclosed in the embodiments. For example, some of all the components disclosed in the embodiments may be deleted. Moreover, components of the different embodiments may be appropriately combined together.

For example, during j horizontal scanning periods, the video signals Vsig for at least j rows can be provided in order after the initialization signal Vini is applied to the video signal line VL, according to the method of driving the display apparatus. This allows the effects of the above-described embodiments to be produced. Reference character j denotes a natural number of 2 or more.

During j horizontal scanning periods, the video signals Vsig for j rows may be provided in order after the initialization signal Vini is applied to the video signal line VL, as disclosed in Examples 1 to 4 according to the fifth embodiment and Examples 1 to 4 according to the six embodiment.

Furthermore, when the video signals Vsig for four rows are provided in order, the video signals Vsig may be consecutively applied to a plurality of pixels PX displaying images in the same color, as disclosed in Example 2 according to the fifth embodiment and Example 2 according to the six embodiment.

Moreover, during j horizontal scanning periods, the video signals Vsig for (2×j) rows may be provided in order after the initialization signal Vini is applied to the video signal line VL. Alternatively, during j horizontal scanning periods, the video signals Vsig for (3×j) rows may be provided in order after the initialization signal Vini is applied to the video signal line VL.

A semiconductor layer in the TFT is not limited to polysilicon but may be formed of amorphous silicon. The TFT forming each switch or the driving transistor DRT is not limited to an N-channel TFT but may comprise a P-channel TFT. Similarly, each of the reset switches RST and RST2 may comprise a P-channel TFT or an N-channel TFT. The shapes and sizes of the driving transistor DRT and the switches are not limited to the shapes and sizes according to the above-described embodiments but may be changed as necessary.

Furthermore, one output switch BCT is provided for and shared by four or six pixels PX. However, the present invention is not limited to this configuration, and the number of the output switches BCT may be increased or reduced as necessary. For example, two pixels PX provided in two rows and one column may share one output switch BCT or eight pixels PX provided in two rows and four columns may share one output switch BCT.

Moreover, a self-illuminated element forming the pixel PX is not limited to the diode (organic EL diode) OLED but may be formed by using any of various display elements which can be self-illuminated.

The additional capacity Cad may be connected between the source electrode of the driving transistor DRT and a constant-potential line. Examples of the constant-potential line include the high-potential power supply line SLa, the low-potential power supply line SLb, and the reset line Sgr.

The fifth and sixth embodiments are not limited to the above-described display apparatuses and methods of driving the display apparatus but may be applied to various display apparatuses and methods of driving the display apparatus.

Matters related to the fifth and sixth embodiments and modifications thereof are disclosed in (C1) to (C7).

(C1) A method of driving a display apparatus comprising a plurality of pixels provided in a matrix along a row direction and a column direction, each of the pixels comprising a display element connected between a high-potential power supply and a low-potential power supply, a driving transistor comprising a source electrode connected to the display element, a drain electrode connected to a reset line, and a gate electrode, an output switch connected between the high-potential power supply and the drain electrode of the driving transistor and configured to switch a state between the high-potential power supply and the drain electrode of the driving transistor to an electrically continuous state or an electrically discontinuous state, a pixel switch connected between a video signal line and the gate electrode of the driving transistor and configured to determine, in a switchable manner, whether to load a signal provided through the video signal line onto the gate electrode side of the driving transistor, and a storage capacitance connected between the source electrode and the gate electrode of the driving transistor, the method comprising:

during a source initialization period, applying a reset signal to the drain electrode of the driving transistor through the reset line;

during a gate initialization period following the source initialization period, with the reset signal applied to the drain electrode of the driving transistor, applying an initialization signal to the gate electrode of the driving transistor through the video signal line and the pixel switch to initialize the driving transistor;

during an offset cancel period following the gate initialization period, with the initialization signal applied to the gate electrode of the driving transistor, passing a current from the high-potential power supply to the driving transistor through the output switch to cancel a threshold offset for the driving transistor;

during a video signal write period following the offset cancel period, applying a video signal to the gate electrode of the driving transistor through the video signal line and the pixel switch to pass a current from the high-potential power supply to the low-potential power supply through the output switch, the driving transistor, and the display element; and during a display period following the video signal write period, passing a driving current corresponding to the video signal from the high-potential power supply to the display element through the output switch and the driving transistor, and when a natural number of 2 or more is denoted by j, providing the video signals for at least j rows in order after applying the initialization signal to the video signal line, during j horizontal scanning periods.

(C2) The method of driving the display apparatus according to (C1), wherein, during the j horizontal scanning periods, the video signals for j rows are provided in order after the initialization signal is applied to the video signal line.

(C3) The method of driving the display apparatus according to (C2), wherein, when the video signals for j rows are provided in order, the video signals are consecutively applied to a plurality of pixels displaying images in an identical color.

(C4) The method of driving the display apparatus according to (C1), wherein, during the j horizontal scanning periods, the initialization signal is applied to the video signal line, and then, the video signals for (2×j) rows are provided in order.

(C5) The method of driving the display apparatus according to (C1), wherein, during the j horizontal scanning periods, the initialization signal is applied to the video signal line, and then, the video signals for (3×j) rows are provided in order.

(C6) The method of driving the display apparatus according to any one of (C2), (C4), and (C5), wherein j is 2.

(C7) The method of driving the display apparatus according to (C1), wherein a plurality of the offset cancel periods is provided between the gate initialization period and the video signal write period.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display apparatus comprising:

a plurality of pixels each comprising a display element connected between a high-potential power supply and a low-potential power supply and a pixel circuit controlling driving of the display element, the pixels being provided in a matrix along a row direction and a column direction, n pixels being arranged in the row direction, 2m pixels being arranged in the column direction, n and m being natural numbers; and a plurality of control lines comprising m reset lines extending in the row direction and arranged in the column direction, m first scanning lines extending in the row direction and arranged in the column direction, and 2m second scanning lines extending in the row direction and arranged in the column direction, the pixel circuit comprising:

a driving transistor comprising a source electrode connected to the display element, a drain electrode, and a gate electrode, the driving transistor connected to each of the m reset lines;

an output switch which is connected between the high-potential power supply and the drain electrode of the driving transistor, is configured to switch a state between the high-potential power supply and the drain electrode of the driving transistor to an electrically continuous state or an electrically discontinuous state, and is connected to each of the m first scanning lines;

a pixel switch which is connected between a video signal line and the gate electrode of the driving transistor, is configured to determine, in a switchable manner, whether to load a signal provided through the video signal line onto the gate electrode side of the transistor, and is connected to each of the 2 m second scanning lines; and a storage capacitance connected between the source electrode and the gate electrode of the driving transistor, wherein a number of pixels of the plurality of pixels which are adjacent to one another in the column direction share the output switch, wherein two of the 2 m second scanning lines are arranged between two of the m first scanning lines which are adjacent to each other in the column direction, wherein two of the 2 m second scanning lines are arranged between two of the m reset lines which are adjacent to each other in the column direction, and wherein one of the pixels including one of the two of the 2 m second scanning lines and another one of the pixels including the other of the two of the 2 m second scanning lines are adjacent to each other in the column direction.

2. The display apparatus according to claim 1, wherein the drain electrode of the driving transistor in the pixel circuit is connected to the each of the in reset lines, and wherein n video signal lines extend in the column direction and are arranged in the row direction.

3. The display apparatus according to claim 2, wherein the plurality of pixels comprise a first pixel, a second pixel adjacent to the first pixel in the column direction, a third pixel adjacent to the first pixel in the row direction, and a fourth pixel adjacent to the second pixel in the row direction and to the third pixel in the column direction, and the first to fourth pixels share the output switch.

4. The display apparatus according to claim 3, wherein the plurality of pixels include pixels arranged in the row direction and including a pixel configured to display a red image, a pixel configured to display a green image, a pixel configured to display a blue image, and a pixel configured to display a white image, and pixels arranged in the column direction are configured to display images in an identical color.

5. The display apparatus according to claim 3, wherein the output switch is provided in a central portion of the first to fourth pixels.

6. The display apparatus according to claim 1, wherein the video signal line and the pixel switch are provided opposite each other across an insulating film and connected together through a contact hole provided in the insulating film, and two pixels of the plurality of pixels adjacent to each other in the row direction share the contact hole.

7. The display apparatus according to claim 1, further comprising:

a scanning line driving circuit connected to the plurality of control lines; and a signal line driving circuit connected to the video signal line, wherein the signal line driving circuit applies an initialization signal or a video signal to the video signal line.

8. The display apparatus according to claim 7, wherein the scanning line driving circuit further comprises:

a first reset power supply;

a third scanning line; and a first reset switch connected between the first reset power supply and the reset line and configured to switch a state between the first reset power supply and the reset line to the electrically continuous state or the electrically discontinuous state, in accordance with a control signal provided through the third scanning line.

9. The display apparatus according to claim 8, further comprising:

a second reset power supply;

a fourth scanning line; and a second reset switch connected between the second reset power supply and the reset line and configured to switch a state between the second reset power supply and the reset line to the electrically continuous state or the electrically discontinuous state, in accordance with a control signal provided through the fourth scanning line.

10. The display apparatus according to claim 1, wherein the pixel circuit further comprises an additional capacitance connected between the source electrode of the driving transistor and a constant-potential line.

11. The display apparatus according to claim 10, wherein the constant-potential line is connected to the high-potential power supply.

12. The display apparatus according to claim 1, further comprising a scanning line driving circuit with a plurality of output sections, wherein each of the plurality of output sections is connected to the plurality of control lines and configured to provide a control signal to the pixel circuits of the plurality of pixels provided in a plurality of rows.

13. The display apparatus according to claim 12, wherein the plurality of control lines connected to each of the plurality of output sections are the plurality of reset lines, and the control signal is a reset signal.

14. The display apparatus according to claim 12, wherein each of the plurality of output sections is configured to apply a control signal to the pixel circuits of the plurality of pixels provided in at least four rows.

15. The display apparatus according to claim 13, wherein each of the plurality of output sections comprises a first reset switch connected between a first reset power supply and the reset line and configured to switch a state between the first reset power supply and the reset line to the electrically continuous state or the electrically discontinuous state in accordance with an applied control signal.

16. The display apparatus according to claim 15, wherein each of the plurality of output sections comprises a second reset switch connected between a second reset power supply and the reset line and configured to switch a state between the second reset power supply and the reset line to the electrically continuous state or the electrically discontinuous state in accordance with an applied control signal.

17. The display apparatus according to claim 1, wherein the driving transistor comprises an N-channel thin film transistor.

18. The display apparatus according to claim 17, wherein each of the output switch and the pixel switch comprises one of an N-channel thin film transistor and a P-channel thin film transistor.

19. A display apparatus, comprising:

a plurality of pixels each comprising a display element connected between a high-potential power supply and a low-potential power supply and a pixel circuit controlling driving of the display element, the pixels being provided in a matrix along a row direction and a column direction; and a plurality of control lines comprising a plurality of reset lines and extending in the row direction to connect to the pixel circuits of the plurality of pixels, the pixel circuit comprising:

a driving transistor comprising a source electrode connected to the display element, a drain electrode, and a gate electrode, the driving transistor connected to each of in reset lines;

an output switch which is connected between the high-potential power supply and the drain electrode of the driving transistor, and is configured to switch a state between the high-potential power supply and the drain electrode of the driving transistor to an electrically continuous state or an electrically discontinuous state;

a pixel switch which is connected between a video signal line and the gate electrode of the driving transistor, and is configured to determine in a switchable manner, whether to load a signal provided through the video signal line onto the gate electrode side of the transistor; and a storage capacitance connected between the source electrode and the gate electrode of the driving transistor, wherein a number of pixels of the plurality of pixels which are adjacent to one another in the column direction share the output switch, wherein the plurality of control lines include a first gate line and a second gate line each of which controls turning on and off of the pixel switch and each of which extends in the row direction, wherein the plurality of reset lines include a first reset line which is the reset line, wherein the plurality of pixels include a plurality of first pixels each of which is the pixel and is connected to the first gate line and the first reset line, and a plurality of second pixels each of which is the pixel and is connected to the second gate line and the first reset line, wherein each of the first pixels and each of the second pixels share the output switch in the column direction, and are adjacent to each other in the column direction, wherein in a first timing, the drain electrodes of the driving transistors of each of the first pixels and each of the second pixels receive a reset signal through the first reset line, the gate electrodes of the driving transistors of each of the first pixels and each of the second pixels receive an initialization signal, and the output switch of each of the first and second pixels is turned off, wherein in a second timing after the first timing, the storage capacitor and the gate electrode of the driving transistor of each of the first pixels receive the video signal, the pixel switch of each of the first pixels is turned on, and the pixel switch of each of the second pixels is turned off, wherein in a third timing after the second timing, the storage capacitor and the gate electrode of the driving transistor of each of the plurality of second pixels receive the video signal, the pixel switch of each of the second pixels is turned on, and the pixel switch of each of the first pixels is turned off, and wherein in a fourth timing after the third timing, the driving transistors of each of the first pixels and each of the second pixels flow driving currents for emitting light of the drive element of each of the first and the second pixels based on the video signal stored in the storage capacitor of each of the first and the second pixels, and the output switch of the first and the second pixels is turned on.

20. The display apparatus according to claim 19, wherein in a fifth timing between the first timing and the second timing, the drain electrodes of the driving transistors of each of the first pixels and each of the second pixels receive the high-potential power supply, the gate electrodes of the driving transistors of each of the first pixels and each of the second pixels receive the initialization signal, and the output switch of each of the first and the second pixels is turned on, wherein in the second timing, the drain electrodes of the driving transistors of each of the first pixels and each of the second pixels receive the high-potential power supply, and the output switch of each of the first and the second pixels is turned on, and wherein in the third timing, the drain electrodes of the driving transistors of each of the first pixels and each of the second pixels receive the high-potential power supply, and the output switch of each of the first and the second pixels is turned on.

21. The display apparatus according to claim 19, wherein in a fifth timing between the first timing and the second timing, the drain electrodes of the driving transistors of each of the first pixels and each of the second pixels receive another reset signal different from the reset signal, the gate electrodes of the driving transistors of each of the first pixels and the second pixels receive the initialization signal, and the output switch of each of the first and the second pixels is turned off, wherein in the second timing, the drain electrodes of the driving transistors of each of the first pixels and each of the second pixels receive the other reset signal, and the output switch of each of the first and the second pixels is turned off, and wherein in the third timing, the drain electrodes of the driving transistors of each of the first pixels and each of the second pixels receive the other reset signal, and the output switch of each of the first and the second pixels is turned off.

22. A display apparatus comprising:

a plurality of pixels each comprising a display element connected between a high-potential power supply and a low-potential power supply and a pixel circuit controlling driving of the display element, the pixels being provided in a matrix along a row direction and a column direction; and a plurality of control lines comprising a plurality of reset lines and extending in the row direction to connect to the pixel circuits of the plurality of pixels, the pixel circuit comprising:

a driving transistor comprising a source electrode connected to the display element, a drain electrode, and a gate electrode, the driving transistor connected to each of m reset lines;

an output switch which is connected between the high-potential power supply and the drain electrode of the driving transistor, and is configured to switch a state between the high-potential power supply and the drain electrode of the driving transistor to an electrically continuous state or an electrically discontinuous state;

a pixel switch which is a single transistor, is directly connected a video signal line and the gate electrode of the driving transistor, and is configured to determine, in a switchable manner, whether to load a signal provided through the video signal line onto the gate electrode side of the transistor; and a storage capacitance connected between the source electrode and the gate electrode of the driving transistor, wherein a number of pixels of the plurality of pixels which are adjacent to one another in the column direction share the output switch.

* * * * *